US006731893B2

(12) United States Patent
Okoshi

(10) Patent No.: US 6,731,893 B2
(45) Date of Patent: May 4, 2004

(54) DEVELOPER HANDLING APPARATUS

(75) Inventor: Takeshi Okoshi, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 21 days.

(21) Appl. No.: 10/013,539

(22) Filed: Dec. 13, 2001

(65) Prior Publication Data

US 2003/0012583 A1 Jan. 16, 2003

(30) Foreign Application Priority Data

Jul. 12, 2001 (JP) ..... 2001-212366

(51) Int. Cl.[7] ..... G03G 15/04
(52) U.S. Cl. ..... 399/119; 399/111; 399/262
(58) Field of Search ..... 399/107, 109, 399/111, 113, 114, 119, 120, 262, 263

(56) References Cited

U.S. PATENT DOCUMENTS 5,867,751 A * 2/1999 Nomura et al. ..... 399/90

FOREIGN PATENT DOCUMENTS

JP A 10-3247 1/1998

* cited by examiner

*Primary Examiner*—Hoang Ngo
(74) *Attorney, Agent, or Firm*—Oliff & Berridge, PLC

(57) ABSTRACT

A housing 10 of a development apparatus is vertically divided into two segments; a lower housing 20 and an upper housing 30. The housings 20, 30 are fixedly joined together without use of fixing means such as screwing or welding means but by means of causing a plurality of engaging projection pieces 26 formed on a joining surface section 25 to engage with engage holes 36 formed on a joining surface section 35, and causing resiliently-deformable snap-fit engaging sections 27 to engage with engaged sections 37. Side brackets 40, 50 are fitted to respective sides of the thus-joined housings 20, 30, thereby reinforcing the joined state of the housings 20, 30. No damage arises at the time of assembly or disassembly of the housing, and the housing can be reused.

29 Claims, 44 Drawing Sheets

DEVELOPER HANDLING APPARATUS

BACKGROUND OF THE INVENTION

1. Field of the Invention

The present invention relates to an apparatus for handling a developing device, a developer container, and an apparatus for handling a developer, such as a developer recycling apparatus (also called a "developer handling apparatus"), which are used in an image forming apparatus for forming an image made of powder developer such as a printer, a copier, a facsimile, a complex machine, and the like and more particularly, to a developer handling apparatus which is relatively easy to assemble, disassemble, and reuse.

2. Description of the Related Art

In an image forming apparatus such as a printer utilizing an image forming method such as electrophotography or electrostatic recording, an electrostatic latent image formed on an image carrier such as a photosensitive member is developed with a powderlike developer, thereby forming an image made of the developer. The image is transferred to a recording medium, such as recording paper, directly or via an intermediate transfer member. Such an image forming apparatus is equipped with, e.g., a developing apparatus which contains and supplies the developer.

As such a development apparatus, a development apparatus having the following construction has been known. Specifically, an enclosed case (such as a housing or casing) having a storage section for storing the developer and an opening for enabling the developer passing therethrough is divided into a plurality of segments. Attachment components, including rotating members such as a development roller and a developer agitating-and-conveying rotator, are attached to the thus-divided segments. All the segments are joined together, and joints are fixed by means of welding or screwing, thereby assembling the development apparatus.

The development apparatus having the foregoing construction poses the following problems.

When the joints between the segments are fixed together by means of welding, complicated welding operations and subsequent complicated disassembly jobs are required. Further, damage is inflicted on the thus-welded joints at the time of disassembly of the joints. The workability of assembly or disassembly of the development apparatus is poor. Particularly when reuse of the development apparatus is to be considered, the damage inflicted on the development apparatus during disassembly hinders reuse of the apparatus.

In contrast, when the joints of the segments are fastened together by means of screwing, operations required for fastening or removing screws are unexpectedly troublesome, and much time is required. Further, screw holes are simple holes, and single use of such screw holes poses difficulty in reuse of the holes. Substantially as in the case where the joints are fixed through welding, the segments are not easy to assemble and disassemble. Thus, the segments are not suitable for reuse.

Incidentally, JP-A-Hei. 10-3247 describes an image formation unit. A photosensitive member, a development device, and an electrostatic charger are housed in an integral casing. Of this casing, a portion which stores and transports or moves toner and developer is divided into two segments. Of outer brims of the split segments to be fastened, portions having a bearing section and a movable section provided therein are screw-engaged together. Other portions of the outer brims of the segments to be fastened are engaged by means of engaging means comprising a claw and an opening.

Although the image formation unit is intended to improve ease of disassembly and assembly of the unit, a portion of the outer brims of the split segments is still screw-engaged. Hence, the image formation unit still suffers the same problem as that suffered by the development apparatus adopting screw-threading (i.e., difficulty in assembly and disassembly, and the image formation unit being not suitable for reuse).

As in the casing of the image formation unit, a casing made of plastic (synthetic resin) is used, and screw holes are formed in one of the two segments. Screw insertion holes are formed in the remaining segment, and the segments are screw-engaged together. In many cases, the following construction is adopted. Namely, screw threads are not formed in the screw holes beforehand. The screw holes are mere holes which are smaller in diameter than screws. When a screw is screw-threaded into any of the screw holes, a screw thread is formed in an interior wall surface of the screw hole for the first time while chipping off the interior wall surface. First screw-threading of the screw is effected well. However, once the screw has been removed, when the screw is again screw-threaded into the same screw hole, the screw thread artificially formed in the screw hole is vulnerable to corruption, and reliable fastening of the segments becomes difficult. Consequently, reliable screwing of the screw for the second time or subsequent to the second time is likely to become difficult or impossible. Consequently, when a casing adopts such screws, the casing is not suitable for re-assembly. Particularly when reuse of the casing is to be considered, difficulty in reusing the casing is a weak point.

The problem relevant to ease of assembly and disassembly of segments when a plurality of segments are assembled into a housing, such as that described in connection with the foregoing development apparatus, and the problem relevant to suitability of the housing to reuse may arise in the following apparatus which handles developer.

For example, the apparatus is a developer container (such as a toner bottle) which stores developer to be replenished to the development apparatus and is provided with a rotary member therein for agitating and transporting the stored developer. Another alternative of the apparatus is a (discarded) developer reclaim container. The reclaim container removes with a cleaning device the developer still remaining on an image carrier or an intermediate transfer member. The thus-removed developer is reclaimed by the reclaim container, and the reclaim container is equipped with a rotary member for leveling the thus-reclaimed developer. Still another alternative of the apparatus is a (deteriorated) developer reclaim container. A developer which has become old and deteriorated in the development apparatus is caused to flood, and the developer reclaim container is equipped with a rotary member for reclaiming the thus-flooded developer and leveling the thus-reclaimed developer. Yet another alternative of the apparatus is a developer transporting apparatus using a developer transport passage (a tube-like housing), the passage having provided therein a rotary member for transporting a developer.

SUMMARY OF THE INVENTION

The present invention has been conceived in view of the foregoing circumstances and primarily aims at providing a developer handling apparatus which comprises a housing including a storage section for storing a powder-like developer and an opening for enabling the developer passing therethrough and a rotary member to be attached to the housing so as to rotate in the housing, wherein even when the housing is separated into two or more segments, the segments are comparatively easy to assemble and disassemble; and when reuse of the developer handling apparatus is planned the developer handling apparatus is easy to reuse.

According to the invention, there is provided a developer handling apparatus comprising:

a casing including a storage section for storing a powder-like developer and an opening section passed the developer therethrough; and a rotary member disposed to rotate within the casing, wherein the casing is a structural body assembled by fixedly joining together a plurality of split housing pieces;

joining sections of at least a part of the split housing pieces are made of synthetic resin; and the joining sections made of synthetic resin are fixedly joined together so that damage is not inflicted on the joining sections when the split housing pieces are disassembled.

BRIEF DESCRIPTION OF THE DRAWINGS

FIG. 1 conceptually shows a developer handling apparatus, wherein

FIG. 12 shows the upper housing, wherein

FIG. 16 shows a development roller, wherein

FIG. 17 shows an auger, wherein

FIG. 18 shows a paddle wheel, wherein

FIG. 22 shows a first side bracket, wherein

FIG. 23 shows a first side bracket, wherein

FIG. 29 shows a development apparatus after the upper and lower housings have been fixedly joined together, wherein

FIG. 31 shows the development apparatus when assemble of the development apparatus equipped with the side brackets has been completed, wherein

FIG. 35 shows a structure for mounting a driven-side end section of the development apparatus, wherein

FIG. 36 shows a structure for mounting another end section of the development apparatus, wherein

DESCRIPTION OF THE INVENTION

Figure 1A:
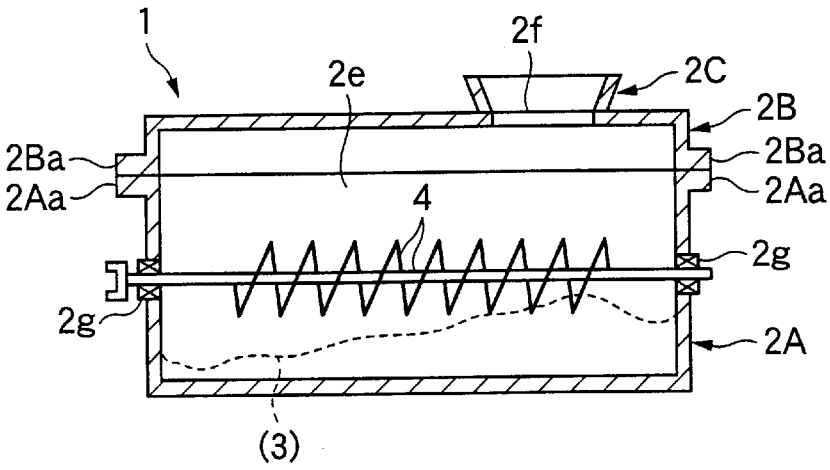
FIG. 1A is a schematic cross-sectional view showing the entirety of the apparatus.
Figure 1B:
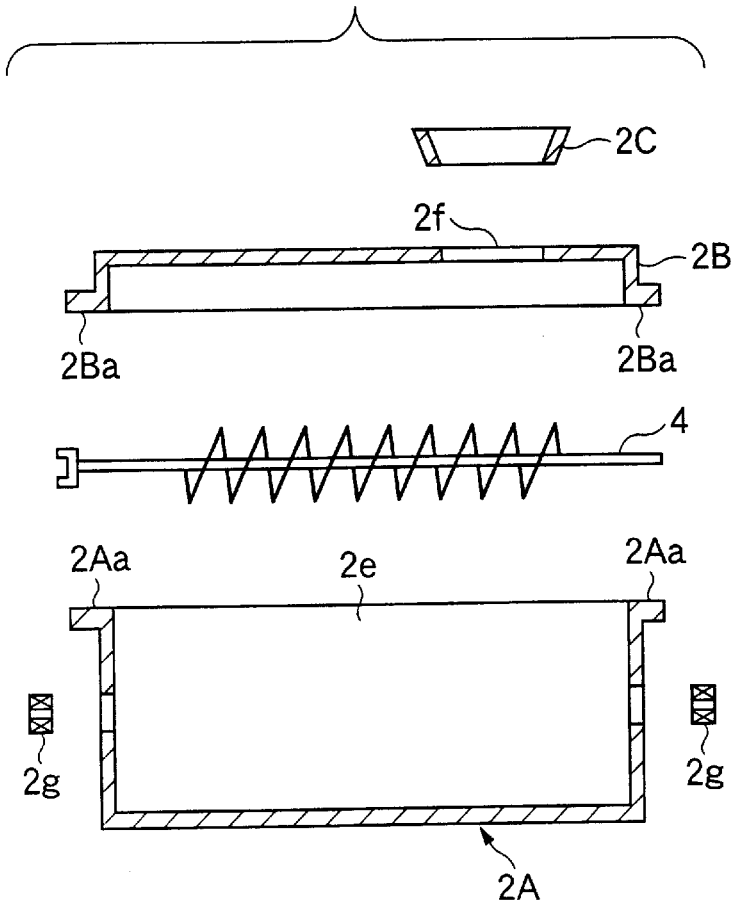
FIG. 1B is an exploded cross-sectional view of the same.

As conceptually illustrated in FIG. 1, a developer handling apparatus according to the present invention (first invention) is an apparatus comprising a housing 2 including a storage section 2*e* for storing a powder-like developer 3 and an opening section 2*f* for enabling the developer 3 passing therethrough; and a rotary member 4 attached so as to rotate within the housing 2. The housing 2 is a structural body assembled by means of fixedly joining together a plurality of split housing pieces 2A, 2B, and 2C. Of the split housing pieces 2A through 2C, joining sections 2A*a* and 2B*a* of at least the split housing pieces 2A and 2B are made of synthetic resin. The joining sections 2A*a* and 2B*a* made of synthetic resin are fixedly joined together such that damage is not inflicted on the joining sections 2A*a* and 2B*a* when the split housing pieces 2A and 2B are disassembled.

No limitations are imposed on the kind of synthetic resin, and any type of synthetic resin can be employed, so long as it can form joining sections. The entirety of the housing 2 including the joining sections may be made of synthetic resin. Fixed joining of the joining sections which does not inflict damage to the joining sections at the time of disassembly is realized, by a fixing section which keeps the joining sections made of synthetic resin in their original shapes without inflicting damage on the joining sections (without breaking the joining sections) at the time of disassembly. No particular limitations are imposed on the fixing section, so long as a fixing operation and an unfixing operation can be performed comparatively readily. Further, no particular limitations on structure and quantity are imposed on the housing section 2*e*, the opening section 2*f*, the split housing pieces (2A through 2C), and the rotary member 3. Among the split housing pieces, at least the a part of split housings (2A, 2B) primarily correspond to split housings requiring separation for disassembly of the housing. Reference numeral 2*g* shown in FIG. 1 represents a bearing of the rotary member 4.

According to the developer handling apparatus 1 according to the first invention, particularly when at least the a part of split housing pieces (2A, 2B) are disassembled, no damage is inflicted on the joining sections made of synthetic resin (2A*a*, 2B*a*). The disassembled split housing pieces (2A, 2B) can again be fixedly joined together by means of joining the joining sections (2A*a*, 2B*a*). Hence, the developer handling apparatus 1 can be reused.

As conceptually illustrated in FIG. 1 and FIGS. 2 through 7, a developer handling apparatus according to the present invention (second invention) comprises a housing 2 including a storage section 2*e* for storing a powder-like developer 3 and an opening section 2*f* for enabling the developer 3 passing therethrough; and a rotary member 4 attached so as to rotate within the housing 2, wherein the housing 2 is a structural body assembled by means of fixedly joining together a plurality of split housing pieces 2A, 2B, and 2C; and wherein, of the split housing pieces 2A through 2C, at least the a part of split housing pieces 2A and 2B are fixed together by use of one or more of first through fourth fixing sections; that is, a first fixing section made of a resilient engaging member 5, which engaging member is to be pressed in against resilient deformation force and engaged under restoration force; a second fixing section constituted of a projection 6*a* and a receiving section 6*b* into which the projection 6*a* is to be fixedly fitted; a third fixing section constituted of holes 7*a*, 7*b* which mutually oppose when the split housing pieces (2A, 2B) are joined together, and an insertion member 7*c* to be fixedly inserted into the mutually-opposing holes 7*a*, 7*b*; and a fourth fixing section for causing the split housing pieces 2A, 2B to adhere to each other with a removable material 8 possessing adhesion properties sandwiched therebetween.

Here, no particular limitations on structure and quantity are imposed on the housing section 2*e*, the opening section 2*f*, the split housing pieces (2A through 2C), and the rotary member 3 as well as the first invention. As in the case of the first invention, among the split housing pieces, at least the a part of split housings (2A, 2B) primarily correspond to split housings requiring separation for disassembly of the housing.

According to the developer handling apparatus 1 according to the second invention, at least the split housing pieces (2A, 2B) are fixed together by use of only one or many of the first through fourth fixing sections described previously. As a result, assembly and disassembly of the split housing pieces (2A, 2B) can be performed comparatively easily. Further, the split housing pieces are fixed by use of one or more of the first through fourth fixing sections. As a result, at the time of disassembly of the split housing pieces (2A, 2B), the joining sections (2A*a*, 2B*a*) of the split housing pieces are not broken by fixing sections such as welding or screwing (without involvement of advanced formation of a screw thread in a screw hole). As a result, the thus-disassembled split housing pieces (2A, 2B) can again be joined together by use of the joining sections (2A*a*, 2B*a*) and be fixed only by one or more of the first through fourth fixing sections. Hence, the developer handling apparatus can be reused.

Figure 2A:
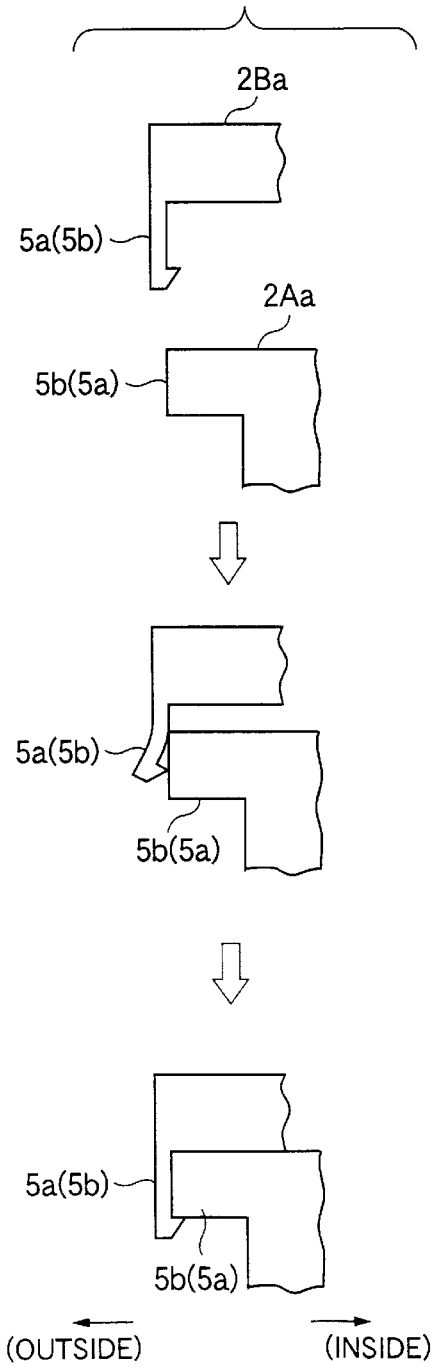
FIGS. 2A and 2B are descriptive views showing an example construction from among typical examples of first fixing means, in which a resiliently deformable engaging or engaged section is situated in an outer position.
Figure 2B:
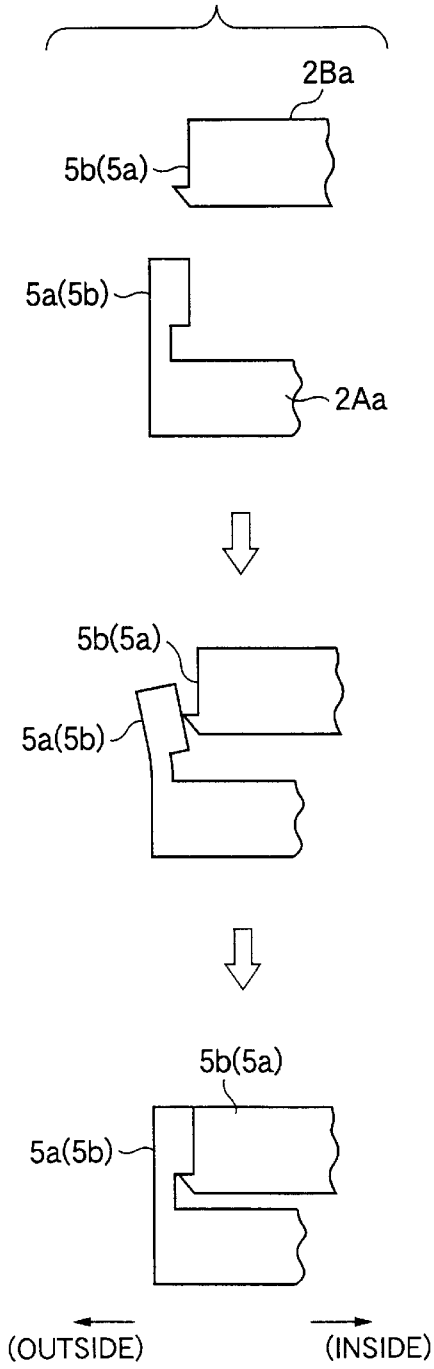
Figure 3:
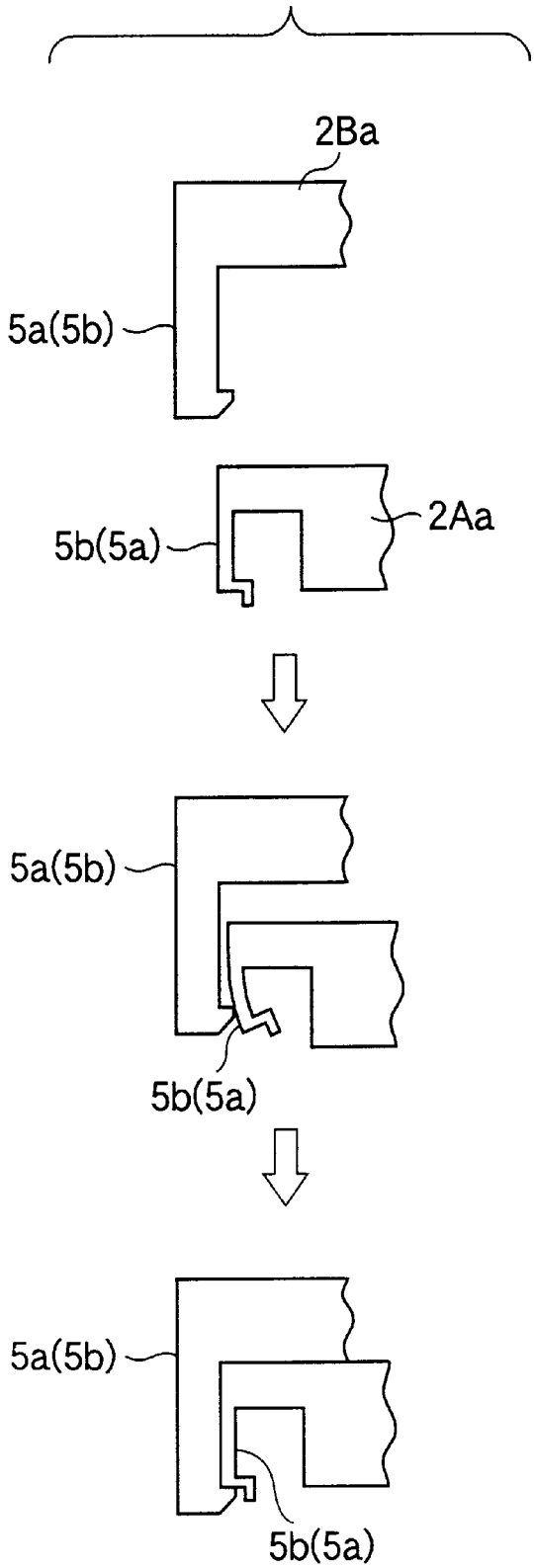
FIG. 3 is a descriptive view showing an example construction from among typical examples of first fixing means, in which a resiliently deformable engaging or engaged section is situated in an outer position.

No particular limitations are imposed on the first fixing section so long as the first fixing section is fixed by a resilient engaging unit 5, which is subject to the above described engagement. For example, as illustrated in FIGS. 2 and 3, there can be employed, as the resilient engaging member 5, an engaging member constituted of an engaging section 5*a* and an engaged section 5*b*, which are formed integrally with at least a part of split housing pieces requiring separation for disassembly. No particular limitations on structure and structure are imposed on the engaging section 5*a* and the engaged section 5*b*; any engaging sections can be employed, so long as they can effect such an engaging action as mentioned previously.

One of the engaging section 5*a* and the engaged section 5*b*, both being shown in FIG. 2, is formed in an resiliently-deformable manner. The resiliently-deformable one of engaging section 5*a* and engaged section 5*b* is situated in an outer position when the engaging section 5*a* and the engaged sections 5*b* are engaged with each other. Here, the outer position means a relative position in which a member is exposed to the outside. When the developer handling apparatus is constructed in this manner, the resiliently-deformable one of engaging section 5*a* and engaged section 5*b*, which is located in an outer position, can be easily and resiliently deformed at a time of disassembly of the split housing pieces (2A, 2B) Hence, it can be facilitated to disengage the engaging section 5*a* from the engaged section 5*b*.

One of the engaging section 5*a* and the engaged section 5*b*, both being shown in FIG. 3, is formed in an resiliently-deformable manner. The resiliently-deformable one of engaging section 5*a* and engaged section 5*b* is situated in an inner position when the engaging section and the engaged sections 5*a*, 5*b* are engaged with each other. Here, the inner position means a relative position in which a member is not exposed to the outside and remains hidden. When the developer handling apparatus is constructed in this manner, the resiliently-deformable one of engaging section 5*a* and engaged section 5*b* is located in an inner position, thereby obviating a chance of the one of engaging section 5*a* and engaged section 5*b* being resiliently deformed upon contact with an object to inadvertently be released from the engaged state.

Figure 4:
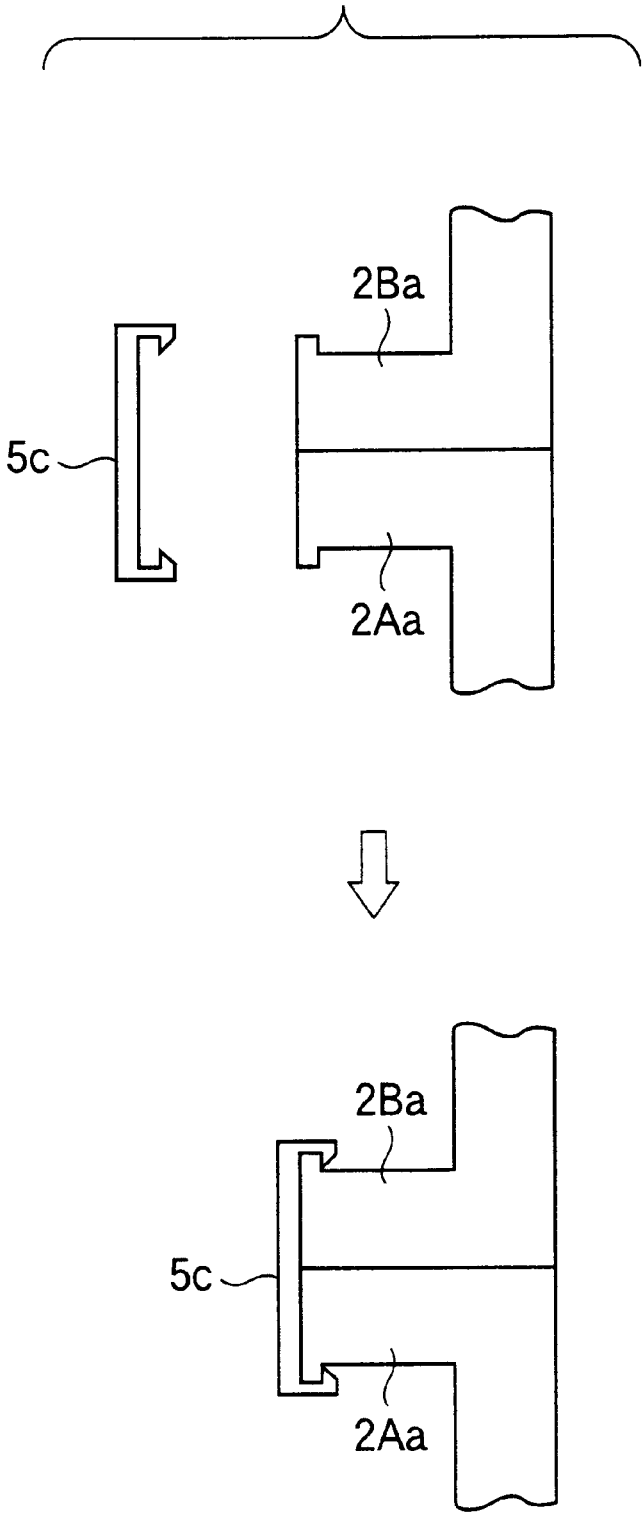
FIG. 4 is a descriptive view showing a typical example of second fixing means.

As illustrated in FIG. 4, a separate constituent component 5*c* may be employed as the resilient engaging member 5. The constituent component 5*c* is different from the split housing pieces (2A, 2B), which are pushed against resilient deformation force into the joining sections (2A*a*, 2B*a*) of at least the a part of split housing pieces (2A, 2B) requiring disassembly and is engaged under restoration force thereof. No particular limitations on structure or structure are imposed on the resilient engaging member 5*c* constituted of another constituent component, so long as the resilient engaging member 5*c* can perform the above described engagement.

When the developer handling apparatus is constituted in this manner, it can be avoided that at least one of the engaging section 5*a* and the engaged section 5*b* is damaged to cause the impossibility of reuse of the split housing pieces (2A, 2B) as the resilient engaging member 5 constituted of the engaging section 5*a* and the engaged section 5*b*. That is, although there still exists a chance of damage being inflicted on the resilient engaging member 5*c* constituted of a separate constituent element, the split housing pieces (2A, 2B) can be reused so long as the joining sections (2A*a*, 2B*a*) are not damaged. In this case, the only requirement is to replace a damaged resilient engaging member 5*c* with a new one.

Figure 5A:
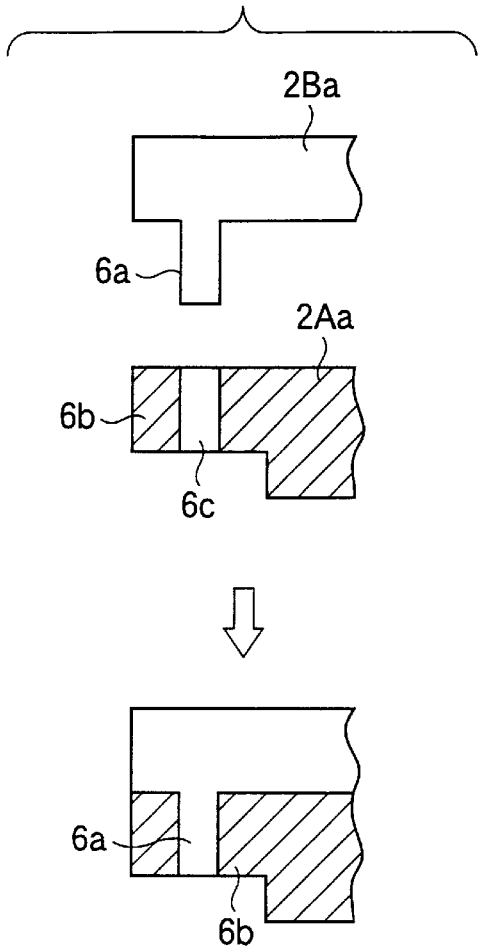
FIGS. 5A and 5B are descriptive views showing a typical example of third fixing means.
Figure 5B:
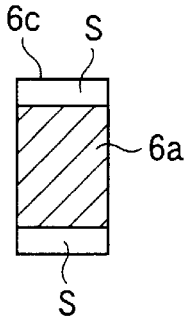

As shown in FIG. 5, the second fixing sections can fix the joining sections (2A*a*, 2B*a*) of the split housing pieces (2A, 2B) together by means of fitting a projection 6*a* into a receiving hole 6*c* of a receiving section 6*b*. No particular limitations on structure and quantity are imposed on the second fixing sections, so long as the fixing sections can be relatively easily released from a fittingly-fixed state without involvement of damage inflicted on the joining sections. The receiving section 6*b* is not limited to a through hole but may be a recess. In view of facilitation of an operation required for releasing the fixing section from a fittingly-fixed state and of realization of release of the fixing section without involvement of damage, it is preferable that the projection 6*a* and the receiving section 6*b* are formed so as to define a predetermined clearance S within a range in which a fitted state between the projection 6*a* and the receiving section 6*b* is not impaired during fitting and fixing.

Figure 6:
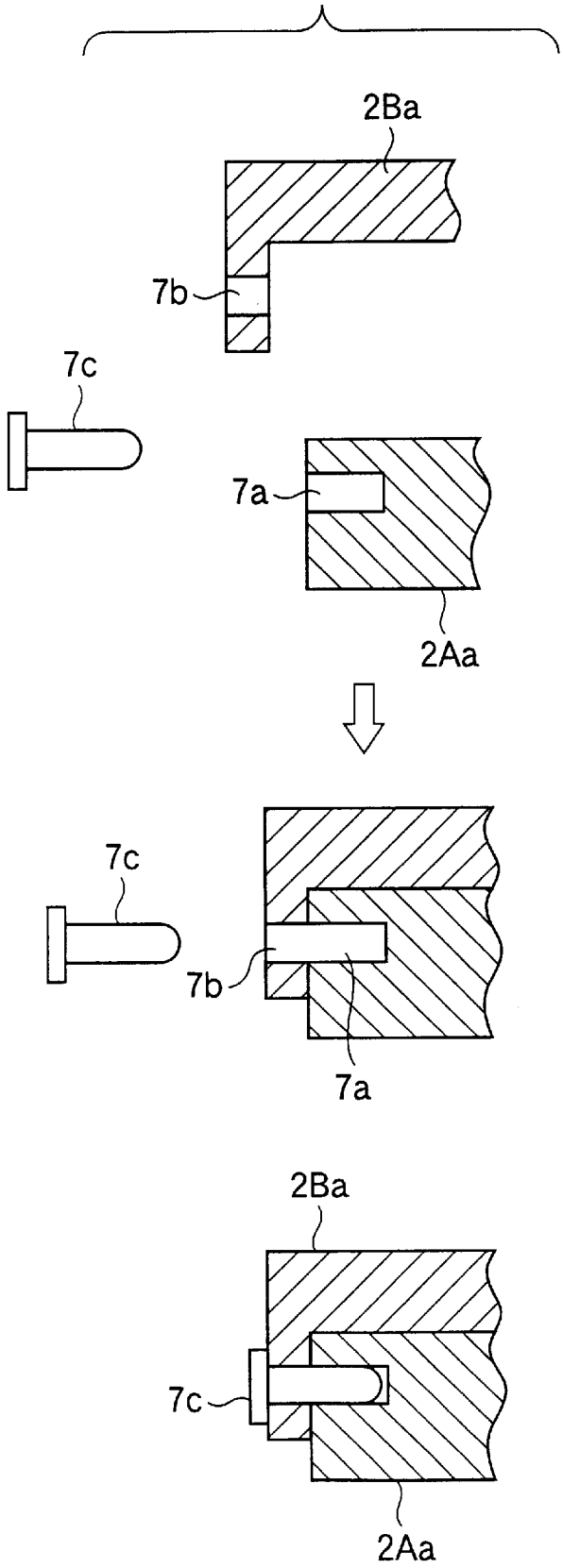
FIG. 6 is a descriptive view showing a typical example of fourth fixing means.

As illustrated in FIG. 6, the third fixing section can fix the joining sections of the split housing pieces (2A, 2B) by means of forming holes 7*a*, 7*b*, which oppose to each other when the corresponding split housing pieces (2A, 2B) are joined together, and inserting an insertion member 7*c* into the holes 7*a*, 7*b*. No particular limitations on structure and quantity are imposed on the holes and the insertion member, so long as the insertion member 7*c* can be relatively easily removed without involvement of damage inflicted on the joining sections.

Figure 7:
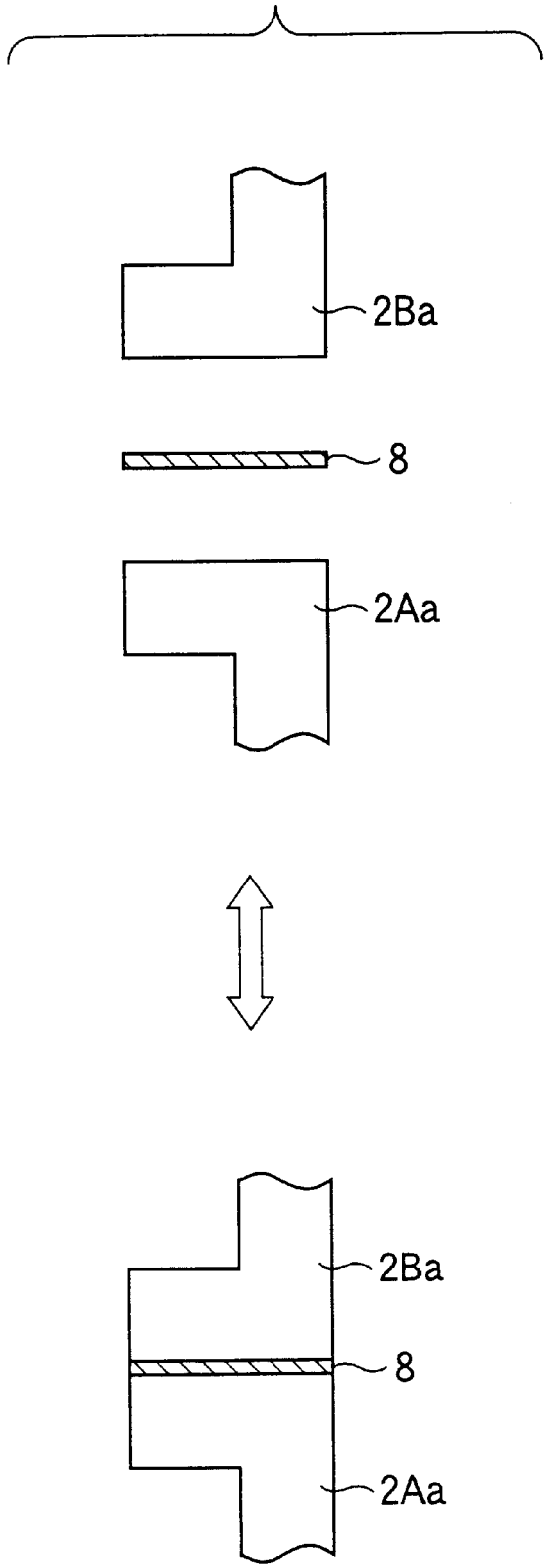
FIG. 7 is a perspective view showing a development apparatus according to a first embodiment of the present invention.

As shown in FIG. 7, the fourth fixing section can fix together the joining sections of the split housing pieces (2A, 2B) by means of causing the joining sections to adhere to each other by a removable material 8 possessing adhesion properties. No particular limitations on material and structure are imposed on the fourth fixing section so long as the fixing section can be comparatively easily released from an adhesively fixed state without involvement of damage inflicted on the joining sections. For instance, a double-sided adhesive tape, a removable adhesive or the like can be used as the material 8.

In the developer handling apparatus according to the second invention, requirements for arrangement of the first through fourth fixing section are basically arbitrary. For instance, in case where the developer handling apparatus has a shaft support section for supporting a shaft of the rotary member 4, preferably at least one of the first through fourth fixing sections is applied to the joining sections of the split housing pieces (2A, 2B) located in the vicinity of the shaft support section. As a result, there can be ensured junction strength of the joining sections of the split housing pieces which are to be a neighborhood of a shaft support section tending to be received a load when the rotating rotary member 4 is supported.

In the developer handling apparatus according to the second invention, the housing 2, which is assembled by joining and fixing a plurality of split housing pieces, is preferably provided with an auxiliary fixing member for preventing occurrence of movement of at least a part of split housing pieces (2A, 2B) in a direction in which the part of split housing pieces depart from each other. More preferably, the auxiliary fixing member is one which does not inflict damage (breakage) on the split housing pieces (joint section thereof). Whereby, the joined and fixed state of the split housing pieces (2A, 2B) only by means of at least one of the first through fourth fixing sections can be reinforced.

When the auxiliary fixing member is attached to the housing 2, a plurality of at least one of the first through fourth fixing sections are provided at the joining sections of at least apart of split housing pieces (2A, 2B) at intervals. The auxiliary fixing members are preferably attached at (some or all of) locations of the joining sections different from those at which the fixing means have already been provided. In this case, the joining sections of the split housing pieces which have not yet been fixed by the first through fourth fixing sections are fixed by means of the auxiliary fixing members. Hence, the split housing pieces are efficiently joined over the entire joining sections.

When the auxiliary fixing member is attached to the housing 2, a plurality of at least one of the first through fourth fixing sections are provided at the joining sections of at least apart of split housing pieces (2A, 2B) at intervals. The auxiliary fixing members are preferably attached at (some or all of) locations of the joining sections corresponding to locations at which the fixing sections have already been provided. In this case, the joining sections of the split housing pieces which have already been fixed together by the first through fourth fixing sections are doubly fixed together by the auxiliary fixing members, and hence the joining sections of the spilt housing pieces are more firmly fixed in predetermined locations.

When the auxiliary fixing member is attached to the housing 2, a plurality of at least one of the first through fourth fixing sections are provided in the joining sections of at least a part of split housing pieces (2A, 2B) at intervals. The auxiliary fixing members are preferably attached at (some or all of) locations of the joining sections differing from those where the fixing sections have already been provided as well as at (some or all of) locations of the joining sections corresponding to locations where the fixing sections have already been provided. In this case, the split housing pieces are efficiently joined over the entire joining sections and the portions of the split housing pieces which have already been fixed together by the first through fourth fixing sections are fixed more firmly.

In the developer handling apparatus according to the first or second invention, a resilient member is preferably interposed to a part of or all of region of the joining sections between at least the part of split housing pieces (2A, 2B) The resilient member is cellular plastic (a porous soft member), rubber material, or the like.

In a situation in which the resilient member is interposed to a part of region of the joining sections, when the split housing pieces are fixed together by means of the first fixing section in the developer handling apparatus according to the second invention, the resilient member produces restoration force as reaction force in a direction in which (the joining sections of) the split housing pieces are separated from each other at the time of fixed joining of the split housing pieces. It is difficult to disengage the resilient engaging member 5 of the first fixing section due to the reaction force, thereby fixedly joining the split housing pieces more reliably. In a situation in which the resilient member is interposed to the entire region of the joining sections, if, in the developer handling apparatus according to the second invention, the split housing pieces are fixed together by means of the first fixing section, the previous working-effect can be yielded in the same manner. In either of the developer handling apparatus according to the first invention and the developer handling apparatus according to the second invention (regardless of type of fixing section), airtightness of the joining sections is ensured, and hence leakage of developer from the joining section can be effectively prevented.

The developer handling apparatus according to the first or second invention may has another attachment member, which is other than the rotary member 4 and must be removed at the time of disassembly. Preferably, at least the part of split housing pieces (2A, 2B) are provided with the rotary member 4 and the other attachment member.

In this case, the rotary member 4 and the other attachment member are attached concentrically to a part of the split housing pieces, thereby enabling efficient attachment or removal of the rotary member 4 and the other attachment member. By extension, assembly and disassembly of the spilt housing pieces (2A, 2B) can be effected efficiently, thereby facilitating reuse of the developer handling apparatus.

Each of the pieces of the developer handling apparatus according to the first or second invention may be a desirable one so long as the one comprises a housing 2, including a housing section 2*e* for storing the powder-shaped developer 3, the opening section 2*f* for enabling passage of the developer 3, and the rotary member 4 attached so as to rotate within the housing 2 wherein a structural body of the one is assembled by means of firmly joining together a plurality of split housing pieces in which the housing 2 is divided into two or more segments.

More specifically, the housing 2 corresponds to a developer container (such as a toner bottle), a waste developer reclaim container, a deteriorated developer reclaim container, or a developer transport device using a developer transport passage, as well as a development apparatus such as that described in connection with the related art and the problems thereof.

If, in the developer handling apparatus according to the first invention and the developer handling apparatus according to the second invention, the housing 2 is a housing and the rotary member 4 corresponds to at least a development roller, the developer handling apparatus becomes a development apparatus. By means of adopting the constituent configurations such as those set forth, a developer according to a third invention yields the previously-described working-effect in the same manner.

In the development apparatus according to the third invention, the housing (2) is vertically split into two pieces, thereby constituting an upper housing (2D) and a lower housing (2E). At least one of the first through fourth fixing sections is provided at a position in the vicinity of a shaft support section for supporting the shaft of the development roller (4), from among positions of a joining section between the upper housing (2D) and the lower housing (2E) and also is provided at the remaining positions.

In the development apparatus according to the third invention, the housing (2) is assembled by means of fixedly joining together the upper housing (2D) and the lower housing (2E). Preferably, a side bracket is attached to either side end section of the development roller (4) of the housing (2) so as to clamp the side end section from the outside, thereby preventing occurrence of movement in a direction in which the split housing pieces (2D, 2E) depart from each other. In this case, there can be ensured junction strength of the joining sections of the split housing pieces (2D, 2E) which are to be located in the neighborhood of the shaft support section, the support section tending to be received load when the rotating rotary member 4 is supported.

In a case of When attachment of the side brackets, the side brackets are preferably formed in a shape so as to simultaneously clamp the fixing section located at the shaft support section of the development roller (4) from outside thereof. In this case, fixing action of the fixing section is reinforced by the clamping action of the side bracket. As a result, both ends of the split housing pieces (2D, 2E) are joined together more firmly.

In a case of attachment of the side bracket, the development apparatus preferably has, as the rotary member 4 to be attached to the housing (2), at least one of a developer agitating-and-transporting member and a developer supply member in addition to the development roller. A torque transmission mechanism for transmitting torque of each of the rotary members 4 is disposed outside of one side end section of the housing (2). The side bracket preferably ma have a cover shape covering (the principal section or entirety of) the torque transmission mechanism. The torque transmission mechanism is usually a gear train. However, the torque transmission mechanism is not limited to the gear train.

In this case, the torque transmission mechanism is disposed densely outside of one side end section of the housing (2), thereby facilitating attachment and removal of the torque transmission mechanism. Since the torque transmission mechanism is covered with the side bracket, entry of foreign matter (e.g., a developer or dust) into the torque transmission mechanism is prevented.

In case of attachment of the side bracket, the development apparatus preferably has, as the rotary member 4 to be attached to the housing (2), at least one of a developer agitating-and-transporting member and a developer supply member, as well as with the development roller. A torque transmission mechanism for transmitting torque of each of the rotary members 4 is disposed outside of one side end section of the housing (2). The side bracket is preferably provided with a bearing section for receiving the shaft of each of the rotary section(s) and a support section for supporting (at least a part of) a torque transmission mechanism.

In this case, the torque transmission mechanism is disposed densely outside of one side end section of the housing (2), thereby facilitating attachment and removal of the torque transmission mechanism. The side bracket supports at least portions of the shafts of respective rotary members 4 and a part of the torque transmission mechanism. Thus, the part of the rotary members 4 and the part of the torque transmission mechanism are supported certainly. Even if the shafts of the rotary members 4 and the torque transmission mechanism are arranged densely as a result of miniaturization of the development apparatus so that not all of the rotary members 4 and the torque transmission mechanism can be provided at one side end section of the housing (2), the shafts of the rotary members 4 and the torque transmission mechanism can be disposed by means of providing the side bracket with the bearing section and the support section. Thus, the present invention can be sufficiently compatible with miniaturization of the development apparatus.

The development apparatus according to the third invention has a parallel layout component which is to be disposed in parallel with and spaced a given distance away from the development roller (4). A receiving recess is preferably formed in the interior of the side end section of the lower housing (2E) for receiving the end section of the parallel layout component. A squeezing projection for squeezing and fixing the parallel layout component fitted into the receiving recess from above is preferably formed in the upper housing (2D), thereby fastening the parallel layout component.

In this case, the parallel layout component can be easily attached to the development roller without use of a special fixing section. Further, at a time of disassembly of the split housing pieces (2D, 2E), the parallel layout component can be easily removed. The receiving recess and the squeeze projection formed in and on the split housing pieces are protected from damage, as is the parallel layout component. Hence, the development apparatus can be easily reused.

The development apparatus according to the third invention is preferably configured in the following manner. Namely, the development roller (4) is attached such that a shaft end section thereof projects outside of the housing (2). An engaging projection projecting in the same direction as that in which the shaft end section of the development roller (4) projects is formed in a part of the housing (2). The shaft end section of the development roller (4) is supported by way of the bearing support on a support frame for rotatably supporting a shaft end of an image carrier on which an electrostatic latent image to be developed is formed. The engaging projection is engaged to an engaging section formed in the support frame. Whereby, the development apparatus is attached to the support frame.

In this case, the development apparatus is attached to the support frame without use of attachment unit such as screws. Hence, there is no risk of damage being inflicted on the housing (2) at a time of attachment or removal of the development apparatus. The housing or the like can be reused. The bearing support supports the bearing by way of the shaft end section of the development roller and is usually removably attached to the support frame. When a space retention ring is attached to the shaft section of the development roller for maintaining a given clearance between the development roller and the image carrier, there is preferably employed a structure for continuously urging the shaft end section of the development roller against the image carrier by means of an urging member such as a spring.

DETAILED DESCRIPTION OF THE PREFERRED EMBODIMENTS

[First Embodiment]

Figure 8:
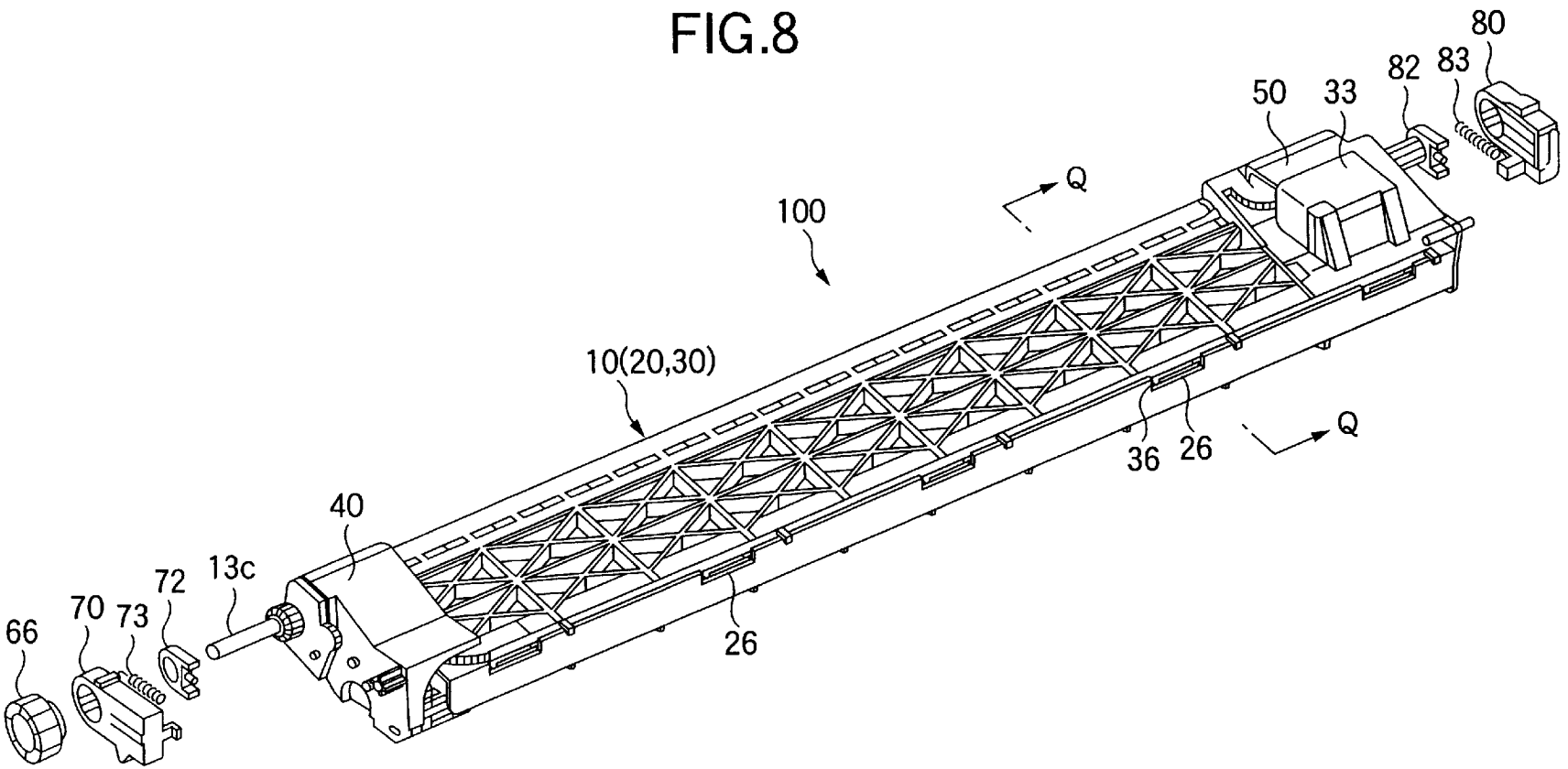
FIG. 8 is a cross-sectional view taken along line Q—Q.
Figure 9:
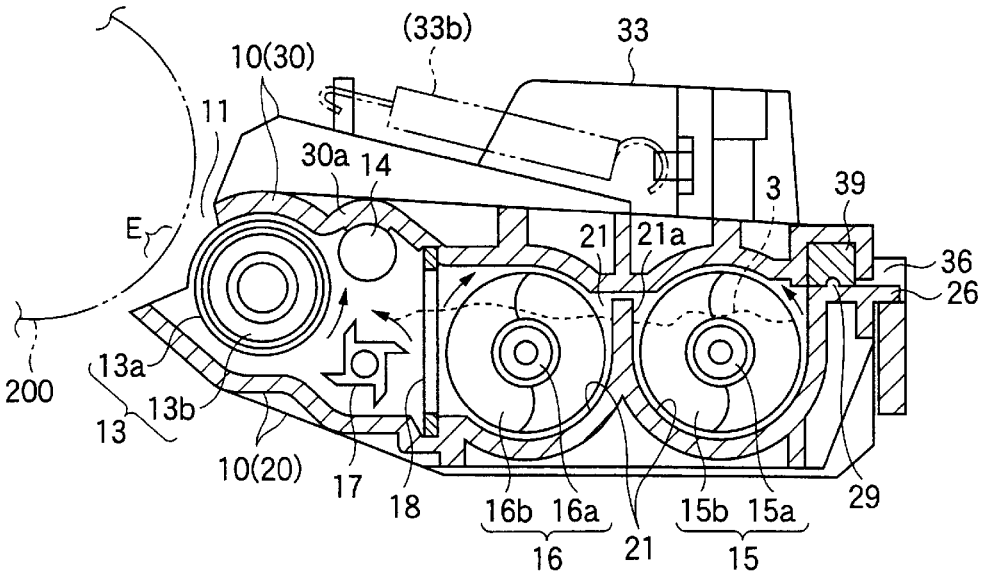
FIG. 9 is an exploded perspective view showing the development apparatus shown in FIG. 8.
Figure 10:
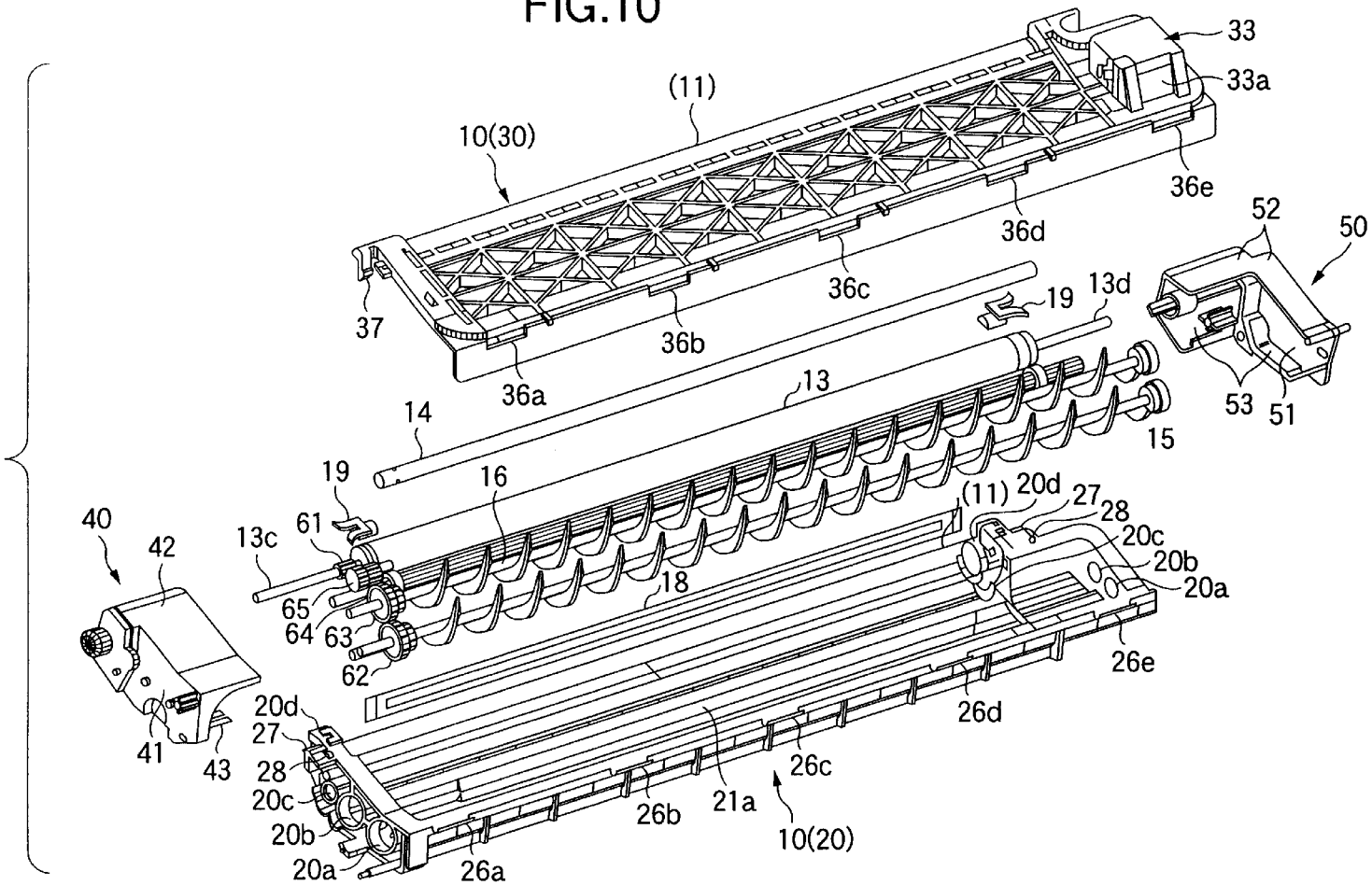
FIG. 10 is a top view showing the development apparatus when an upper housing is removed therefrom.
Figure 11:
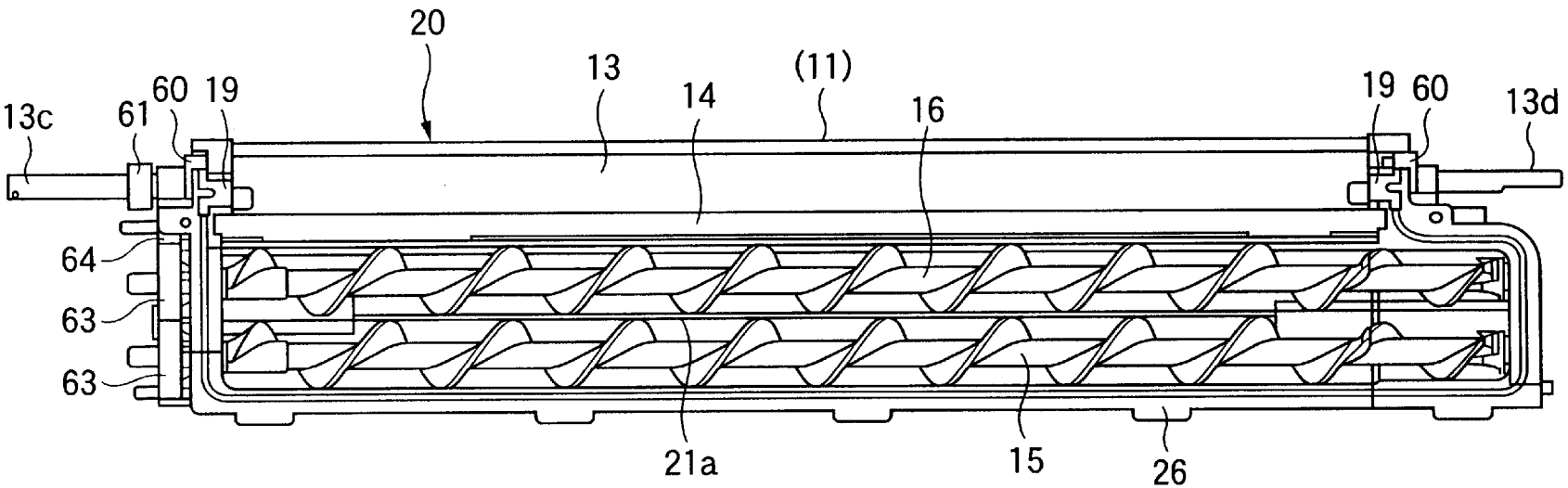
FIG. 11 shows a lower housing.

FIGS. 8 through 11 show a development apparatus serving as a developer handling apparatus according to the present invention. FIG. 8 is a perspective view of the development apparatus; FIG. 9 is a schematic cross-sectional view taken along line Q—Q shown in FIG. 8; FIG. 10 is an exploded perspective view of the development apparatus; and FIG. 11 is a top view of the development apparatus while an upper housing is removed.

<Configuration of the Development Apparatus>

In accordance with demand for miniaturization, a development apparatus 100 is a thin-type two-component development apparatus, the whole shape of which is a flat shape. A principal section of the development apparatus 100 is basically comprises a housing 10; a development roller 13; a roll-shaped layer regulation member 14; two augers 15, 16; and an impeller paddle wheel 17. Reference numeral 200 shown in FIG. 9 designates a photosensitive drum serving as an image carrier on which an electrostatic latent image is to be formed in accordance with image information; reference numeral 2 designates a two-component developer including non-magnetic toner (having a mean particle size of 6 to 10 $\mu$m) and magnetic carriers; and symbol E designates a development area on the photosensitive drum 200. Each of arrows depicts a rotating direction of each of rotary components.

The entirety of the housing 10 is of a flat and elongated box shape. The housing 10 is assembled by means of joining a lower housing 20 and an upper housing 30, which are vertically divided. In a state in which the lower housing 20 and the upper housing 30 are assembled, a housing opening 11 is formed in an end portion of the housing 10 opposing the photosensitive drum 200 and a housing section 12 storing developer 3 is formed in the housing 10. The lower housing 20 and the upper housing 30 are made of molded plastic (e.g., ABS resin or high impact polystyrene (HIPS)).

As shown in FIGS. 9 through 12, a developer storage recess 21 for storing a two-component developer 3 is formed along an end and surroundings of the lower housing 20 of the housing 10 opposite an end which is to become the housing opening section 11. In an area extending from the developer storage recess 21 to the housing opening section 11, there are formed a developer supply lower section 22 having a paddle wheel 17 provided therein and an upper developer supply section 23 having a development roller 13 provided therein. A joining surface section 25 to be used for joining with an upper housing 30 is formed over the entire circumferential edge of the lower housing 20 except for an area which is to be the housing opening section 11. On both side surfaces of the lower housing 20 are formed a bearing support hole 20*a* for supporting a shaft of the auger 15, a bearing support hole 20*b* for supporting a shaft of the auger 16, a bearing support hole 20*c* for supporting a shaft of the paddle wheel 17, and a bearing support section 20*d* for supporting a shaft of the development roller 13.

The developer storage recess 21 is partitioned by means of a partition wall 21*a* provided in a center section side thereof except for both ends thereof to define two parallel rows of developer circulation transport paths 21*b* and 21*c*. The developer circulation paths 21*b* and 21*c* are interconnected by way of a return-circulation/developer receiving section 21*d* and a return circulation section 21*e*, which are located on both ends of the partition wall 21*a*.

A plurality of engaging projection pieces 26*a*, 26*b*, 26*c*, 26*d*, and 26*e* is formed on the lower housing 21, which are fitted into a engage hole (36) (described later) formed in the upper housing 30 at a time of assembly. The engage hole (36) are formed to be opposite to and parallel to the housing opening section 11 of the joining surface section 25. The engaging projection pieces 26 are formed on the joining surface section 25 at predetermined intervals so as to each project to the rearward of the housing 20 in a substantially horizontal direction.

Figure 14A:
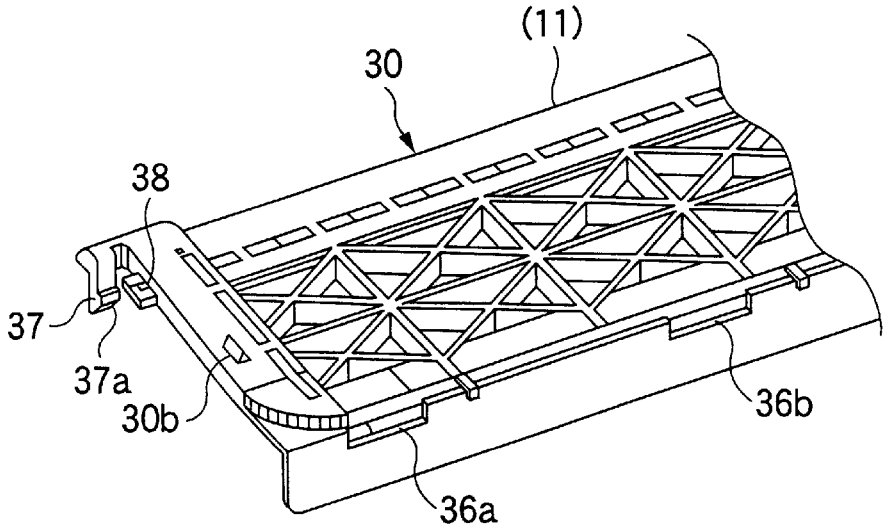
FIG. 14 is a perspective view showing the principal section of a structure for fixedly joining the upper and lower housings together.
Figure 14B:
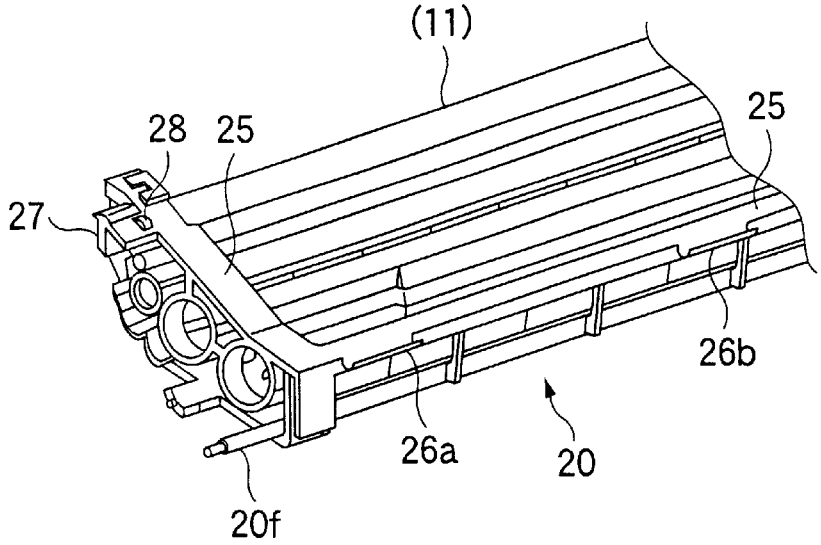
Figure 15:
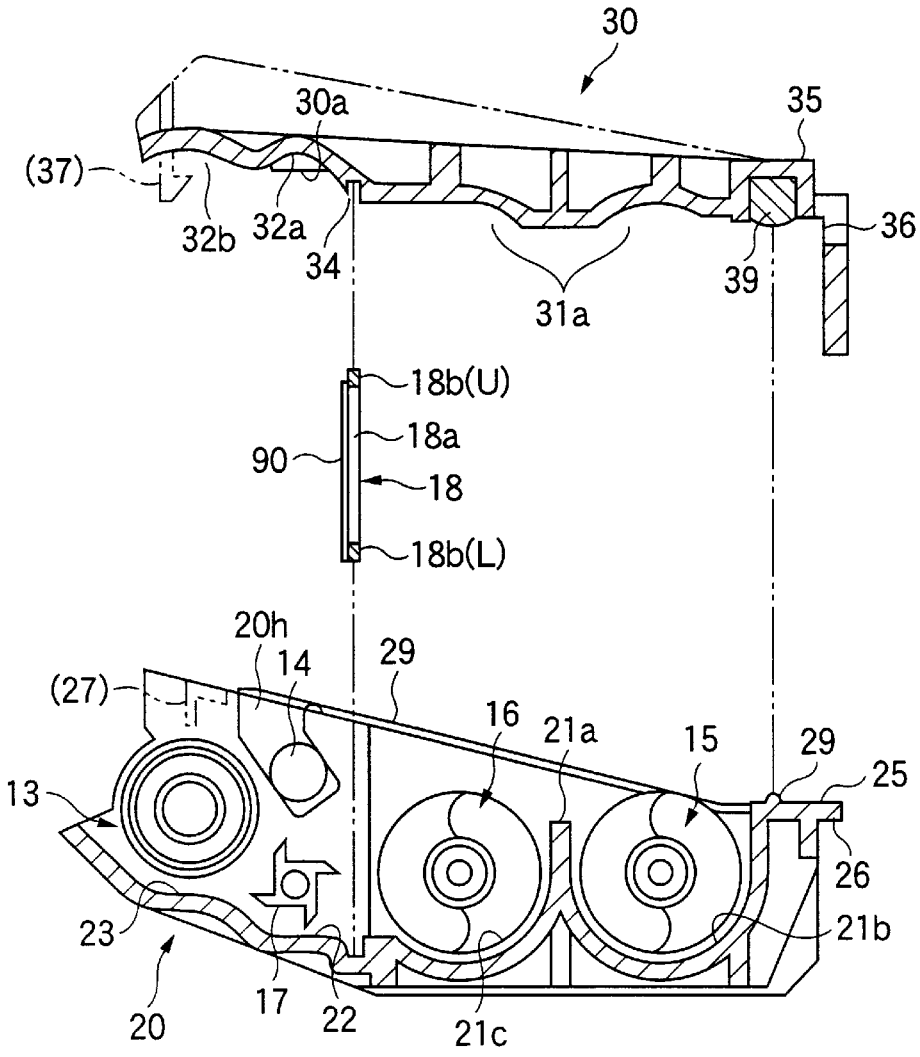
FIG. 15 is a part of exploded cross-sectional view of the development apparatus shown in FIG. 9.
Figure 16A:
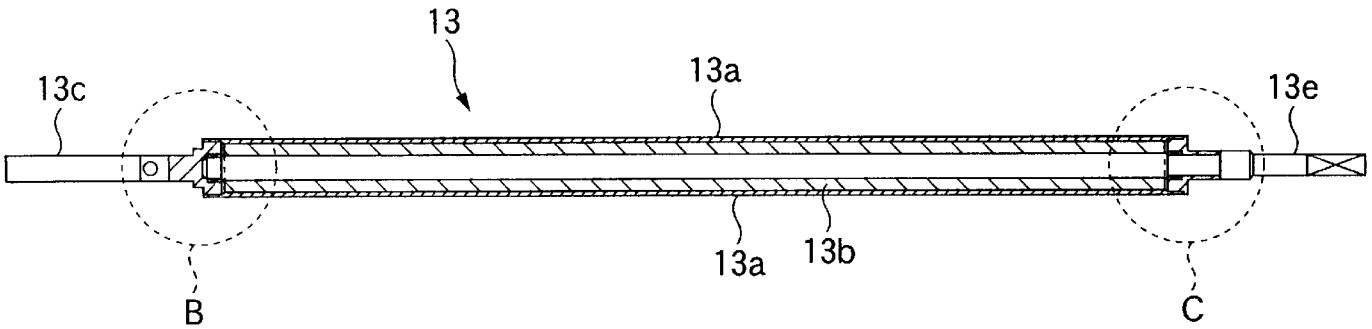
FIG. 16A is a cross-sectional view of the development roller.
Figure 16C:
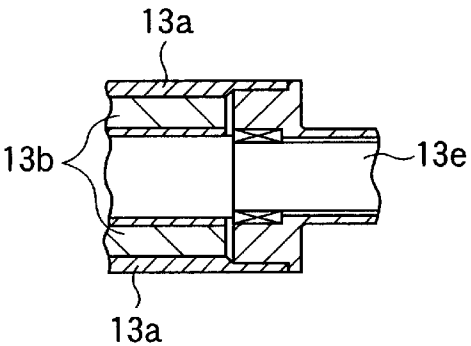
FIG. 16C is an enlarged cross-sectional view of the area enclosed by broken-line circle C shown in FIG. 16A.
Figure 16B:
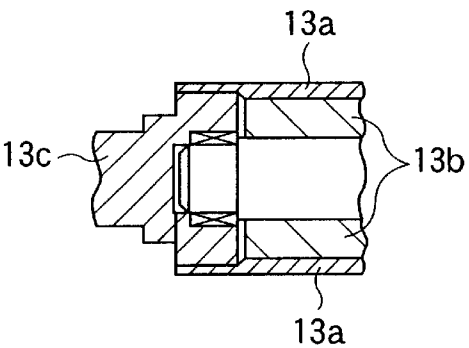
FIG. 16B is an enlarged cross-sectional view of the area enclosed by broken-line circle B shown in FIG. 16A.

As shown in FIGS. 14A through 15, engaged sections 27 for snap fitting purposes and positioning pins 28 are formed in an area on the joining surface section 25 which is close to the region to be the housing opening section 11 and in the vicinity of the area in which the shaft end sections of the development roller 13 situates. Engaging pieces (37) for snap fitting purposes, which will be described later and are formed on the upper housing 30, are to be engaged into the engaged sections 27. The positioning pins 28 are to be inserted into positioning holes (38), which will be described later and are formed on the upper housing 30. Each of the engaged sections 27 is formed such that an angular portion on which a hook portion of each of engaged pieces (37) is eventually to be hooked is formed in a lower end section thereof.

Figure 12A:
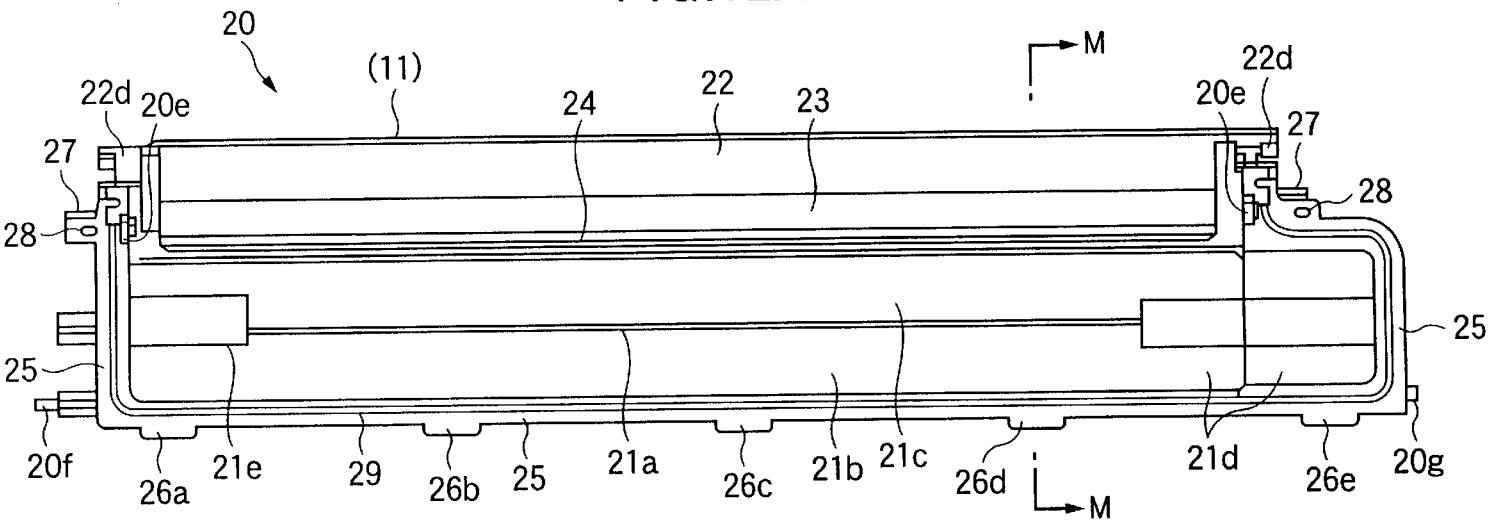
FIG. 12A is a bottom view of the upper housing.
Figure 12B:
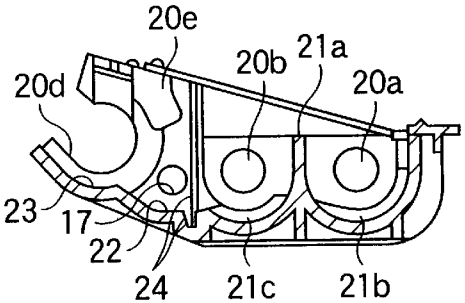
FIG. 12B is a cross-sectional view taken along line N—N shown in FIG. 12A.

As shown in FIGS. 9 and 12, a rib 29 is formed continuously so as to protrude from the joining surface 25 and extend over the entire surface thereof. The rib 29 is a projection having a substantially triangular shape in cross section. The rib 29 is formed at a position where the rib 29 bites into a substantially center of a resilient member 39 described later, when the lower housing 20 and the upper housing 30 are assembled. An engaging projection 20*f* to be inserted into an engage hole (47) of a side bracket (40) described later is formed on a side surface of an end portion of the lower housing 20 and an engaging projection 20*g* to be inserted into an engage hole (57) of a side bracket (50) described later is formed on the side surface of an end portion of the lower housing 20.

Figure 13A:
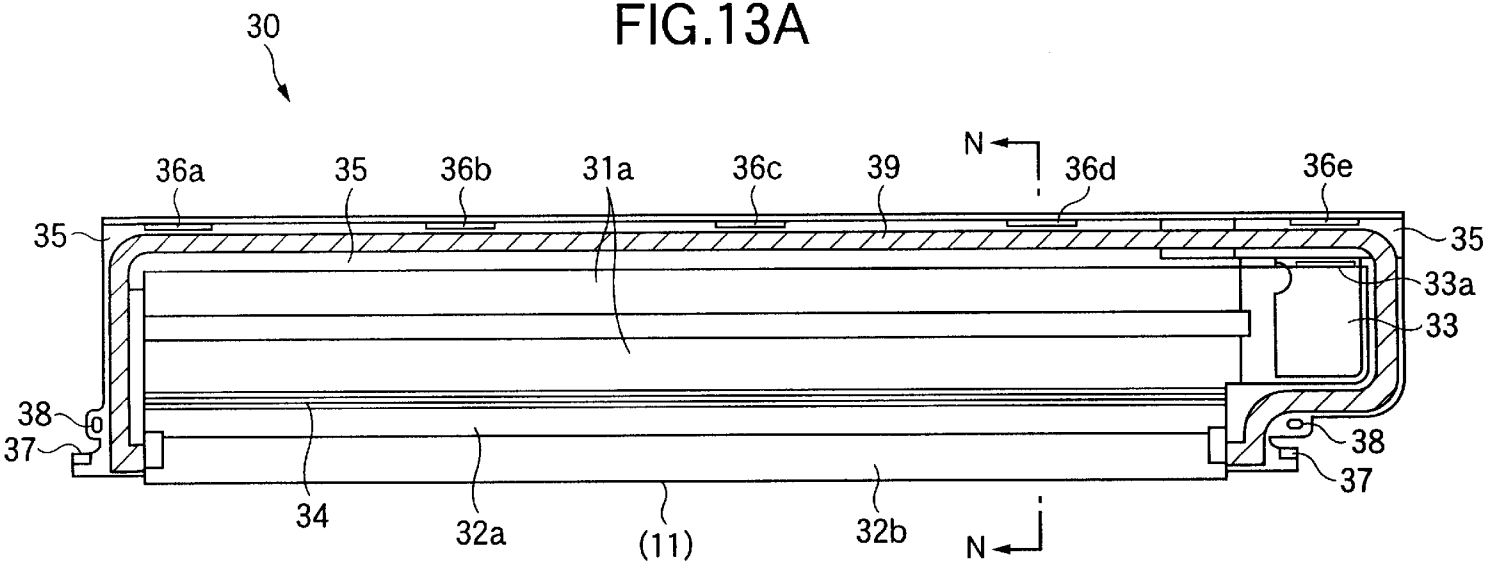
FIG. 13 is a perspective view showing the principal section of a structure for fixedly joining the upper housing and the lower housing together.
Figure 13B:
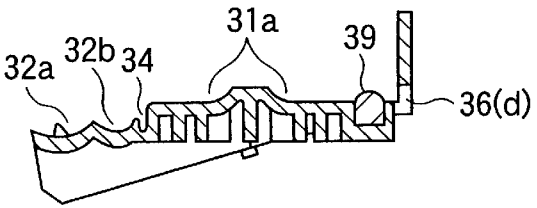

As shown in FIGS. 9, 10, and 13, the upper housing 30 is constituted primarily of a storage recess cover section 31; a lower cover section 32*a*; an upper cover section 32*b*; and a replenishment developer receiving section 33. When the upper housing 30 and the lower housing 20 are assembled and mated, the storage recess cover section 31 opposes the developer storage recess 21 of the lower housing 20 and covers and regulates the space of the storage recess 21 from above. When the upper housing 30 and the lower housing 20 are assembled and mated, the lower cover section 32*a* opposes the developer supply lower section 22 of the lower housing 20 and covers and regulates the space of the lower section 22 from above. When the upper housing 30 and the lower housing 20 are assembled and mated, the upper cover section 32*b* opposes the upper developer supply section 23 of the lower housing 20 and closes and regulates the space of the upper section 23 from above. When the upper housing 30 and the lower housing 20 are assembled and mated, the replenishment developer receiving section 33 opposes the return-circulation receiving section 21*d* of the lower housing 20. Reference numeral 33*a* designates a receiving open/close door (port) which opens upon insertion of a developer transport pipe of a developer replenishing device (not shown) and reference numeral 33*b* designates a tension spring for urging the receiving door in a closing direction.

A joining surface section 35 to be joined to the lower housing 20 is formed over the entire outer brim of the upper housing 30 except for an area which is to become the housing opening 11. A plurality of engage holes 36*a*, 36*b*, 36*c*, 36*d*, and 36*e* for receiving the engaging projection pieces 26*a* through 26*e* formed on the joining surface section 25 of the lower housing 20 at a time of assembly are formed on a drooping edge opposite to and parallel to the portion of the joining surface section 35 to be the opening section 11. Each of engage holes 36 is formed to have substantially the same width as engaging the projection piece 26 in the vertical direction and to be slightly wider than the engaging projection piece 26 in the horizontal direction.

Engaging pieces 37 for snap fitting purposes and positioning holes 38 are formed in an area on the joining surface section 35 which are close to the region to become the housing opening section 11. The engaging pieces 37 are hooked to the engaged section for snap fitting purposes. The positioning holes 38 are inserted into the positioning pins 28. As shown in FIGS. 14 and 15, the engaging pieces 37 are constituted of projections extending downwardly. A hook section is formed in a lower end portion of the engaging piece 37 so as to project rearward of the housing. The engaging piece 37 is formed in such thickness that the center to lower end of the engaging piece 37 is resiliently deformable. The engaging piece 37 is pushed into the engaged section 27 of the housing from the forward direction. When engaged, the engaging piece 37 is situated in an outer position.

After a trench (see FIGS. 9 and 13) has been formed in the joining surface section 35 over the entire surface thereof, a resilient member 39 (hatched portion) is provided on the joining surface 35 such that a portion thereof is embedded in the trench while another portion of the same protrudes from the joining surface. The resilient member 39 is provided, for instance, by means of filling the trench with two-liquid type polyurethane by using a two-liquid polyurethane gasket coating system.

Reference numeral 18 shown in FIG. 10 designates a partition frame plate to which a seal film 90 is affixed, wherein the film is removed before use of the development apparatus. The partition frame plate 18 comprises a frame section 18*a* to which a part of the seal film 90 is affixed; and an opening section 18*b* which is formed so as to have a shape corresponding to a longitudinal cross-sectional profile (i.e., the shape of an elongated rectangle) of the internal space 12 of the housing 10 and is used for passing a developer. The partition frame plate 18 is fitted into a mount groove 24 formed in the lower housing 20 and a mount groove 34 formed in the upper housing 30.

Reference numeral 19 designates a seal member attached for preventing leakage of a developer from the end of the development roller 13. The seal member 19 is attached to the bearing support section 20*d* of the development roller 13. Reference numeral 20*e* designates a recess (groove) formed in the interior wall section of the lower housing 20 for receiving the end of the roll-shaped layer thickness regulation member 14. A squeeze projection section 30*a* is formed in the upper housing 30 for squeezing from above the layer thickness regulation member 14 fitted into the receiving recess 20*e*.

As shown FIGS. 9 through 11 and 16, the development roller 13 in the development apparatus 100 is constituted of a non-magnetic sleeve 13*a* and a magnetic roller 13*b* (FIG. 16A) The non-magnetic sleeve 13*a* is positioned in the upper developer supply section 23 of the lower housing 20, is disposed so as to be rotatable while being partly exposed through the housing opening section 11, and is formed into a hollow cylindrical shape. The magnetic roller 13*b* is provided in the hollow space of the sleeve 13*a* and a plurality of magnetic poles are provided on the magnetic roller 13*b* at a predetermined angle appropriately (FIG. 16A). An end portion of the sleeve 13*a* is coupled to a rotary drive shaft 13*c* (FIG. 16B). The magnetic roller 13*b* is rotatably supported on the sleeve 13*a* and an end portion of the magnetic roller 13*b* is coupled to a center shaft 13*e* (FIG. 16C).

Figure 19A:
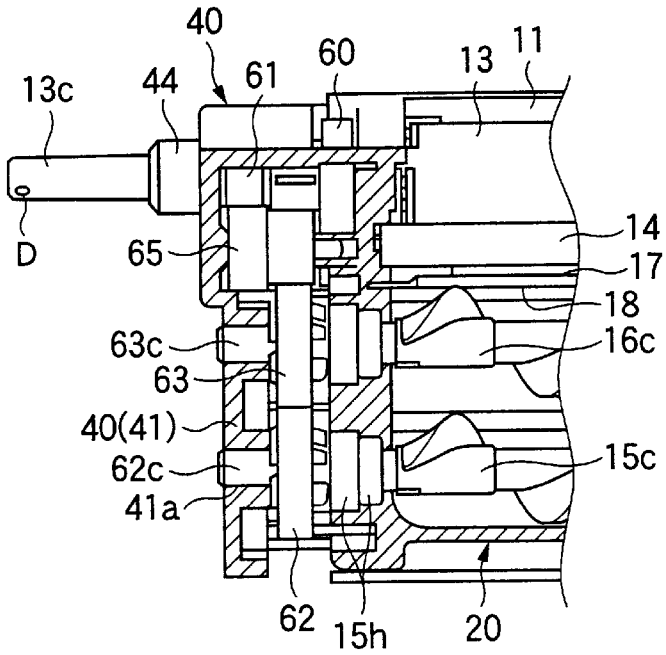
FIG. 19A is a fragmentary cross-sectional top view showing a driven-side end section of the development apparatus.
Figure 19B:
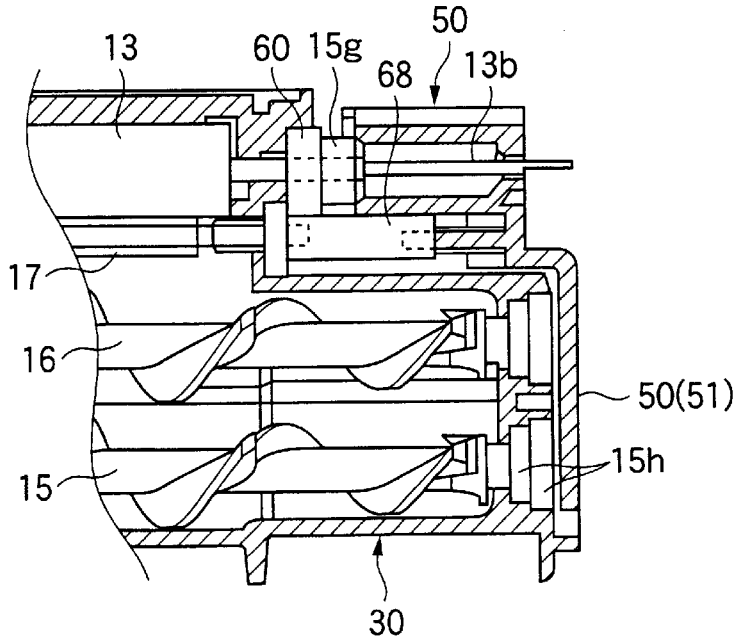
FIG. 19B is a fragmentary cross-sectional top view showing another end section of the development apparatus.
Figure 20:
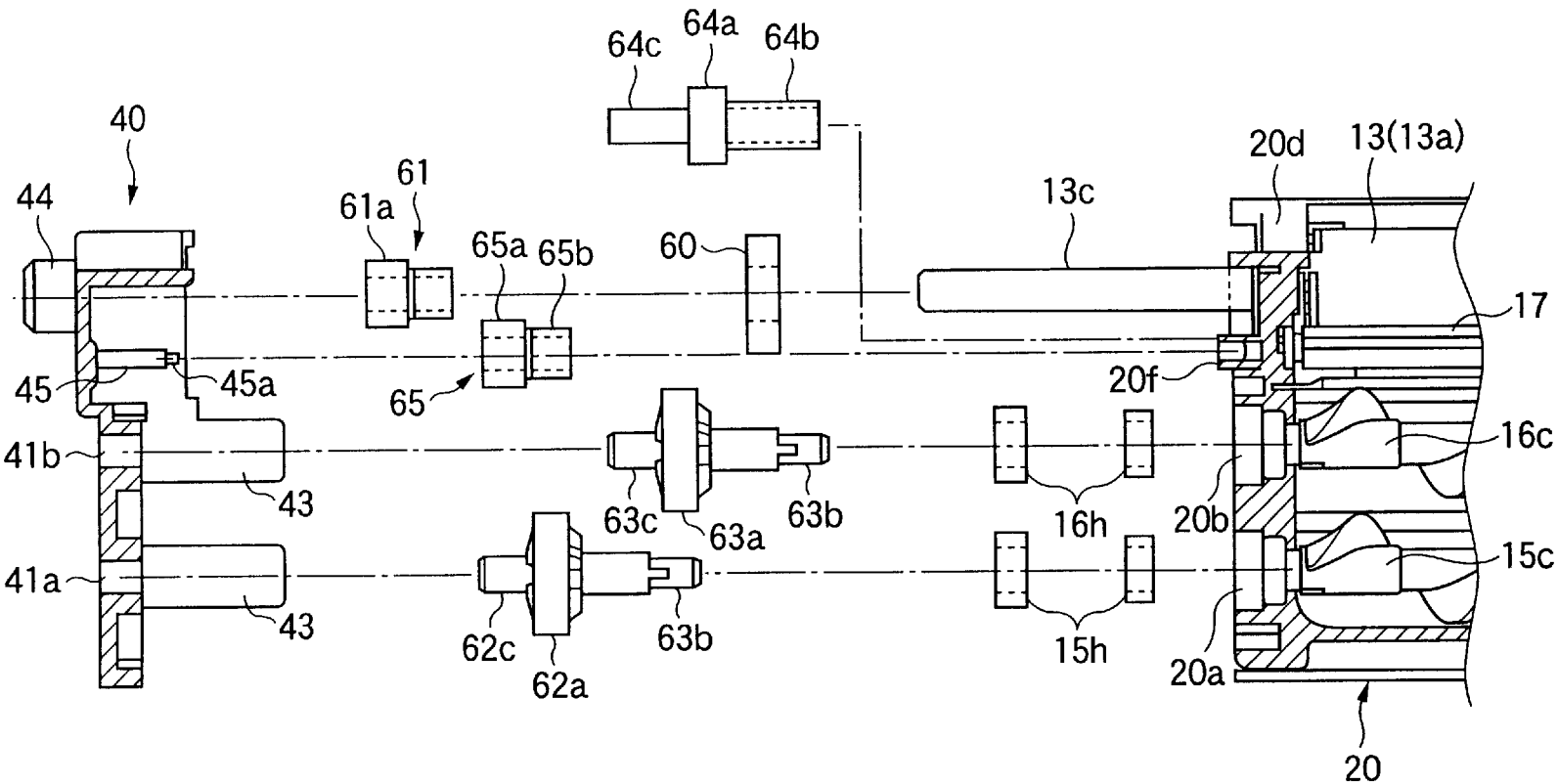
FIG. 20 is an exploded view of the end section of the development apparatus shown in FIG. 19A.
Figure 21:
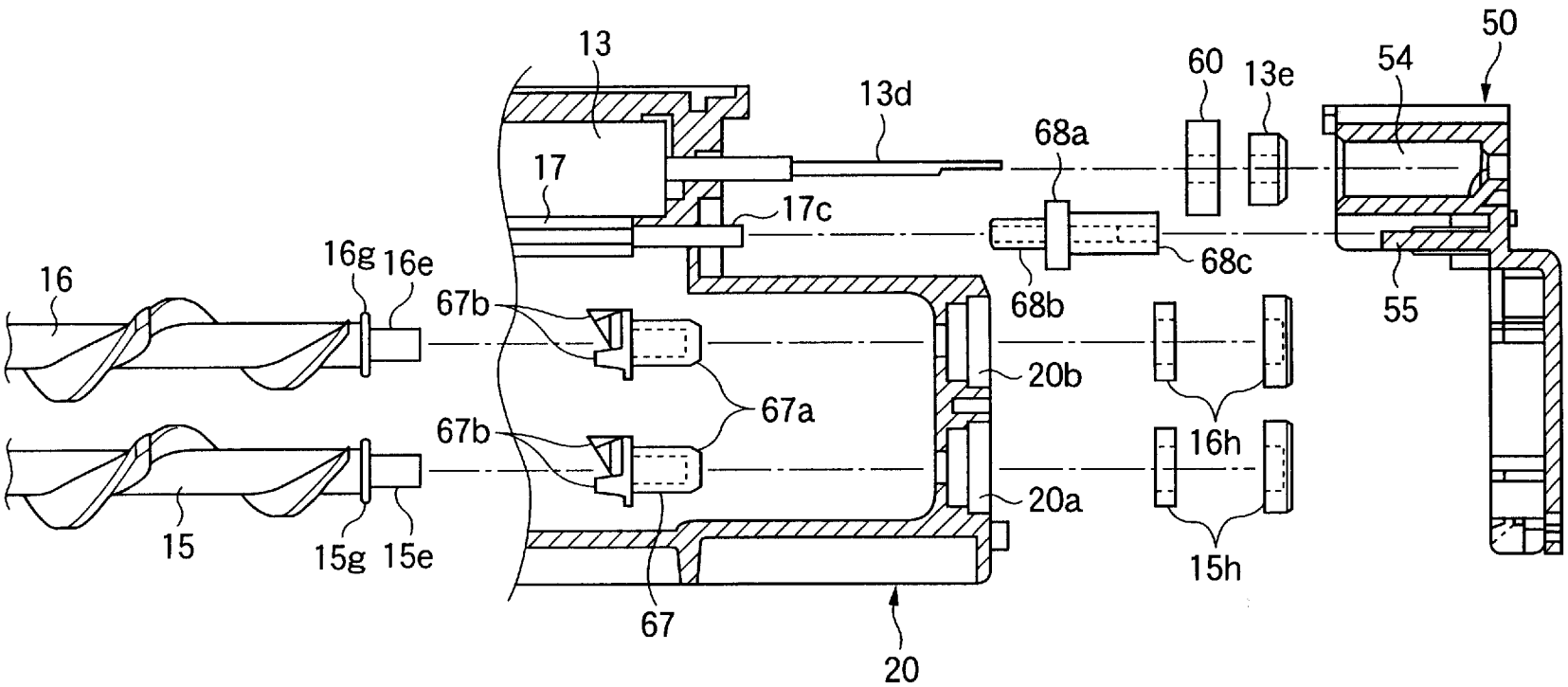
FIG. 21 is an exploded view of the end section of the development apparatus shown in FIG. 19B.

The development roller 13 is in principle attached to the bearing support section 20*d* of the lower housing 20. As shown in FIGS. 19A and 20, a retention ring 60, which comes into contact with the photosensitive drum 200 is rotatably provided outside of the bearing support section 20*d* to maintain a clearance between the rotary drive shaft 13*c* and the photosensitive drum 200. Further, a drive gear 61 having gear teeth 61*a* formed thereon is attached to the drive shaft 13*c* so as to be nonrotatable within a pinhole D of the drive shaft 13*c*. In FIG. 20, the pinhole D is not represented because of an angle of the drive shaft 13*c*. As shown in FIGS. 19B and 21, the clearance retention ring 60 is attached to a center shaft 13*d* provided on the side of the development roller 13 opposite to the rotary drive shaft 13*c* so as to be freely rotatable at a position outside the bearing support section 20*d*. A bearing ring 15*g* is attached to the outside of the clearance retention ring 60 in a rotatable manner.

The roll-shaped layer regulation member 14 is formed of a non-magnetic roller for regulating the thickness of the two-component developer layer 3 held on the surface of the development roller 13 (sleeve 13*a*) to a predetermined thickness (FIG. 10). The end of the layer thickness regulation member 14 is press-fitted into the receiving groove 20*e* formed in the lower housing 30 so that the layer thickness regulation member 14 is disposed to be opposite to the surface of the sleeve 13*a* with a clearance therebetween corresponding to a thickness to which a layer is regulated (FIG. 15). The entrance side of the receiving groove 20*e* is formed so as to become wider than the outside diameter of the layer thickness regulation member 14. A part of the receiving groove 20*e* corresponding to a normal attachment position of the layer thickness regulation member 14 is formed so as to bulge slightly inward.

Figure 17A:
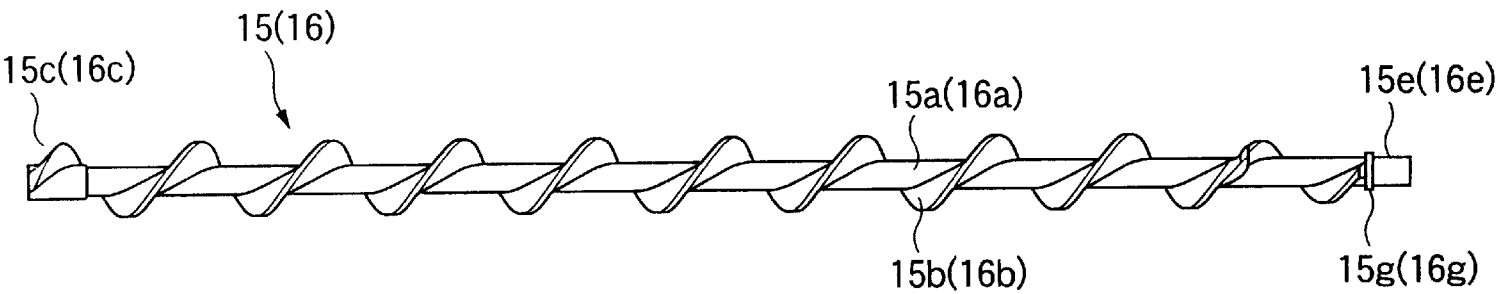
FIG. 17A is a front view of the auger.
Figure 17C:
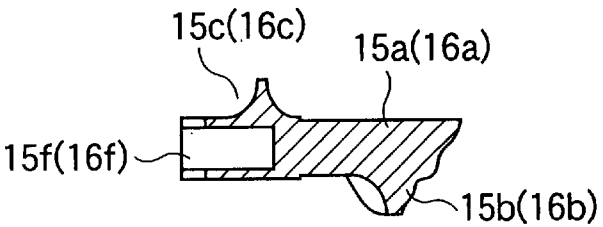
FIG. 17C is a cross-sectional view taken along line C—C shown in FIG. 17B.
Figure 17B:
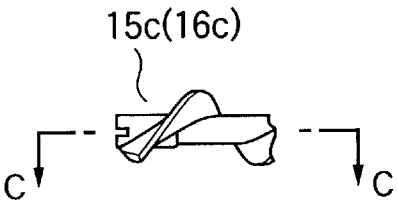
FIG. 17B is a front view showing one end of the auger.

As shown in FIGS. 9 and 17, the augers 15 and 16 are rotary members, wherein a vane section 15*b*, 16*b* for agitating and transporting the two-component developer 3 are spirally wrapped around a rotary shaft sections 15*a*, 16*a* at a predetermined pitch, respectively. Shaft insertion holes 15*f*, 16*f* having grooves for receiving engaging projections are formed in driven-side end sections 15*c*, 16*c* and shafts having engaging projection receiving grooves formed in drive gears (62, 63) described later is inserted into the shaft insertion holes 15*f*, 16*f*, respectively. Flange sections 15*g*, 16*g* for locking engaging claws of bearing caps (67) described later are formed on the remaining ends 15*e*, 16*e*, respectively.

The auger 15 is inserted into the bearing support hole 20*a* so as to be driven to rotate within the developer circulation transport path 21*b* of the two rows of developer circulation transport paths in the developer storage recess 21 of the lower housing 20. The auger 16 is inserted into the bearing support hole 20*b* so as to be driven to rotate within the developer circulation transport path 21*c* of the two rows of developer circulation transport paths in the developer storage recess 21 of the lower housing 20. As shown in FIGS. 19A and 20, a drive gear 62 is inserted into, from outside, the bearing support hole 20*a* of the lower housing 20 to which a pair of bearing rings 15*h* is fitted. The driven-side end 15*c* is rotatably supported by the drive gear 62. A drive gear 63 is inserted into, from outside, the bearing support hole 20*b* of the lower housing 20 having a pair of bearing rings 16*h* fitted therein. The driven-side end 16*c* is rotatably supported by the drive gear 63. The drive gear 62 is constituted of a main body formed gear teeth 62*a* thereon and an insert shaft 62*b* having an engaging projection formed on one side surface of the main body so as to project. The drive gear 63 is constituted of a main body formed gear teeth 63*a* thereon and an insert shaft 63*b* having an engaging projection formed on one side surface of the main body so as to project. The insert shaft 62*b* is inserted into the bearing support hole 20*a* and is inserted into the shaft insertion hole 15*f* formed in the end section 15*c* (FIG. 17C). The insert shaft 63*b* is inserted into the bearing support hole 20*b* and is inserted into the shaft insertion hole 16*f* formed in the end section 16*c* (FIG. 17C). A rotary shaft 62*c* is formed so as to project from the remaining surface of the main body of the drive gear 62 having the gear teeth 62 formed thereon. A rotary shaft 63*c* is formed so as to project from the remaining surface of the main body of the drive gear 63 having the gear teeth 63 formed thereon.

As shown in FIGS. 19B and 21, the bearing cap 67 is attached to each of the other ends 15*e*, 16*e* of the augers 15, 16. Subsequently, one of the bearing caps 67 is inserted into and rotatably supported by the bearing support hole 20*a* of the lower housing 20 having a pair of bearing rings 15*h* inserted therein. The remaining of the bearing caps 67 is inserted into and rotatably supported by the bearing support hole 20*b* of the lower housing 20 having a pair of bearing rings 16*h* inserted therein. The bearing caps 67 have fitting holes 67*a* for receiving the other ends 15*e*, 16*e* of the augers 15, 16 and a plurality of claws 67*b* engaged with the flange sections 15*g*, 16*g*, respectively.

Figure 18A:
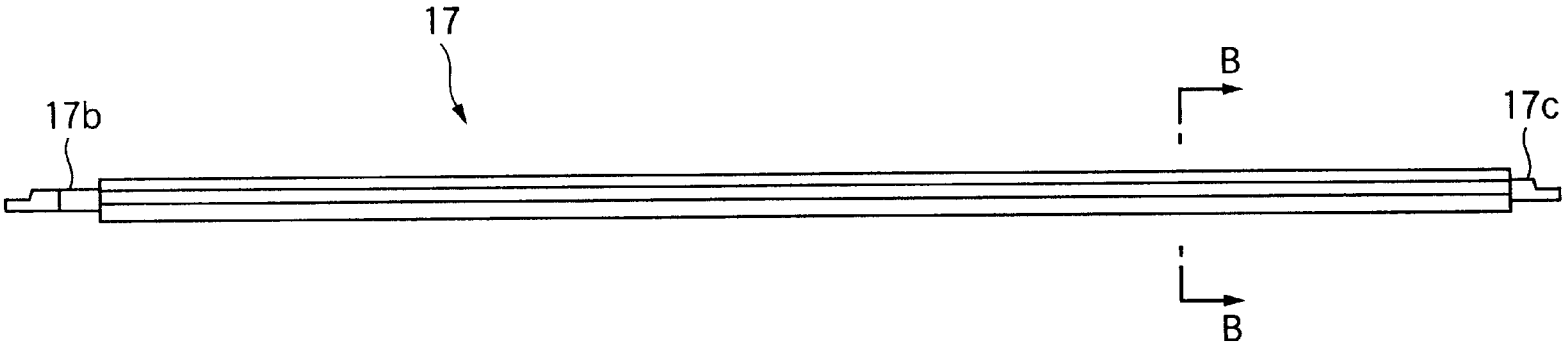
FIG. 18A is a front view of the paddle wheel.
Figure 18B:
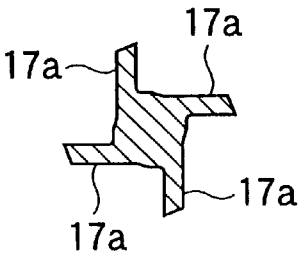
FIG. 18B is a cross-sectional view taken along line B—B shown.

As shown in FIGS. 9 and 18, the paddle wheel 17 is a rotary member constituted of a rotary shaft section having four vane sections 17*a* formed thereon. A driven-side end section of the paddle wheel 17 is formed as a rotary shaft 17*b*, and a remaining end section of the paddle wheel 17 is formed as a rotary shaft 17*c*.

The paddle wheel 17 is driven to rotate while being situated in the upper developer supply section 23 of the lower housing 20. As shown in FIGS. 19A and 20, the drive gear 64 is inserted into the bearing support hole 20*c* of the lower housing 20, and the driven-side rotary shaft 17*b* is rotatably supported by the drive gear 64. The drive gear 64 comprises a main body having gear teeth 64*a* formed thereon. An insertion shaft 64*b* is formed so as to protrude from one side of the main body, and a shaft insertion hole for fittingly receiving the rotary shaft 17*b* is formed in the insertion shaft 64*b*. The insertion shaft 64*b* is inserted into the bearing support hole 20*c*, and the rotary shaft 17*b* of the paddle wheel 17 is fitted into the shaft insertion hole. A rotary shaft 64*c* is formed so as to protrude from the side of the drive gear 64 opposite the side having the insertion shaft 64*b* formed thereon.

As shown in FIGS. 19B and 21, a bearing joint 68 is attached to the remaining rotary shaft 17*c* of the paddle wheel 17, and the bearing joint 68 is inserted into and rotatably supported by the bearing support hole 20*c* of the lower housing 20. A flange section 68*a* is formed in the center of the bearing joint 68. A first shaft section 68*b* is formed on one side of the flange section 68*a*, and an insertion hole for receiving the rotary shaft 17*c* is formed in the first shaft section 68*b*. A second shaft section 68*c* is formed on the other side of the flange 68*a*, and a pin insertion hole for receiving a bearing pin (55) to be described later is formed in the second shaft section 68*c*.

As shown in FIGS. 8 and 10, the development apparatus 100 has a first side bracket 40 and a second side bracket 50. The first side bracket 40 is fitted, from the outside, to both ends of the housing 10 in the longitudinal direction assembled by joining the upper housing 20 and the lower housing 30, and the second side bracket 50 is fitted to the other longitudinal side of the housing 10 from the outside.

Figure 22A:
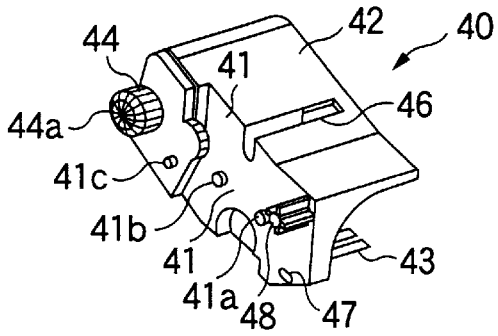
FIG. 22A is a perspective view of the first side bracket.
Figure 22B:
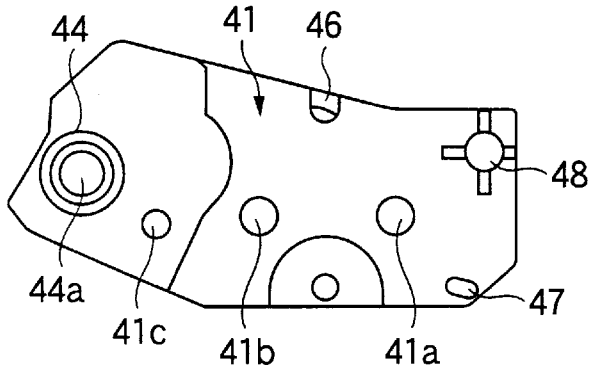
FIG. 22B is a side view of the first side bracket when viewed from the side.
Figure 22C:
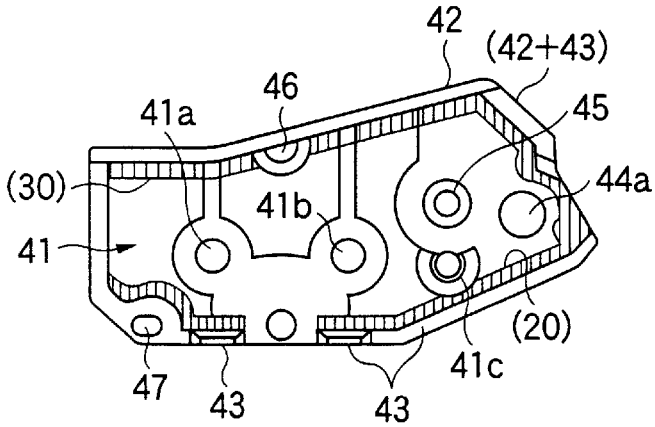
FIG. 22C is a side view of the same when viewed from inside.
Figure 23A:
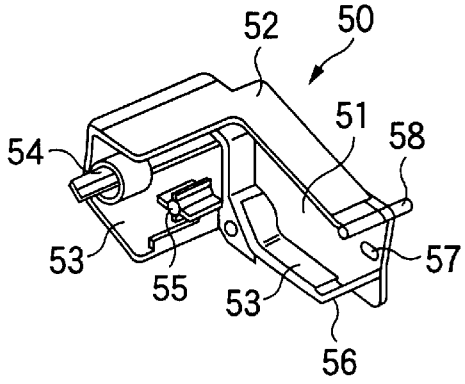
FIG. 23A is a perspective view of the first side bracket.
Figure 23B:
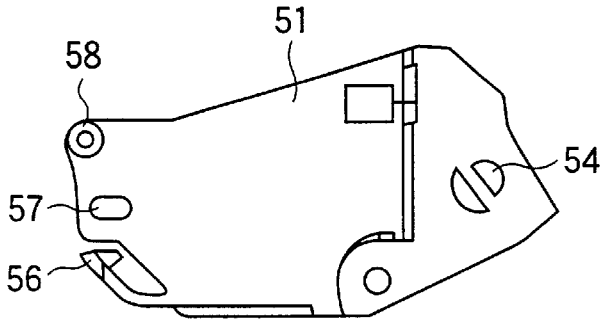
FIG. 23B is a side view of the first side bracket when viewed from the side.
Figure 23C:
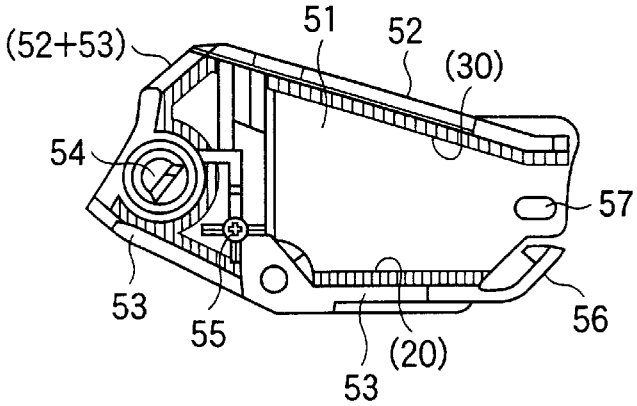
FIG. 23C is a side view of the same when viewed from inside.

As shown in FIGS. 22A through 22C, the first side bracket 40 is in principle constituted of a side surface section 41, an upper fitting frame section 42, and a lower fitting frame section 43. The side surface section 41 substantially corresponds in shape to both right and left side sections of the housing 10. The upper and lower fitting frame sections 42, 43, 52, 53 are formed so as to protrude from the side surface section 41, 51 toward the right-side and left-side end of the housing 10, as well as are formed in a shape such that the upper and lower fitting frame sections 42, 43, 52, 53 are to come into contact with a predetermined area on the outer circumferential surface of the right-side and the left-side end of the housing 10 (a hatched area in FIGS. 22C, 23C show a portion of the housing 10 remaining in contact with the side bracket 40). The side bracket 40, 50 is fitted to the right-side and the left-side end of the housing 10. As a result, particularly the upper and lower fitting frame sections 42, 43, 52, 53 fit around the lower and the upper housing 20, 30 in the vertical direction, thereby reinforcing the joined status of the lower and the upper housing 20, 30 as required.

Formed in the side surface section 41 of the first side bracket 40 are a bearing projection 44 having a shaft hole 44*a* for receiving the rotary shaft 13*c* of the development roller 13; a bearing hole 41*a* for receiving and supporting the rotary shaft 62*c* of the drive gear 62 attached to the auger 15; a bearing hole 41*b* for receiving and supporting the rotary shaft 63*c* of the drive gear 63 attached to the auger 16; and a bearing hole 41*c* for receiving and supporting the rotary shaft 64*c* of the drive gear 64 having the rotary shaft 17*c* of the paddle wheel 17 inserted therein. A spindle 45 is formed on the interior of the side surface section 41 for rotatably supporting an idler gear 65 (see FIGS. 19A and 20). First gear teeth 65*a* formed on the idler gear 65 mesh with the drive gear 61 of the development roller 12, and second gear teeth 65*b* formed on the idler gear 65 mesh with the drive gear 64 of the paddle wheel 17. A tip section 45*a* of the support shaft 45 is to be inserted into and supported by a bearing 20*f* formed in the side surface section of the lower housing 20 (shown in FIGS. 19A and 20).

The upper fitting frame section 42 of the first side bracket 40 is formed into the shape of a cover such that the cover covers a portion of the surface of the end section of the upper housing 30 and covers a space defined above the drive gears 61 through 65 acting as a rotary transmission mechanism. A engage groove hole 46 is formed in substantially the center of the upper fitting frame section 42. When the first side bracket 40 is fitted to the upper housing 30, the engaging projection 30*b* (FIG. 14) formed so as to project from the exterior surface of the end section of the upper housing 30 fits into and is engaged with the engage groove hole 46. The lower fitting frame section 43 of the first side bracket 40 is formed into the shape of a cover such that the cover covers a portion of the lower surface of the end section of the lower housing 20. The lower fitting frame section 43 is formed such that a portion of the section 43 is continuous to a portion of the upper fitting frame section 42, and covers substantially all the space defined below the drive gears 61 through 65. A continuous section (42+43) between the upper and lower fitting frame sections 42 and 43 is formed so as to be able to hide the engaged section 27 and engaging pieces 37 for snap fitting and to come close to or come into contact with the upper and lower housings 30 and 20 to thereby press (or clamp) the housings 20 and 30 so as to prevent occurrence of movement in a direction in which the engaging pieces 37 are disengaged from the engaged sections 27.

A engage hole 47 is formed in a lower portion opposite to the bearing projection 44 of the side surface section 41. In case of attachment of the first side bracket 40, the engaging projection 20*f* of the lower housing 20 is inserted into the engage hole 47. A mount engaging pin 48 is formed so as to project toward the exterior surface of the first side bracket 40 from an upper portion opposite to the bearing projection 44 of the side surface section 41. When the development apparatus 100 is finally attached to a predetermined image forming apparatus, the mount engage pin 48 is used. Of the mount engaging pin 48, only a tip end section 48*a*, exclusive of a base portion formed so as to project by the same projecting amount of the shaft bearing projection 44 projects, is fitted into a positioning hole formed in an object of attachment.

A shaft fixing hole 54 and a spindle 55 are formed on the side surface section 51 of the second side bracket 50. The center shaft 13*d* of the development roller 13 is inserted into the shaft fixing hole 54 and is fixedly positioned at a given angle. The spindle 55 receives and supports the second shaft section 68*c* of the bearing joint 68 attached to the end 17*c* of the paddle wheel 17.

The upper fitting frame section 52 of the second side bracket 50 is formed into the shape of a cover such that the cover covers a portion of the surface of the end section of the upper housing 30 and covers a space defined around the bearing joint 68 of the paddle wheel 17. The lower fitting frame section 53 of the second side bracket 50 is formed into the shape of a cover such that the cover covers a portion of the lower surface of the end section of the lower housing 20. Further, the lower fitting frame section 53 is formed such that a portion of the lower fitting frame section 53 is continuous to a portion of the upper fitting frame section 52. Whereby, the lower fitting frame section 53 hides a space defined around the bearing joint 68 of the paddle wheel 17. An engaging projection arm section 56 is formed at the end of the lower fitting frame section 53 opposite to the shaft fixing hole 54. In case of attachment of the second side bracket 50 is fitted to the housings, the engaging projection arm 56 fits into and is engaged with the recess formed in the rear side surface of the lower housing 20. Moreover, a continuous section (52+53) between the upper and lower fitting frame sections 52 and 53 is formed so as to be able to hide the engaged section 27 and engaging pieces 37 for snap fitting and to come close to or come into contact with the upper and lower housings 30 and 20 to thereby press (or clamp) the housings 20 and 30 so as to prevent occurrence of movement in a direction in which the engaging pieces 37 are disengaged from the engaged sections 27.

An engage hole 57 is formed in the center of the edge of the side surface section 51 of the second side bracket 50 opposite to the shaft fixing hole 54. Further, amount engaging pin 58 is formed so as to project toward the exterior surface of the second side bracket 50 from an upper portion on the edge of the side surface section 51 opposite to the shaft fixing hole 54. The mount engage pin 58 is used when the development apparatus 100 is finally attached to a predetermined image forming apparatus.

<Assembly of Development Apparatus>

The development apparatus 100 is assembled as follows:

After the seal member 19 of the development roller 13 has been attached to the shaft support section 20*d*, rotary members, such as the development roller 13, the two augers 15, 16, and the paddle wheel 17, are attached (see FIGS. 19A through 21).

First, the driven-side rotary shaft 13*c* of the development roller 13 is inserted into the shaft support section 20*d*, and the clearance retention ring 60 is fitted around and supported on the rotary shaft 13*c*. The center shaft 13*d*; that is, the other end of the development roller 13, is inserted into the shaft support section 20*d*. The clearance retention ring 60 is fitted around the center shaft 13*d*. Next, after the end 17*c* of the paddle wheel 17 has been inserted into and supported on the first shaft section 68*b* of the bearing joint 68, the other end 17*b* is inserted into and attached to the insertion shaft 64*b* of the drive gear 64 fitted in the bearing hole 20*c*. After the end 15*e* of the auger 15 has been inserted into and supported on the bearing hole 20*a* while being covered by the bearing cap 67, the driven-side shaft end section 15*c* is coupled to and supported on the insertion shaft 62*b* of the drive gear 62 fitted into the bearing hole 20*a*. Then, after the end 16*e* of the auger 16 has been inserted into and supported on the bearing hole 20*b* while being covered by the bearing cap 67, the driven-side shaft end section 16*c* is coupled to and supported on the insertion shaft 62*b* of the drive gear 63 fitted into the bearing hole 20*b*. Each of these rotary members can be attached with comparative ease.

As shown in FIG. 15, either end of the roll-shaped layer thickness regulation member 14 is fitted into the attachment grove 20*e* of the lower housing 20 having the rotary members attached thereto. Further, the partition frame plate 18 is fitted into the mount groove 24.

As shown in FIG. 11, the rotary member such as the development roller 13 and the other component such as the roller-shaped layer thickness regulation member 14 now has been attached to the lower housing 20. At this time, at the end of the lower housing 20 having the rotary transmission mechanism provided thereon (i.e., the left-side end of FIG. 11), the drive gears 62 and 63 are engaged with each other, and the drive gears 63 and 64 are engaged with each other. Although the drive gear 61 is inserted into and attached to the rotary shaft 13*c* of the development roller 13, the drive gear 61 is attached so as to become offset from the drive gear 64. Hence, no direct engagement arises between the drive gears 61 and 64.

Next, as shown in FIGS. 24 through 27, the upper housing 30 is attached and fixed to the lower housing 20. Incidentally, the upper housing 30 is finished only by attaching the opening/closing door 33*a* of the developer receiving section 33 and processing the resilient member 39. The lower housing 20 requires attachment of the rotary member and the like. However, finish of the upper housing 30 does not require such an attachment of the rotary member and the like at all.

Figure 24A:
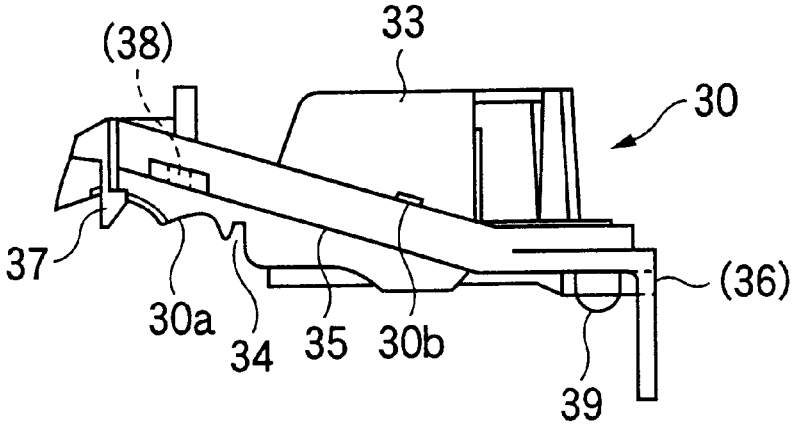
FIGS. 24A and 24B are exploded side views showing one end section of a structure for fixedly joining together the upper and lower housings.
Figure 24B:
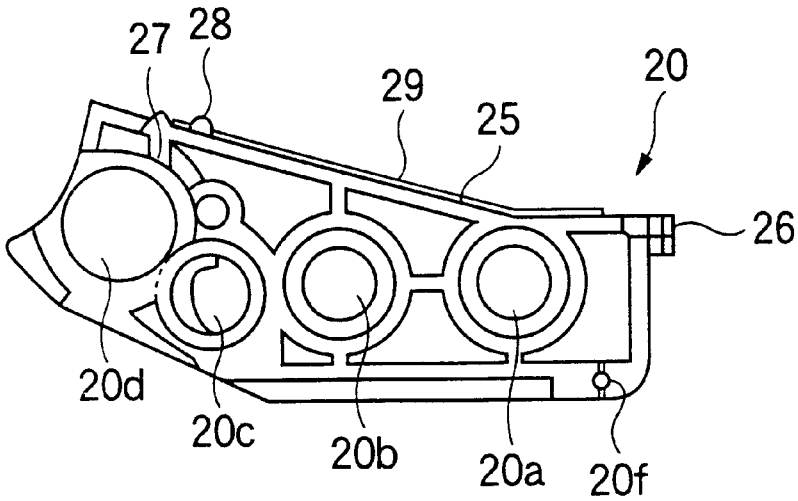
Figure 25A:
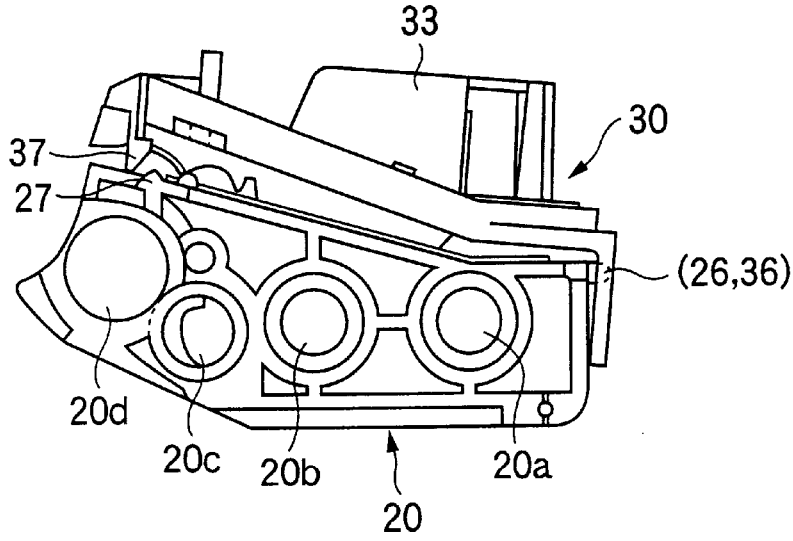
FIG. 25 sows the structure for fixed joining of FIG. 24, wherein FIG. 25(*a*) is a side view showing the upper and lower housings before they are fixedly joined together.
FIG. 25B is a side view showing the upper and lower housings after they have been fixedly joined together.
Figure 26A:
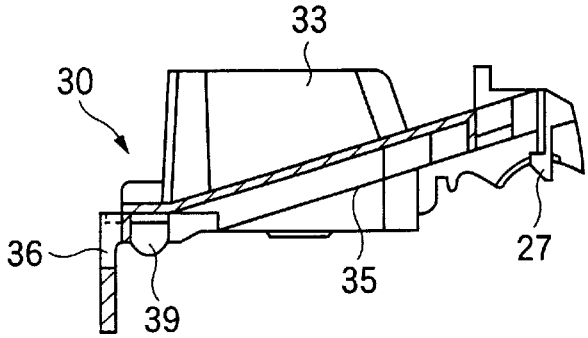
FIG. 26 shows another end section of the structure for fixedly joining the upper and lower housings together.
Figure 26B:
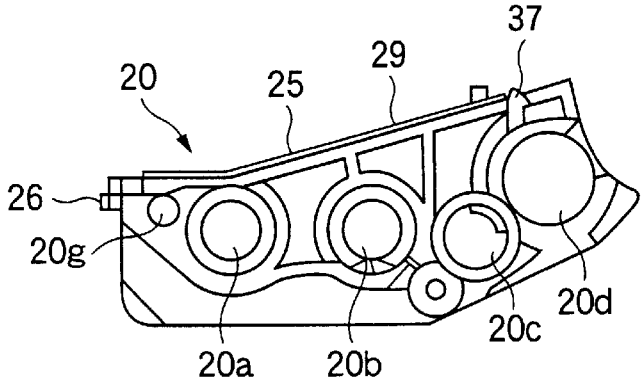

The upper housing 30 is caused to approach the lower housing 20 from above (FIGS. 24 and 26). Subsequently, the engaging projection pieces 26*a*, 26*b*, 26*c*, 26*d*, and 26*e* provided in the rear positions on the lower housing 20 are lightly fitted into the engaging holes 36*a*, 36*b*, 36*c*, 36*d*, and 36*e* provided in the rear positions on the upper housing 30 (FIG. 25A). At this time, a forward portion of the upper housing 30 (i.e., the housing opening section 11 of the upper housing 30) remains slightly separated from the lower housing 20. In this state, the upper housing 30 is pressed down toward the lower housing 20 (in a pivoting manner while an insertion section between the engaging projection piece 26 and the engage hole 36 is taken as a fulcrum).

Figure 25B:
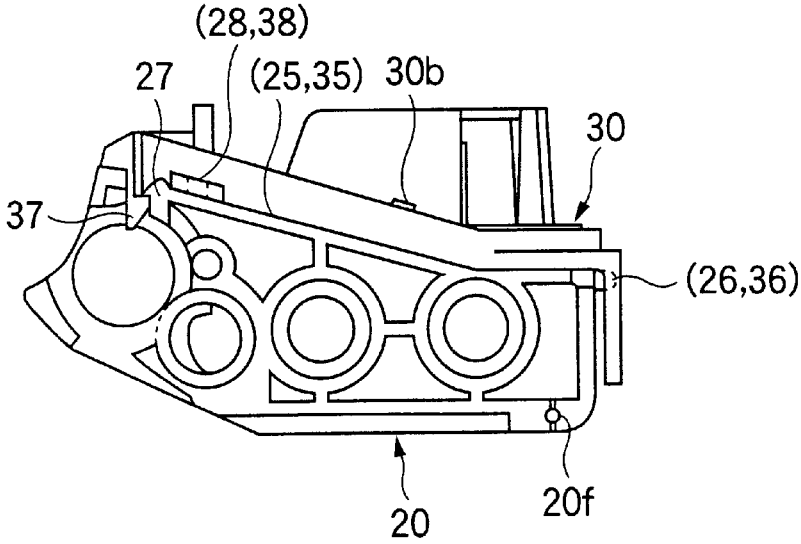
Figure 27:
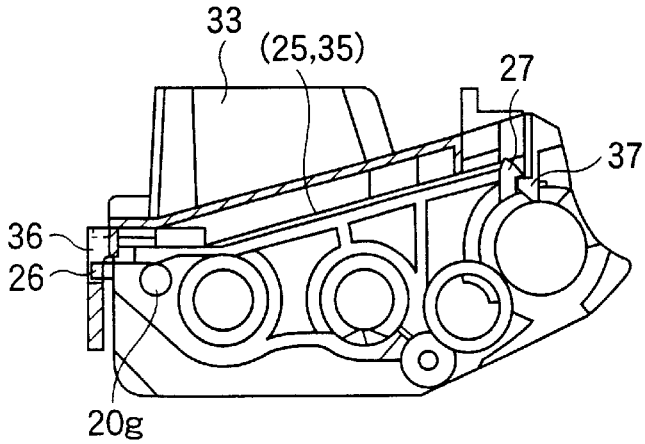
FIG. 27 is a side view showing the state of the upper and lower housings after they have bee joined together.

As a result, the snap-fit engaging piece 37 located in the vicinity of the opening 11 of the upper housing 30 is moved to a position lower than the snap-fit engaged section 27 provided on the lower housing 20 while being susceptible to resilient deformation. At the lowermost end (i.e., the hook) of the engaged section 27, the engaging piece 37 is restored to its original state from the resiliently-deformed state and is engaged with the lowermost end (FIGS. 25B and 27). Concurrently, the positioning pin 28 provided on the lower housing 20 is inserted into the positioning hole 38 formed in the upper housing 30. Consequently, the lower housing 20 and the upper housing 30 are fixedly joined together while remaining positioned. In short, the lower housing 20 and the upper housing 30 are accurately joined and integrated together.

Figure 28:
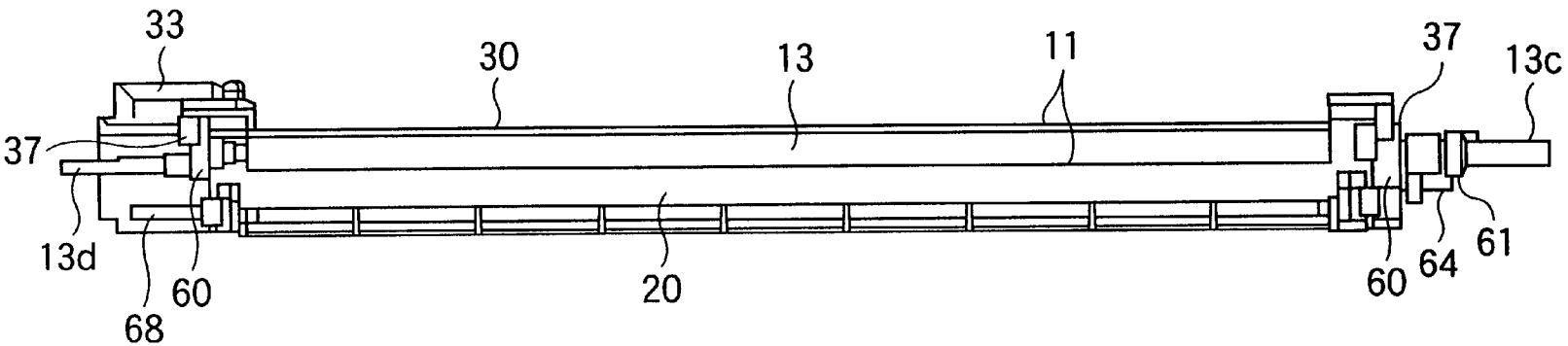
FIG. 28 is a front view showing the development apparatus after the upper and lower housings have been fixedly joined together.
Figure 29A:
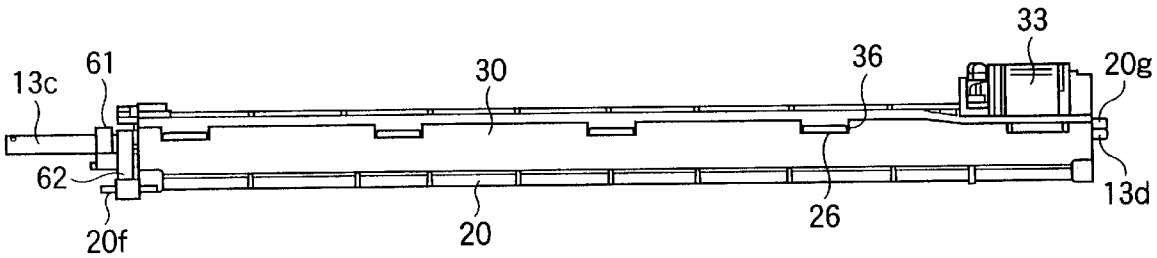
FIG. 29A is a rear view of the apparatus.
Figure 29B:
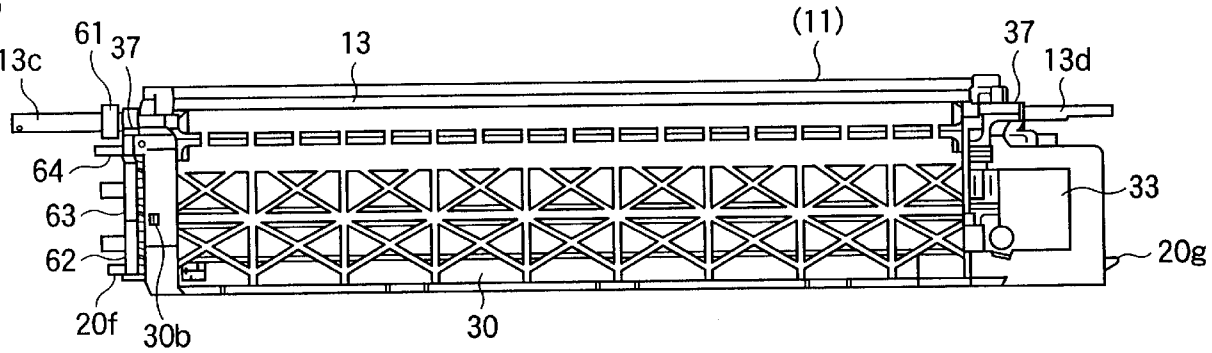
FIG. 29B is a top view of the same.
Figure 29C:
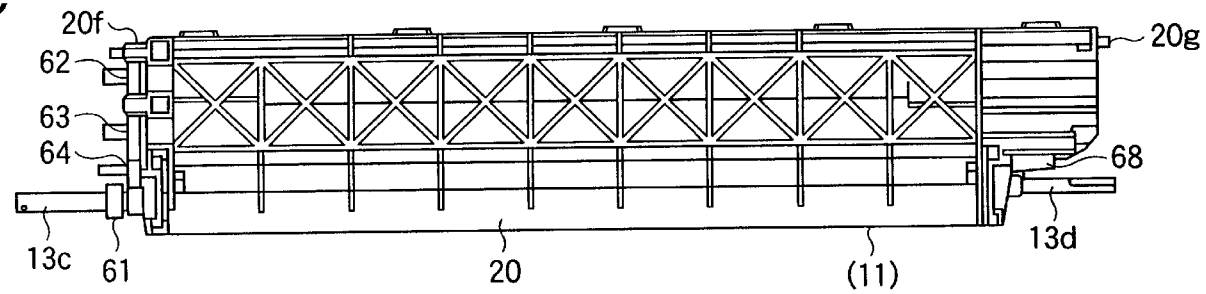
FIG. 29C is a bottom view of same.

FIGS. 28 through 29C show the appearance of the lower housing 20 and the upper housing 30 when they are fixedly joined together. FIG. 28 is a front view of the housing opening section 11; FIG. 29A is a rear view of the assembled housing; FIG. 29B is a top view of the same; and FIG. 29C is a bottom view of the same. In this stage, the drive gears 62 through 64 and the bearing joint 68, which act as the rotary transmission mechanism, still remain exposed to the outside. Further, the drive gear 61 is preferably attached to the rotary shaft 13*c* of the development roller 13 at this stage. However, the drive gear 61 still remains exposed to the outside in the same manner as do the other drive gears.

The first side bracket 40 and the second side bracket 50 are attached to both ends of the housing 10 in which the lower housing 20 and the upper housing 30 are fixedly joined together.

After the idler gear 65 has been inserted into the spindle 45 provided on the interior surface of the side surface section 41, the first side bracket 40 is fitted to the end of the housing where the drive gears 61 through 64 are provided (FIG. 19A and others). At this time, the rotary shaft 13*c* of the development roller 13 is inserted into the bearing projection 44. The rotary shaft 62*c* of the drive gear 62 attached to the auger 15 is inserted into and supported on the bearing hole 41*a*, and the rotary shaft 63*c* of the drive gear 63 attached to the auger 16 is inserted into and supported on the bearing hole 41*b*. The rotary shaft 64*c* of the drive gear 64 attached to the paddle wheel 17 is inserted into and supported on the bearing hole 41*c*. Further, the idler gear 65 is engaged simultaneously with the drive gears 61 and 64, and the tip of the spindle 45 is inserted into the bearing section 20*f*. The engaging projection 20*f* of the lower housing 20 is inserted into the engage hole 47, and the engaging projection 30*b* of the upper housing 30 is engaged with the engage groove hole 46. As a result, the first side bracket 40 is fixedly attached to the housing 10.

The second side bracket 50 is fitted to the end of the housing 10 where the center shaft 13*d* of the development roller 13 is present (FIG. 19B and others). At this time, the center shaft 13*e* of the development roller 13 is inserted into and fixed to the shaft fixing hole 54. The second shaft section 68*c* of the bearing joint 68 of the paddle wheel 17 is inserted into and supported on the spindle 55. The engaging projection 20*g* of the lower housing 30 is inserted into the engage hole 57, and the engaging projection arm section 56 fits into and is engaged with the recess of the lower housing 30. As a result, the second bracket 50 is fixedly attached to the housing 10.

Figure 30:
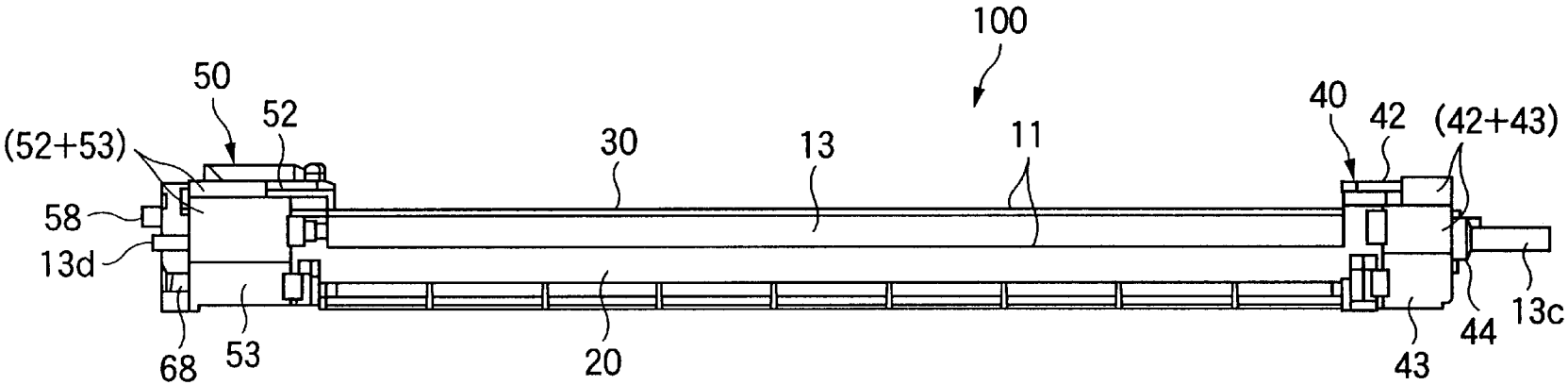
FIG. 30 is a front view showing the development apparatus when assemble of the development apparatus equipped with the side brackets has been completed.
Figure 31A:
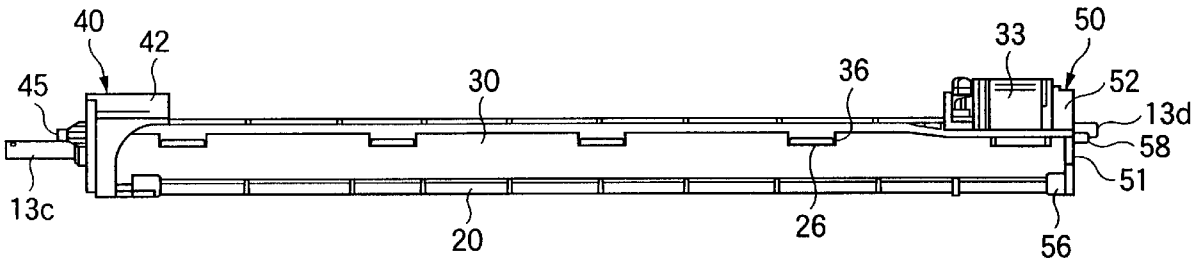
FIG. 31A is a rear view of the apparatus.
Figure 31B:
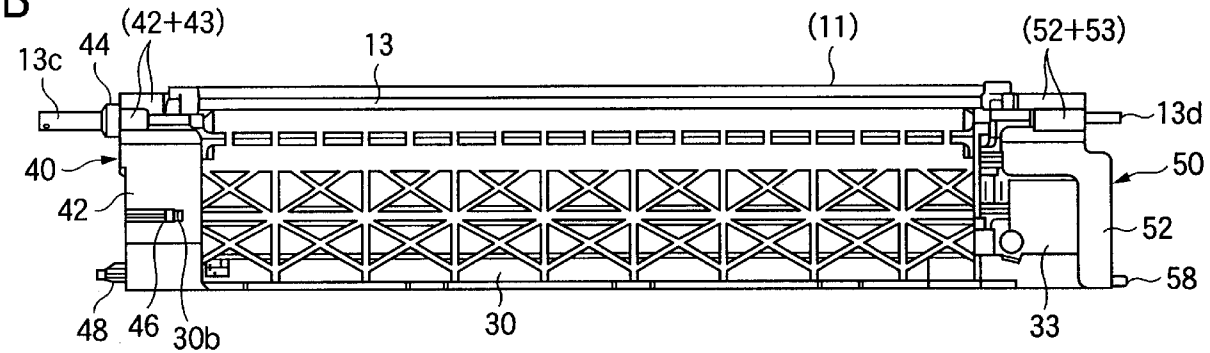
FIG. 31B is a top view of the same.
Figure 31C:
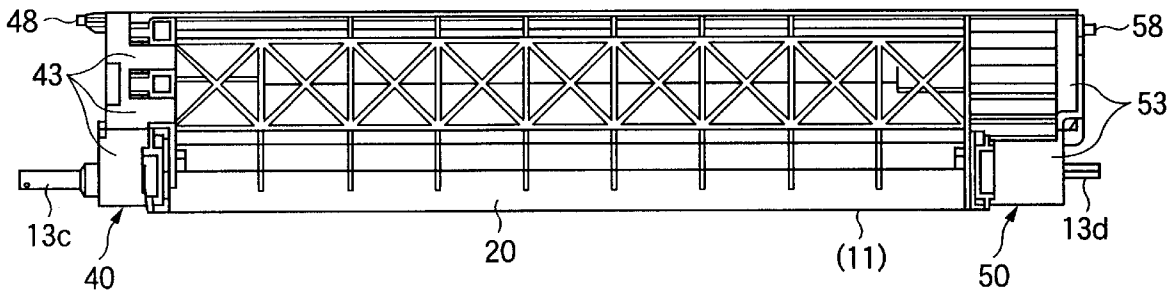
FIG. 31C is a bottom view of the same.

The development apparatus 100 has been assembled in the manner mentioned above. FIGS. 30 through 31 show the appearance of the development apparatus when assembly of the development apparatus has been completed by means of attachment of the side brackets 40, 50. FIG. 30 is a front view of the housing opening section 11 side; FIG. 31A is a rear view of the development apparatus; FIG. 31B is a top view of the same; and FIG. 31C is a bottom view of the same. At this stage, the drive gears 61 through 65, and the bearing joint 68, which acts as a rotary transmission mechanism, are hidden by the side brackets 40, 50.

Assembly of the development apparatus does not involve use of fastening operation, such as screwing operation or welding operation. Hence, assembly of the development apparatus becomes very easy.

The lower housing 20 and the upper housing 30 are fixedly joined together by means of fixing action exerted by the plurality of engaging projection pieces 26 and the engaging holes 36 as well as of fixing action exerted by the snap-fit engaged section 27 and the snap-fit engaging section 37.

Particularly, the lower housing 20 and the upper housing 30 are fixed together by means of the snap-fit engaged section 27 and the snap-fit engaging section 37 located in the vicinity of shaft support sections 20*d* to which the shafts 13*c*, 13*d* provided at both ends of the development roller 13 are attached. Even if load stemming from rotation of the development roller 13 is exerted on the housing 10, the joined status of the housing 10 is retained securely. Further, the resilient member 39 interposed between the joining surface 25 of the lower housing 20 and the joining surface 35 of the upper housing 30 is resiliently deformed so as to be compressed when the upper and lower housings are fixedly joined together. Hence, the airtightness between the joining surfaces is ensured, thereby preventing leakage of the developer 3 stored in the developer storage recess 21. Restoration force stemming from resilient deformation firmly maintains the status of the engaging section 37 engaged with the snap-fit engaged section 27, thereby preventing disengagement of the engaging section 37 from the engaged section 27.

As a result of attachment of the side brackets 40, 50, the lower housing 20 and the upper housing 30 are clamped vertically. As a result, there is prevented occurrence of movement in a direction in which the housings 20, 30 depart from each other, thereby reinforcing the joined and fixed status of the housings 20, 30. Further, the continuous portions between the upper and lower fitting frame sections of the side brackets (42+43, 52+53) hide and press the snap-fit engaged section 27 and the snap-fit engaging section 37, thereby rendering disengagement of the engaging section 37 from the engaged section 27 difficult. Further, the snap-fit engaging section 37 becomes resiliently deformed and engaged. When engaged, the engaging section 37 is situated in an outer position. Since the side brackets 40, 50 are provided in the manner as mentioned above, there is obviated a chance of the snap-fit engaging section 37 being disengaged from the engaged section 27 as a result of coming into contact with something during transport. Thus, the engaged state of the engaging section 37 is retained more reliably.

Particularly, the side bracket 40 substantially hides the drive gears 61 through 65 acting as a rotary transmission mechanism of the rotary member, such as the development roller 13. As a result, there is prevented drop or entry of undesired matter floating during a development process of the development apparatus, such as toner, between drive gears. Accordingly, there is prevented occurrence of operation failures by entry of undesired matter. The side bracket 40 is provided with the bearing section 44 of the rotary shaft 13*c* of the development roller, the bearing sections 41*a* through 41*c* supporting the shafts of the drive gears 62 through 64, and the spindle 45 for the idler gear 65. Even in an environment in which the development roller 13 and the drive gears 62 through 65 must be closely and densely arranged in response to a request for miniaturization of the development apparatus, the interval between a train of gears can be made narrower without sacrificing an operating state of the gears, thereby more easily attaining further miniaturization of the development apparatus.

As a result of the upper housing 30 being fixedly joined to the lower housing 20, both ends of the roll-shaped layer thickness regulation member 14 fitted into the mount groove 20*e* of the lower housing 20 are pressed from above by means of the projection 30*a* of the upper housing 30. The end section of the layer thickness regulation member 14 is pressed into the mount groove 20*e* against resistance from a bulge in the mount groove 20*e*. Consequently, the roll-shaped layer thickness regulation member 14 is attached to a normal mount position of the mount groove 20*e*. As a result, the roll-shaped layer thickness regulation member 14 is disposed opposite to (the sleeve 13*a* of) the development roller 13 with a predetermined clearance therebetween (FIG. 9). As mentioned above, attachment of the roll-shaped layer thickness regulation member 14 can be effected easily and accurately. Moreover, the upper housing 30 is fixedly joined to the lower housing 20. Thus, the parallel plate 18 is also supported by the mount groove 34 of the upper housing 30.

A predetermined amount of two-component developer is filled from the developer receiving section 33 of the upper housing 30 in the thus-assembled development apparataus 100. Further, at the time of use of a development apparatus, the seal film 9 label affixed to the partition plate 18 is removed.

Structure for Mounting Development Apparatus

Next, a structure to be used for mounting the development apparatus 100 will be described.

Figure 32:
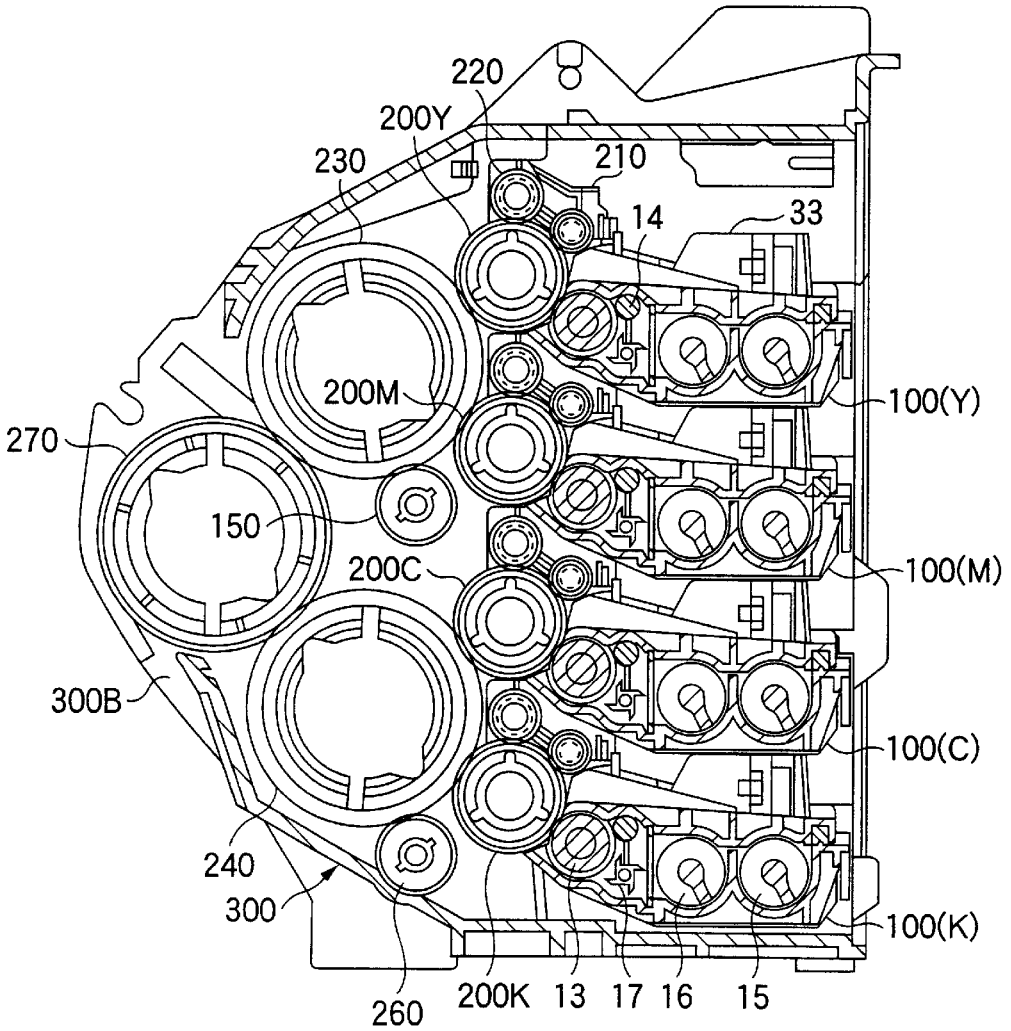
FIG. 32 is a fragmentary cross-sectional side view showing one example of construction of an image formation unit equipped with the development apparatus.
Figure 33:
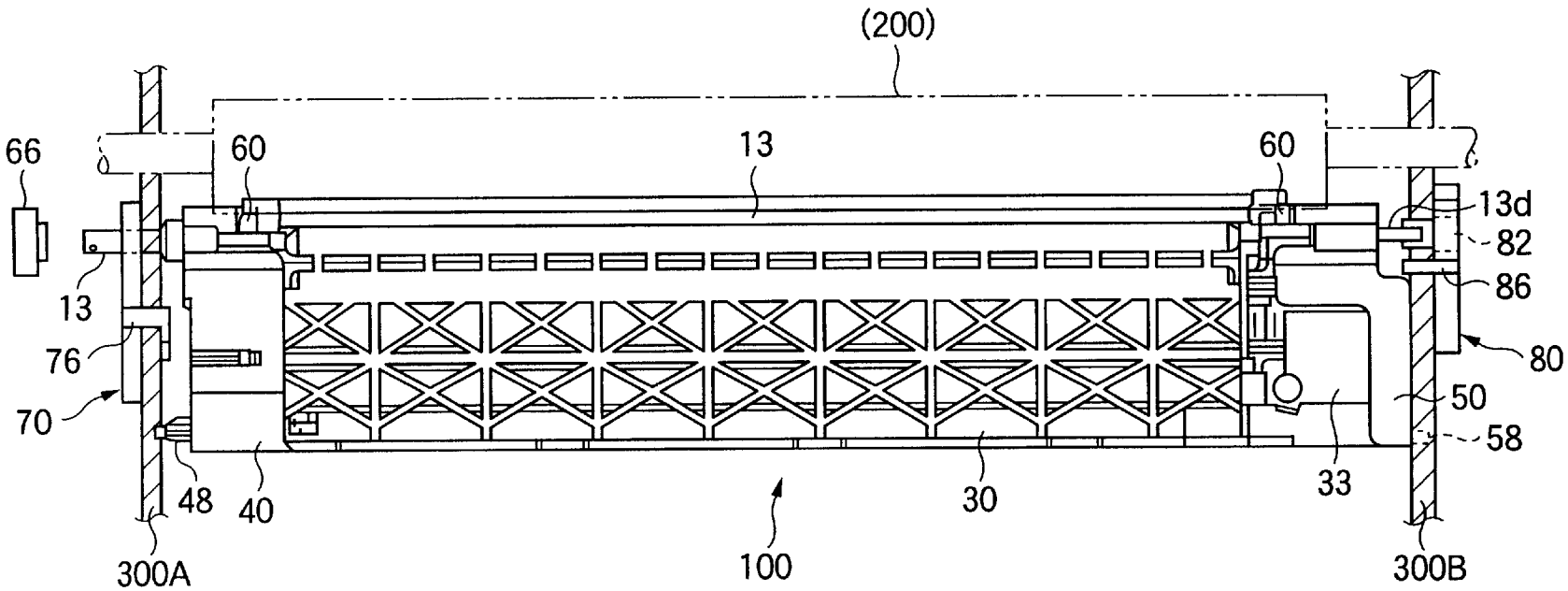
FIG. 33 is a fragmentary cross-sectional top view showing the state in which the development apparatus is mounted in the image formation unit shown in FIG. 32.

As shown in FIG. 32, the development apparatus 100 are mounted on a support frame 300 so as to correspond to four photosensitive drums 200Y, 200M, 200C, and 200K in a one-to-one correspondence. A yellow (Y) toner image is formed on the photosensitive drum 200Y; a magenta (M) toner image is formed on the photosensitive drum 200M; a cyan (C) toner image is formed on the photosensitive drum 200C; and a black toner image (K) is formed on the photosensitive drum 200K, which are vertically spaced apart from each other and arranged in one row on the support frame 300 of an image formation unit. As shown in FIG. 33, the four development apparatus are mounted on the support frame 300 through use of bearing support members 70, 80. One of two-component developers 3 of four colors is charged in each development apparatus in correspondence with the color of a toner image to be formed on the corresponding photosensitive drum 200. The support frame 300 has two support frames (plates) 300A, 300B which mutually oppose each other with the development apparatus 100 interposed therebetween.

As shown in FIG. 32, reference numeral 210 designates an electrostatically-charging roller for uniformly charging each of the photosensitive drums 200; 220 designates a cleaning roller for removing toner still remaining on each of the photosensitive drums 200; 230 designates a first intermediate transfer drum on which toner images are to be primarily transferred from the photosensitive drums 200Y and 200M; 240 designates a second intermediate transfer drum on which toner images are to be primarily transferred from the photosensitive drums 200C and 200K; 250 designates a cleaning roller for removing the toner still remaining on the first intermediate transfer drum 230; 260 designates a cleaning roller for removing the toner still remaining on the first intermediate transfer drum 230; and 270 designates a final intermediate transfer drum on which the toner image on the first intermediate transfer drum 230 and the toner image on the second intermediate transfer drum are to be secondarily transferred. Reference numeral 66 shown in FIG. 33 designates a final drive gear finally attached to the rotary shaft 13*c* of the development roller.

Figure 34:
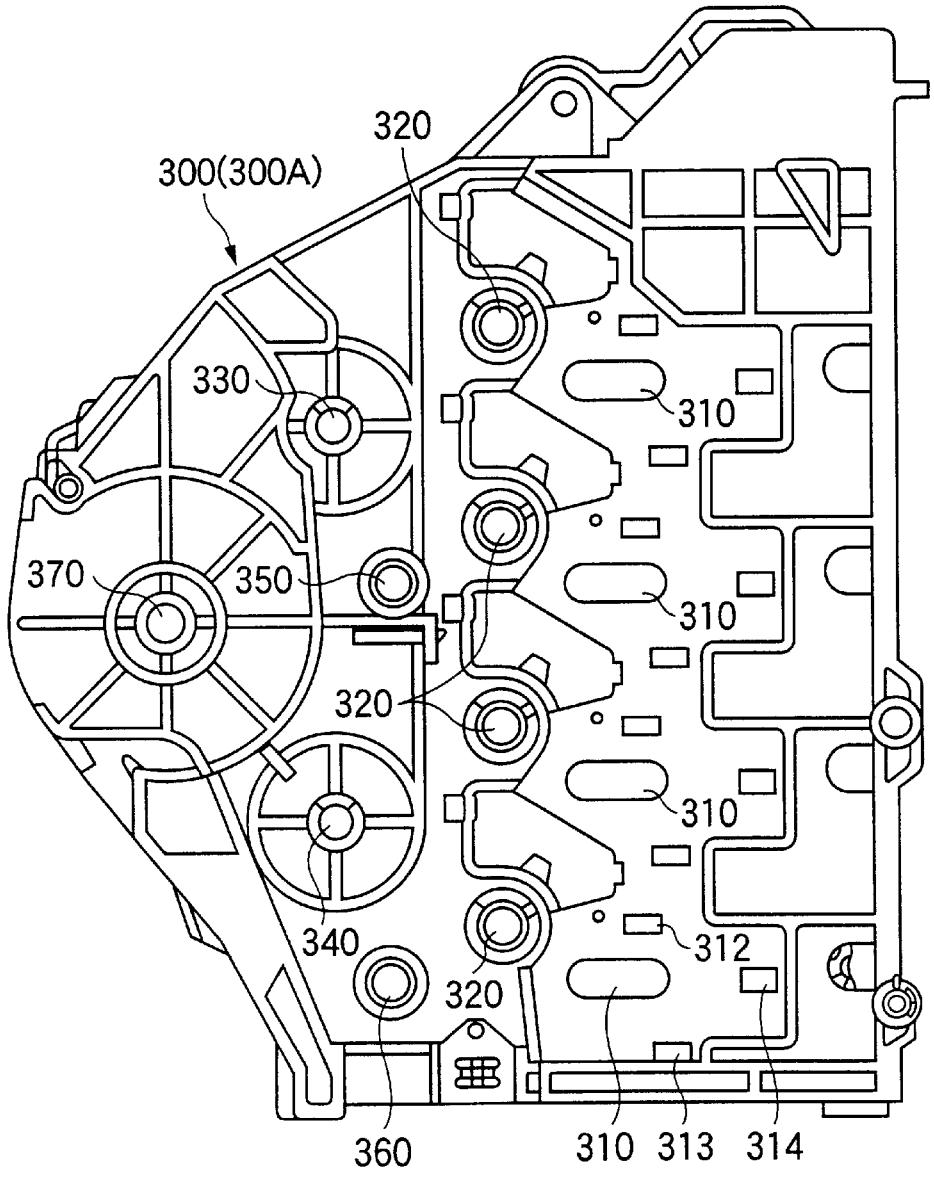
FIG. 34 is a side view showing a support frame (on one side) of the image formation unit shown in FIG. 32.

FIG. 34 is a side view of the support frame 300A when viewed from the outside. The illustrated support frame 300 is in a state such that the development apparatus 100 have not yet been mounted on the frame. As shown in the drawing, reference numeral 320 designates bearing sections on which the photosensitive drums 200Y, 200M, 200C, and 200K are to be mounted; 330 designates a bearing section on which the rotary shaft of the first intermediate transfer drum 230 is to be mounted; 340 designates a bearing section on which the rotary shaft of the second intermediate transfer drum 240 is to be mounted; 350 designates a bearing section on which the cleaning roller 250 is to be mounted; 360 designates a bearing section on which the cleaning roller 260 is to be mounted; and 370 designates a bearing section on which the rotary shaft of the final intermediate transfer drum 270 is to be mounted. Mount holes 310A, 312A, 313A, 314A to be used for mounting the development apparatus 100 are formed in the vicinity of the bearing section 320 on the support frame 300. Here, the mount holes 310 are elongated holes which are formed in a predetermined positional relationship with the bearing sections 320 for the photosensitive drums 200, and the rotary shaft 13*c* of the development roller 13 is to be inserted into each of the mount holes 310. Three engaging projections provided on each of the bearing supports 70, 80 are to be engaged on the mount holes 312 through 314.

Figure 35A:
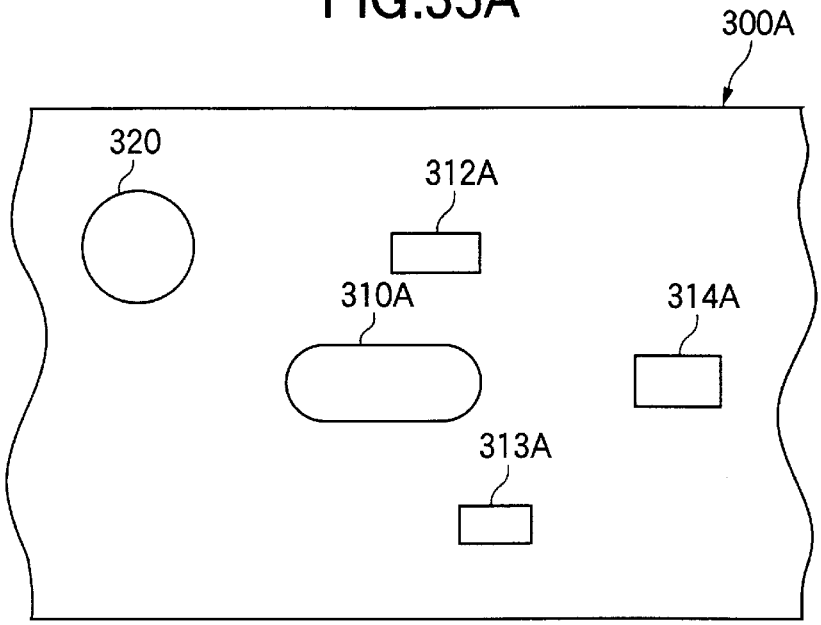
FIG. 35A is a side view showing the principal section of a support frame on which the development apparatus is to be mounted.
Figure 35B:
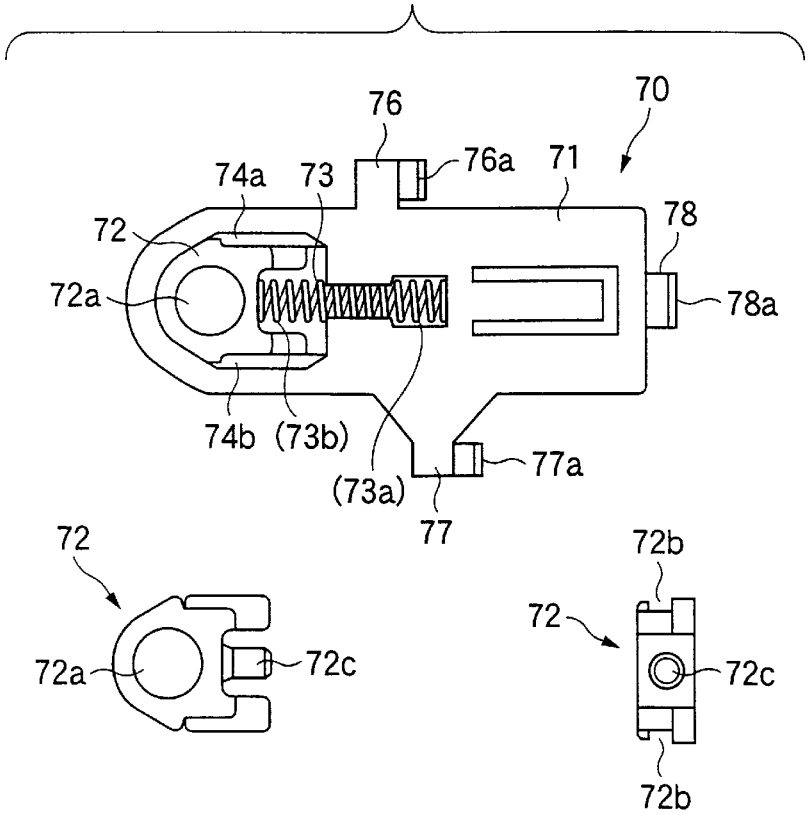
FIG. 35B is a side or rear view showing a bearing support member and its components.
Figure 37A:
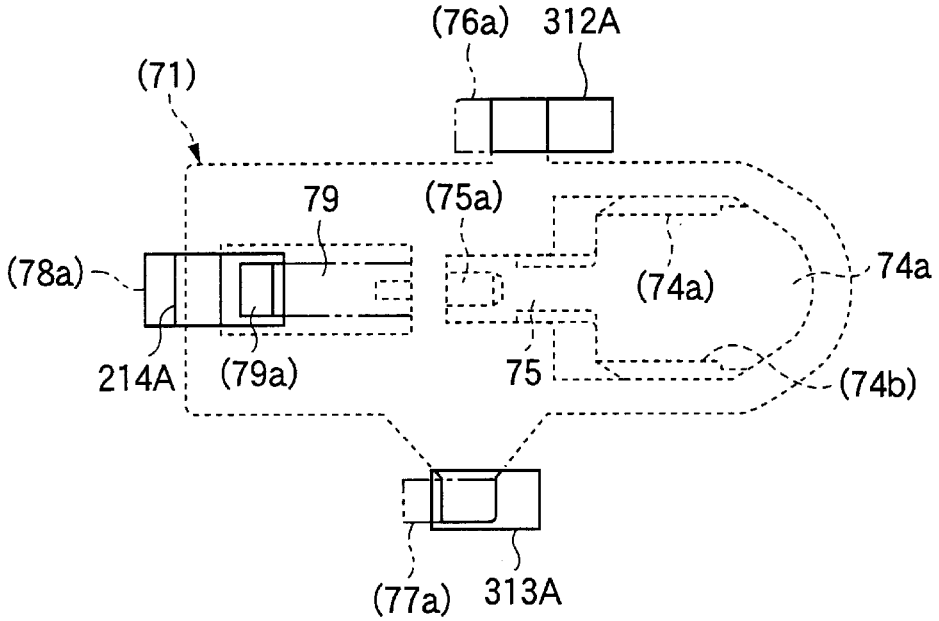
FIGS. 37A and 37B are descriptive views showing a state in which the bearing support members are attached to mount holes of respective support frames.

A development apparatus 100 is mounted on such a support frame 300A through use of the bearing support 70 such as that shown in FIGS. 35 and 37A. The bearing support 70 is primarily constituted of a support main body 71; a bearing slide member 72 to be slidably attached to the support main body 71; and a spring 73 for pressing the bearing slide body 72 in a certain direction.

The entirety of the support main body 71 is constituted into the shape of a short plate. Formed in one end of the support main body 71 are a slide member loading section 74 for enabling slidable loading of the bearing slide member 72 to a forward position (toward a direction in which the photosensitive drum 200 is located) and a spring loading section 75 for loading the spring 73. Formed along the outer brim of the support main body 71 are first through third engaging projection pieces 76 through 78 having hooks 76*a* through 78*a*, the hooks projecting toward the support frame 300A and being bent finally in a rearward direction, and a positioning engaging projection piece 79 having a tip-end hook 79*a* bent toward the support frame 300A.

The slide member loading section 74 is constituted of a space into which the slide member 72 is to be loaded, and guide rails 74*a*, 74*b* are formed on either side of the space so as to be slidably supporting the slide member 72. The spring loading section 75 is constituted of a space defined continuously with the slide member loading section 74 so as to enable loading of the spring 73. A support pin 75*a* is formed at an end opposite the slide body loading section 74 for supporting one end 73*a* of the spring 73. The bearing slide member 72 is constituted of a bearing hole 72*a* for rotatably supporting the rotary shaft 13*c* of the development roller; a slide recess 72*b* into which the guide rails 74*a*, 74*b* are to be fitted; and a support pin 72*c* supporting another end 73*b* of the spring 73. The end 73*a* of the spring 73 is inserted into the support pin 75*a* of the spring loading section 75, and the other end 73*b* of the spring 73 is inserted into the support pin 72*c* of the bearing slide member 72. As a result, the bearing slide member 72 is constantly pressed forward at a predetermined pressure.

Figure 36A:
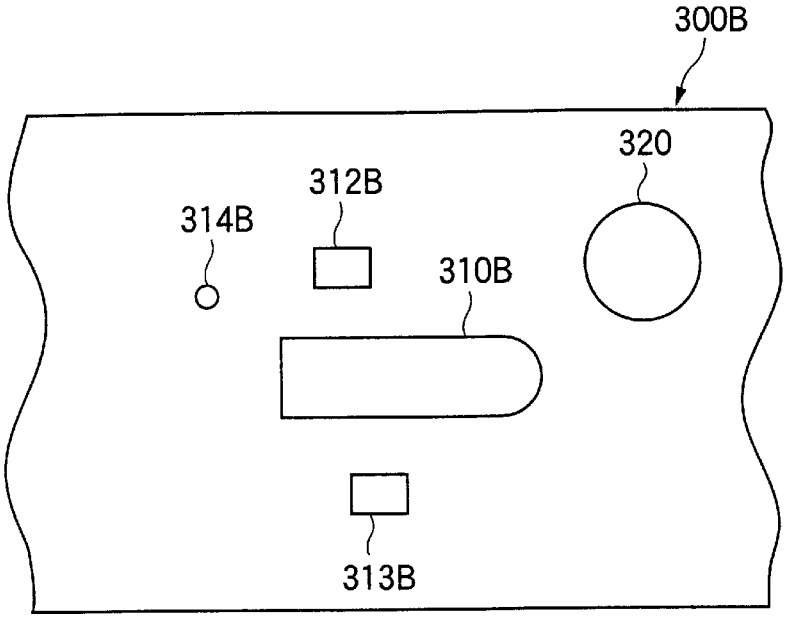
FIG. 36A is a side view showing the principal section showing a support frame on which the apparatus is to be mounted.

As shown in FIG. 36*a*, a support frame 300B is identical in structure with the support frame 300A, except that mount holes 310B, 312B, 313B, and 314B to be used for mounting the development apparatus 1 are slightly different in shape from the mount holes 310A, 312A, 313A, and 314A (FIGS. 34 and 35A).

Figure 36B:
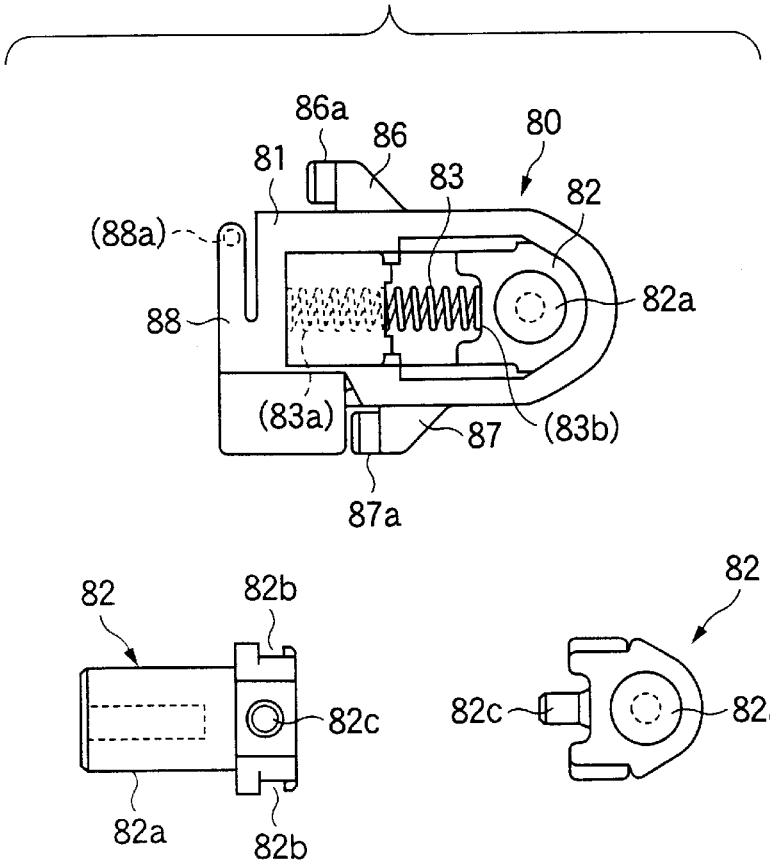
FIG. 36B is a side or rear view showing a bearing support member and its components.
Figure 37B:
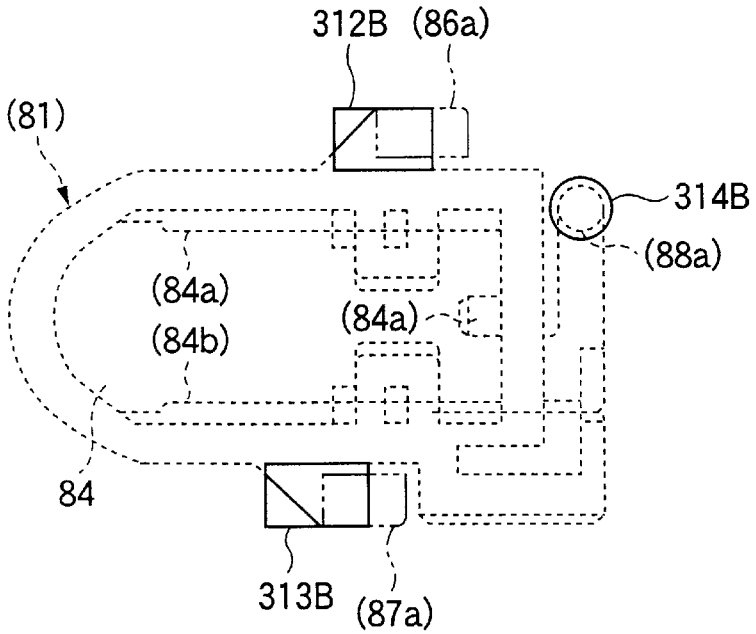

The development apparatus 1 is mounted on the support frame 300B through use of the bearing support 80 such as that shown in FIGS. 36 and 37*b*. The bearing support 80 is in principle constituted of a support main body 81; a bearing slide member 82 slidably attached to the support main body 81; and a spring 83 for pressing the bearing slide member 82 in a certain direction, as in the case of the bearing support member 70.

The entirety of the support main body 81 is constituted into the shape of a short plate. Formed in the support main body 81 is a slide member loading section 84 for enabling slidable loading of the bearing slide member 82 to a forward position (toward a direction in which the photosensitive drum 200 is located). Formed along the outer brim of the support main body 81 are first through third engaging projection pieces 86 through 88 having hooks 86*a* through 88*a*, the hooks projecting toward the support frame 300B and being bent finally in a rearward direction.

The slide member loading section 84 is constituted of a space into which the slid member 82 is to be loaded, and guide rails 84*a*, 84*b* are formed to either side of the space so as to be slidably supporting the slide member 82. A support pin 84*c* for supporting one end 83*a* of the spring 83 is in a rear side end section of the slide member loading section 84. The bearing slide member 82 is constituted of a bearing cylinder section 82*a* for rotatably supporting the rotary shaft 13*c* of the development roller; a slide recess 82*b* into which the guide rails 84*a*, 84*b* are to be fitted; and a support pin 82*c* supporting another end 83*b* of the spring 83. The end 83*a* of the spring 83 is inserted into the support pin 84*c* of the spring loading section 84, and the other end 83*b* of the spring 83 is inserted into the support pin 82*c* of the bearing slide member 82. As a result, the bearing slide member 82 is constantly pressed forward at a predetermined pressure.

The four development apparatus 100 are mounted on the support frame 300A and 300B in the following manner.

First, the center shafts 13*c* and 13*d* of the development roller 13 are inserted into the mount holes 310A, 310B of the support frames 300A, 300B, respectively. At this time, the engaging projection 48 of the first side bracket 40 of the development apparatus 1 and the engaging projection 58 of the second bracket 50 of the same are inserted into engage holes (not shown) formed in the support frames 300A, 300B, respectively. As a result, the development apparatus 1 is temporarily loaded between the support frames 300A, 300B.

Next, the portion of the development apparatus 100 where the rotary shaft 13*c* of the development roller is provided is attached to the support frame 300A by use of the bearing support 70. More specifically, the rotary shaft 13*c* of the development roller 13 projecting from the mount hole 310A of the support frame 300A is inserted into the bearing slide body 72 (of the bearing hole 72*a*) of the bearing support member 70. The first through third engaging projection pieces 76 through 78 of the support member 71 are inserted into the mount holes 312A, 313A, and 314A of the support frame 300A. Then, the support main body 71 is slid rearward by only an amount corresponding to a dimensional difference between the engaging projection pieces and the mount holes, and the hooks 76*a* through 78*a* of the engaging projection pieces 76 through 78 are hooked on the rear ends of the mount holes 312A, 313A, and 314A. Finally, the tip-end hook section 79*a* of the positioning engaging projection piece 79 fits into the mount hole 314A and is engaged and positioned (FIG. 37A). As a result, the bearing support 70 is attached to the support frame 300A. Consequently, the rotary shaft 13*c* of the development roller of the development apparatus 100 is attached to the frame 300A.

Subsequently, the portion of the development apparatus 100 where the rotary shaft 13*d* of the development roller is provided is attached to the support frame 300B by use of the bearing support 80. More specifically, the rotary shaft 13*d* of the development roller 13 projecting from the mount hole 310B of the support frame 300B is inserted into the bearing slide body 82 (of the bearing hole 82*a*) of the bearing support member 80. The first through third engaging projection pieces 86 through 88 of the support member 81 are inserted into the mount holes 312B, 313B, and 314B of the support frame 300B. Then, the support main body 81 is slid rearward by only an amount corresponding to a dimensional difference between the engaging projection pieces and the mount holes, and the hooks 86*a* through 88*a* of the engaging projection pieces 86 through 88 are hooked on the rear ends of the mount holes 312B, 313B, and 314B. Finally, the tip-end hook section 88*a* of the positioning engaging projection piece 88 fits into the mount hole 314B and is engaged and positioned (FIG. 37B). As a result, the bearing support 80 is attached to the support frame 300B. Consequently, the rotary shaft 13*d* of the development roller of the development apparatus 100 is attached to the frame 300B.

Figure 38:
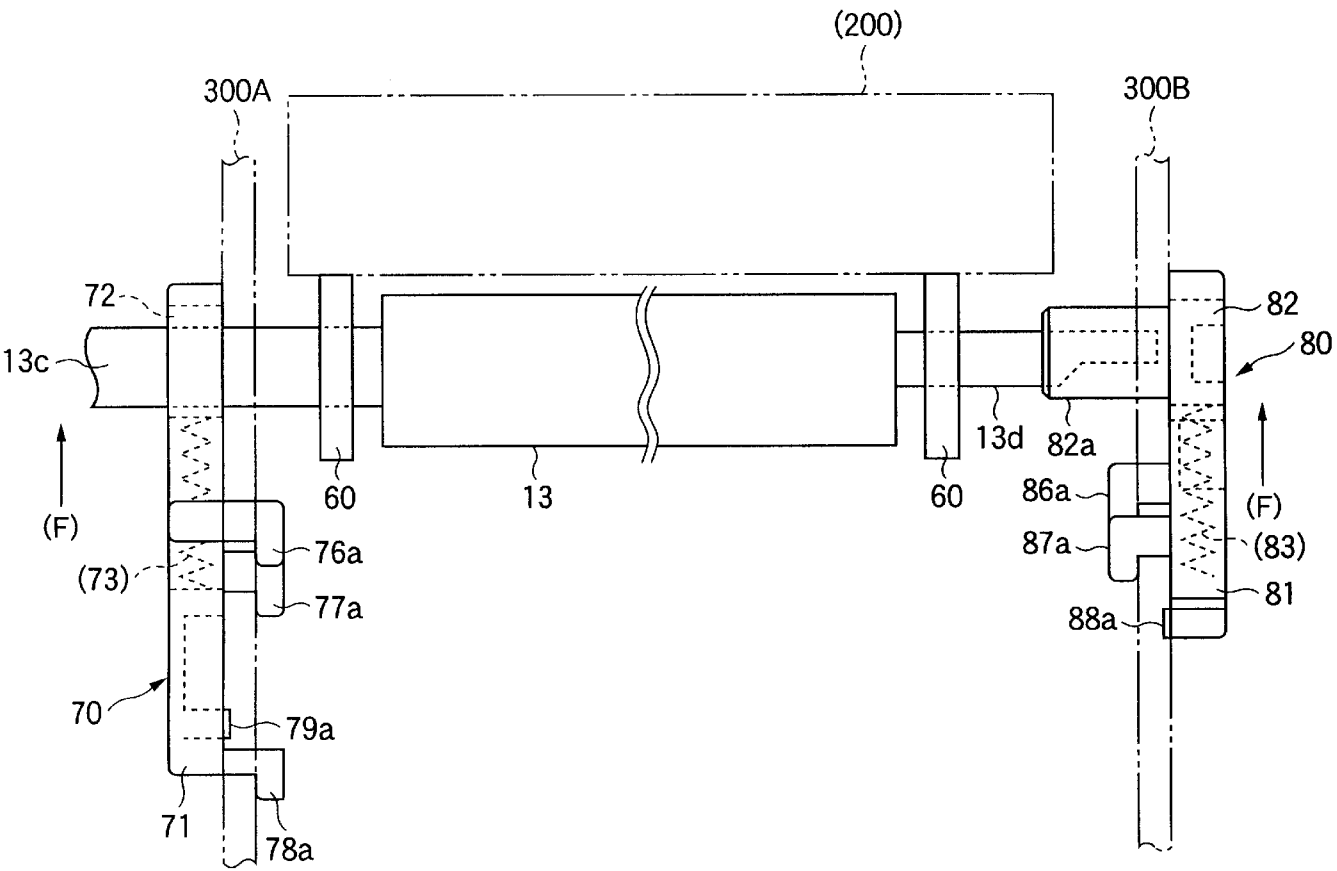
FIG. 38 is a descriptive view of the principal section of the development apparatus when it is mounted.

As shown in FIGS. 33 and 38, the development apparatus 100 is attached to the support frame 300 (300A, 300B). The development apparatus can be readily mounted without involvement of screwing operation or the like.

As a result of mounting of the development apparatus 100, the development roller 13 is brought into contact with the circumferential surface of the end face of the photosensitive drum 200 opposing the clearance retention ring 60 fitted around the rotary shaft 13*c* and that fitted around the rotary shaft 13*d*. As a result, the development roller 13 is disposed opposite the photosensitive drum 200 with a predetermined clearance therebetween. In connection with mounting of the development apparatus 100, the slide members 72, 82 of the bearing supports 70, 89 are pressed forward at a predetermined F. The rotary shafts 13*c* and 13*d* of the development roller 13 are pressed against the photosensitive drum 200 (FIG. 38). The clearance retention ring 60 is brought into reliable contact with the circumferential surface of the end section of the photosensitive drum 200. Accordingly, the development roller 13 is caused to stably oppose the photosensitive drum 200.

<Disassembly of the Development Apparatus>

Disassembly of the development apparatus 100 will now be described.

At the time of disassembly of the development apparatus 100, the development apparatus 100 is removed from the support frame 300.

The disassemble of the development apparatus 100 can be effected by reversing the mounting procedure set forth. That is, the support members 70, 80 are first removed from the support frames 300A, 300B. Specifically, the engaging projection pieces are released from their engaged state (particularly, release of the tip-end hook 79*a* of the positioning engaging projection 79 provided on the bearing support member 70 and release of the hook 88*a* of the engaging projection piece 88 of the bearing support member 80 are performed first). Subsequently, the bearing support members 70, 80 are removed from the rotary shafts 13*c* and 13*d*. Finally, the engaging projections 20*f*, 20*g* of the lower housing 20 of the development apparatus are disengaged from the support frames 300A, 300B, thereby enabling complete removal of the development apparatus 100 from the support frame 300.

At this time, no damage is inflicted on the bearing support members 70, 80 at the time of removal, and hence the bearing support members can easily be reused.

Disassembly of the thus-removed development apparatus 100 will now be commenced. First, the side brackets 40, 50 are removed. The engaging projection 30*b* is disengaged from the engage groove hole 46 of the upper fitting frame section 42 and removed from the housing 10, thereby removing the first side bracket 40. As a result of removal of the first side bracket 40, the idler gear 65 is removed simultaneously. Next, the engaging projection arm section 56 of the lower fitting frame section 53 is disengaged from the recess of the lower housing 20 and removed from the housing 10, thereby removing the second side bracket 50.

Next, the upper housing 30 is removed from the lower housing 20. To this end, the tip of the snap-fit engaging section 37 of the upper housing 30 is resiliently deformed outside until the tip is disengaged from the engaged section 27 of the lower housing 20. The engage hole 36 of the upper housing 30 is pulled and disengaged from the engaging projection piece 26 of the lower housing 20, thereby removing the upper housing 30 from the lower housing 20.

Finally, the components attached to the lower hosing 20 are removed. At first, the roll-shaped layer thickness regulation member 14 and the partition plate 18 are pulled off from the corresponding mount grooves. The development roller 13, the augers 15, 16, and the paddle wheel 17 are removed by means of pulling the driver gears 61 through 64 and the clearance retention rings 60 from the bearing holes 20*a* through 20*c* and the rotary shafts 13*c*, 13*d*, and then pulling the same from the lower housing 20 (FIGS. 20 and 21). The bearing caps 67, the bearing joint 68, and the bearing rings 15*h*, 16*h* are also pulled from the shaft end sections 15*e*, 16*e* and the bearing holes 20*a* through 20*c* (FIGS. 20 and 21).

The development apparatus 100 is disassembled in the foregoing manner. Disassemble of the development apparatus 100 does not involve complicated operation, such as removal of screws or separation of welded sections. Hence, disassembly can be effected very easily.

Disassembly operation does not inflict or cause any damage or break on or in the lower housing 20 and the upper housing 30. This also applies to the rotary members, such as the development roller 13, the augers 15, 16, and the paddle wheel 17, and to other attachments. Thus, particularly the housings 20, 30 can be reused readily. Further, rotary members or other attachments can also be reused, as required.

[Modification of the First Embodiment]

Figure 39A:
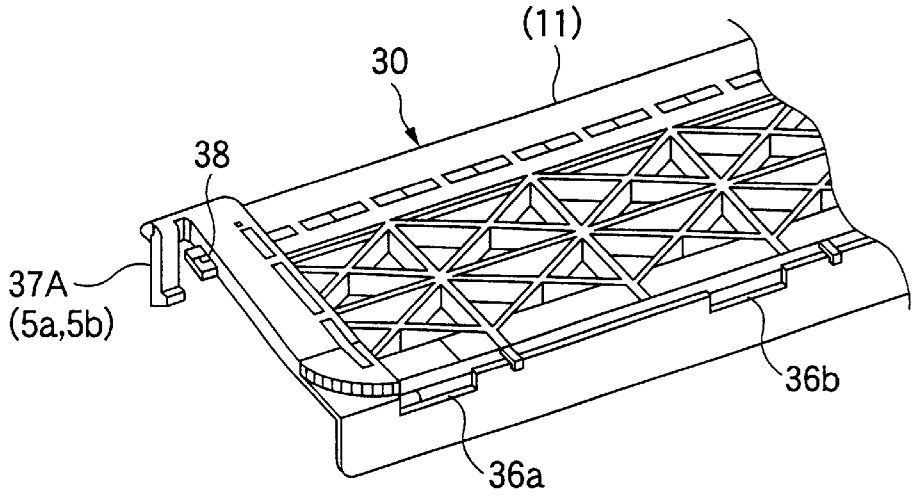
FIGS. 39A and 39B are perspective views showing the principal section of a first modification of a structure for joining together upper and lower housings.
Figure 39B:
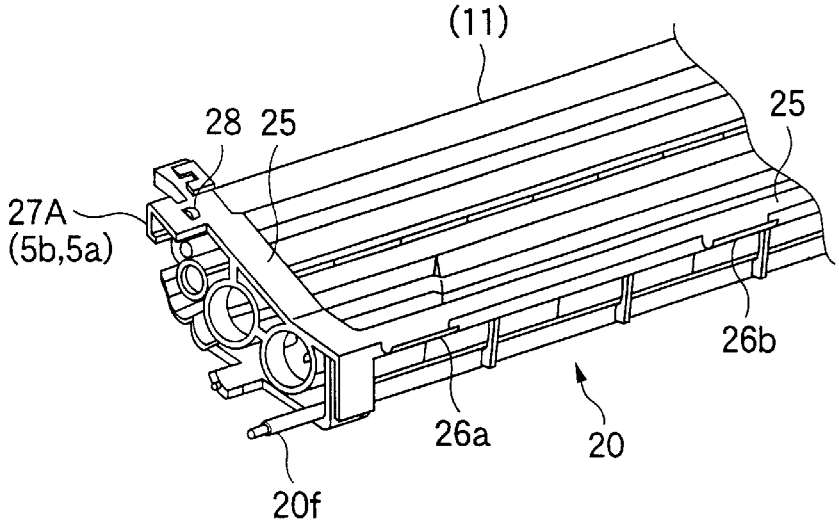

FIG. 39 shows, in the development apparatus according to the first embodiment, an example construction of modifications are made on the construction as follows: the snap-fit engaging section 37 provided in the upper housing 30 is replaced with a thick snap-fit engaging section 37*a* which is less susceptible to resilient deformation. Further, the snap-fit engaged section 27 of the lower housing 20 is replaced with a snap-fit engaged section 27*a*, which is similar to the deformable engaged section 5*a* (5*b*) illustrated in FIG. 3.

In this case, the upper housing 30 is depressed toward the lower housing 20 so that the snap-fit engaged section 27A is engaged with the engaging section 37A after having subjected to resilient deformation and restoration. The housings 20, 30 are then fixedly joined together. In relation to this engaging structure, the snap-fit engaged section 27A which is susceptible to resilient deformation is located inside. Hence, there is surely obviated a chance of the engaged section 27A being disengaged as a result of coming into contact with something. Release of the engaged section 27A from the engaged state can be easily effected, by means of slightly resilient deforming a lower portion of the engaged section 27A inwardly.

Figure 40A:
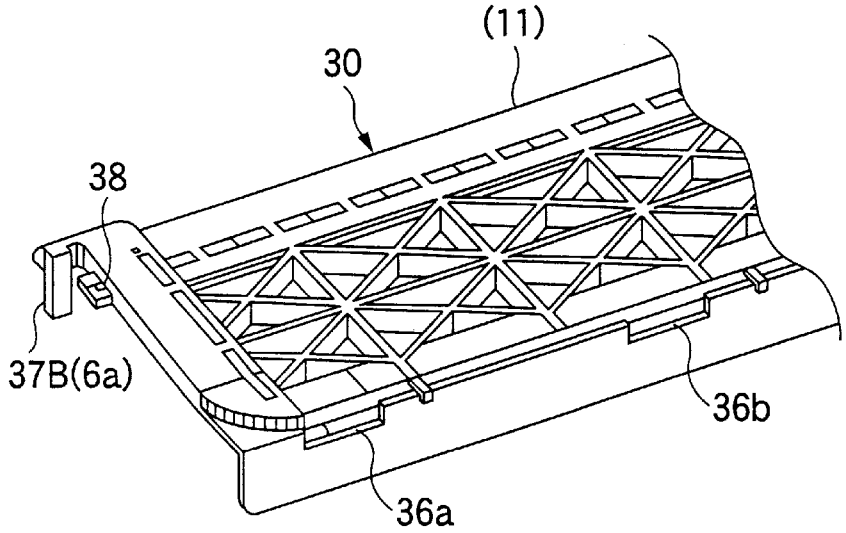
FIGS. 40A and 40B are perspective views showing the principal section of a second modification of a structure for joining together upper and lower housings.
Figure 40B:
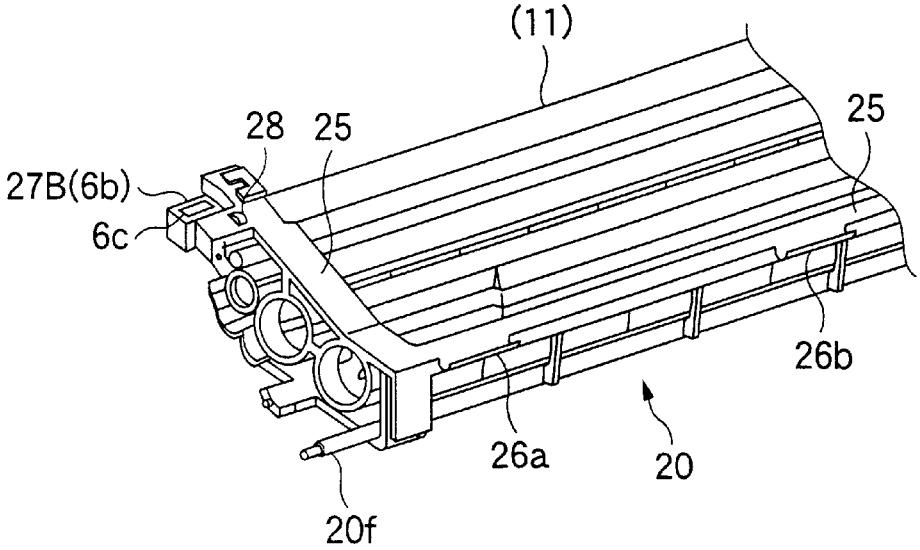

FIG. 40 shows, in the development apparatus according to the first embodiment, an example construction of modification made on the construction as follows: the snap-fit engaging section 37 provided in the upper housing 30 is replaced with a projection engagement section 37B having a projecting structure similar to that of the projection 6*a* illustrated in FIG. 5. Further, the snap-fit engaged section 27 of the lower housing 20 is replaced with a snap-fit engaged section 27B having a fitting hole 6*c* similar to the fitting section 6*b* illustrated in FIG. 5.

In this case, the housings 20, 30 are fixedly joined together, by means of fitting the projection engagement section 37B into the fitting hole 6*c* of the fitted engage section 27B. Engagement between the projection engagement section 37B and the fitted engage section 27B is reinforced finally by means of attachment of the side brackets 40, 50.

Figure 41A:
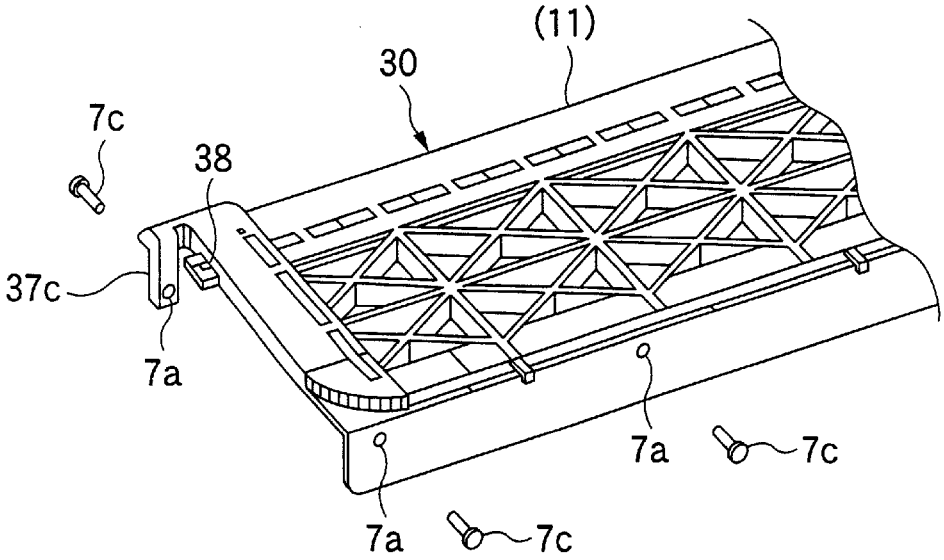
FIGS. 41A and 41B are perspective views showing the principal section of a third modification of a structure for joining together upper and lower housings.
Figure 41B:
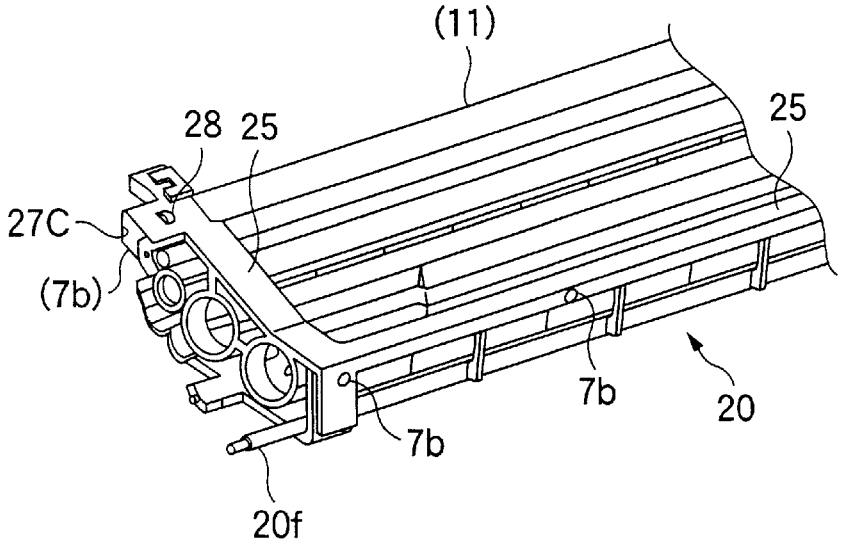
Figure 42A:
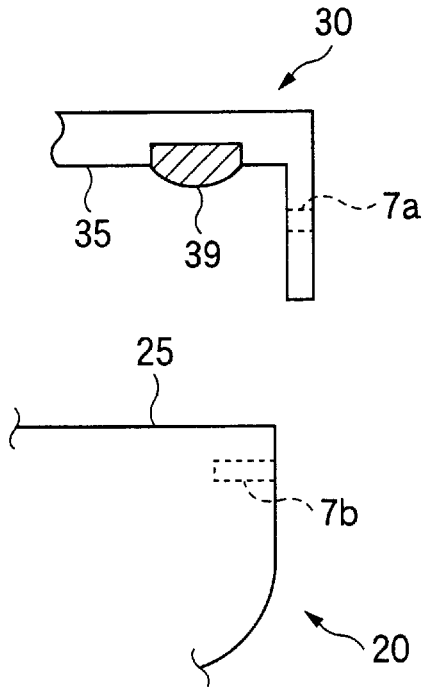
FIGS. 42A and 42B are descriptive views showing the principal section of the structure shown in FIGS. 41A and 41B.
Figure 42B:
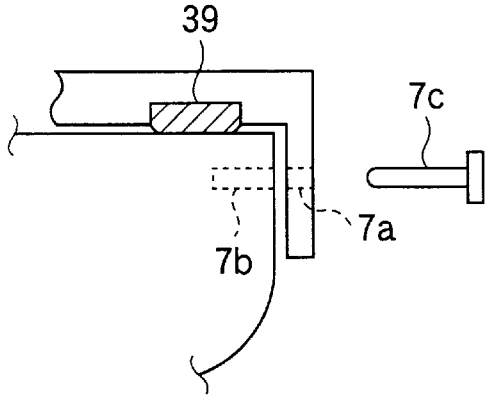

FIGS. 41 and 42 show, in the development apparatus according to the first embodiment, an example construction of modification are made as follows: the snap-fit engaging section 37 provided on the upper housing 30 is changed to an engaging projection piece section 37C having a hole 7*a* such as that illustrated in FIG. 6. Further, a plurality of the holes 7*a* are formed in lieu of the engage holes 36 at intervals. The snap-fit engaged section 27 of the lower housing 20 is changed to a engage section 27C having a hole 7*b* formed therein, the hole 7*b* opposite to the hole 7*a* illustrated in FIG. 6. Further, the holes 7*b* opposite to the holes 7*a* are formed in lieu of the engaging projection pieces 26. The insertion pins 7*c* to be inserted into the holes 7*a*, 7*b* are employed.

In this case, the housings 20, 30 are fixedly joined together by means of joining the upper housing 30 to the lower housing 20 such that the holes 7*a*, 7*c* mutually oppose. Then, the insertion pins 7*c* are inserted into and engaged with the holes 7*a*, 7*c*, thereby fixing the housings 20, 30 together. The insertion pins 7*c* are tightly inserted into the holes 7*a*, 7*c* and are not removed easily. The housings 20, 30 can be easily disengaged from each other by means of pulling the insertion pins 7*c*.

Figure 43A:
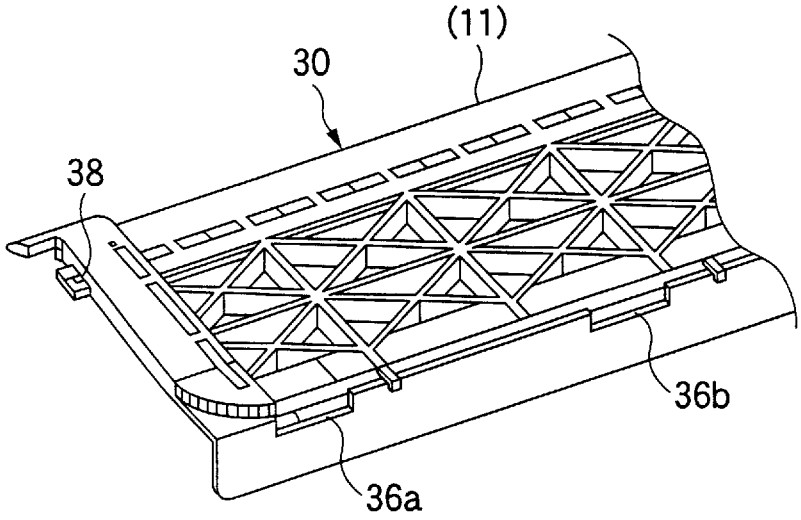
FIGS. 43A and 43B are perspective views showing the principal section of a fourth modification of a structure for joining together upper and lower housings.
Figure 43B:
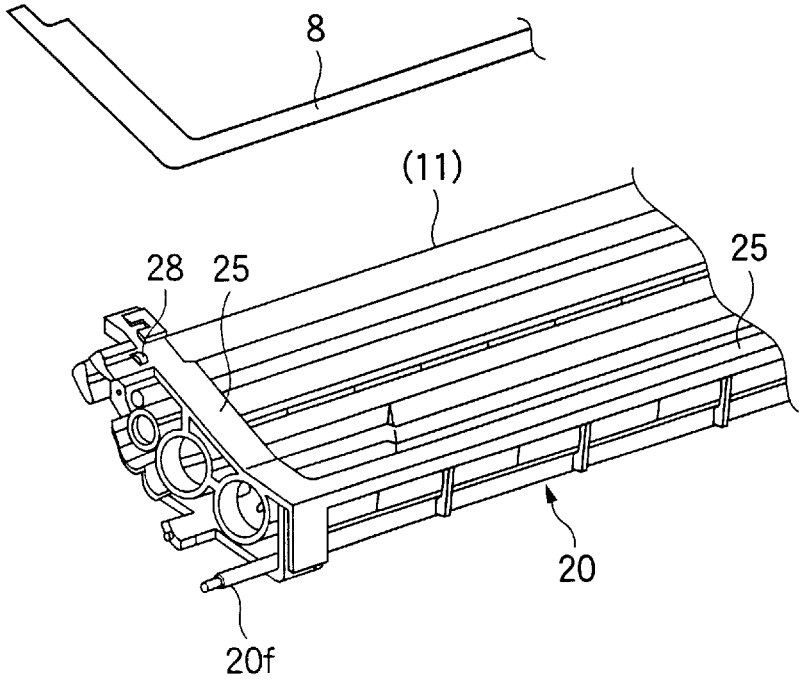

FIG. 43 shows, in the development apparatus according to the first embodiment, an example construction of modification are made as follows: the snap-fit engaging section 37 provided in the upper housing 30 and the snap-fit engaged section 27 provided in the lower housing 20 are removed. There is used a removable double-side adhesive tape 8 interposed between the joining surface section 35 of the upper housing 30 and the joining surface section 25 of the lower housing 20.

In this case, after the removable double-side adhesive tape 8 has been affixed to the joining surface section 25 of the lower housing 20, the upper housing 30 is laid over and joined to the lower housing 20, thereby bringing the joining surface section 35 into close contact with the double-side adhesive tape 8. Thus, the housings 20, 30 are fixedly joined together. The housings 20, 30 can be disengaged from each other, by means of removing the double-side adhesive tape 8 such that the upper housing 30 is separated from the lower housing 20, and peeling the double-side adhesive tape 8 from the lower housing 20.

[Second Embodiment]

Figure 44:
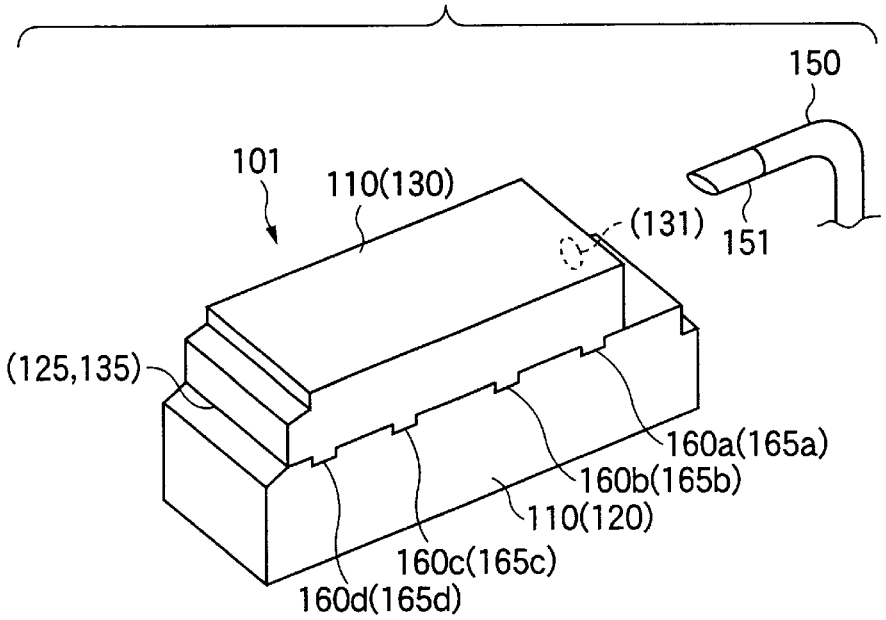
FIG. 44 is a perspective view showing a developer reclaim container according to a second embodiment of the present invention.
Figure 45:
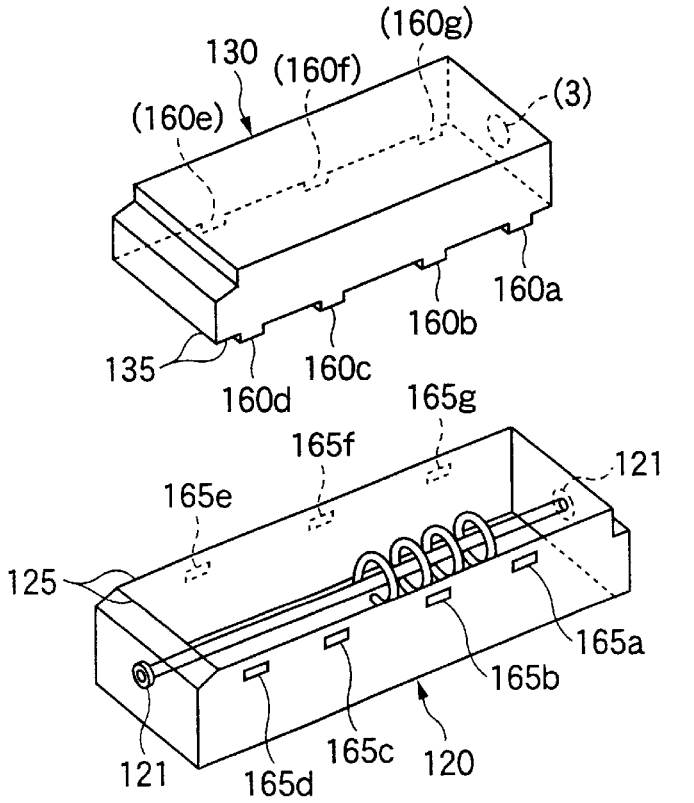
FIG. 45 is an exploded perspective view of the developer reclaim container shown in FIG. 44.
Figure 46:
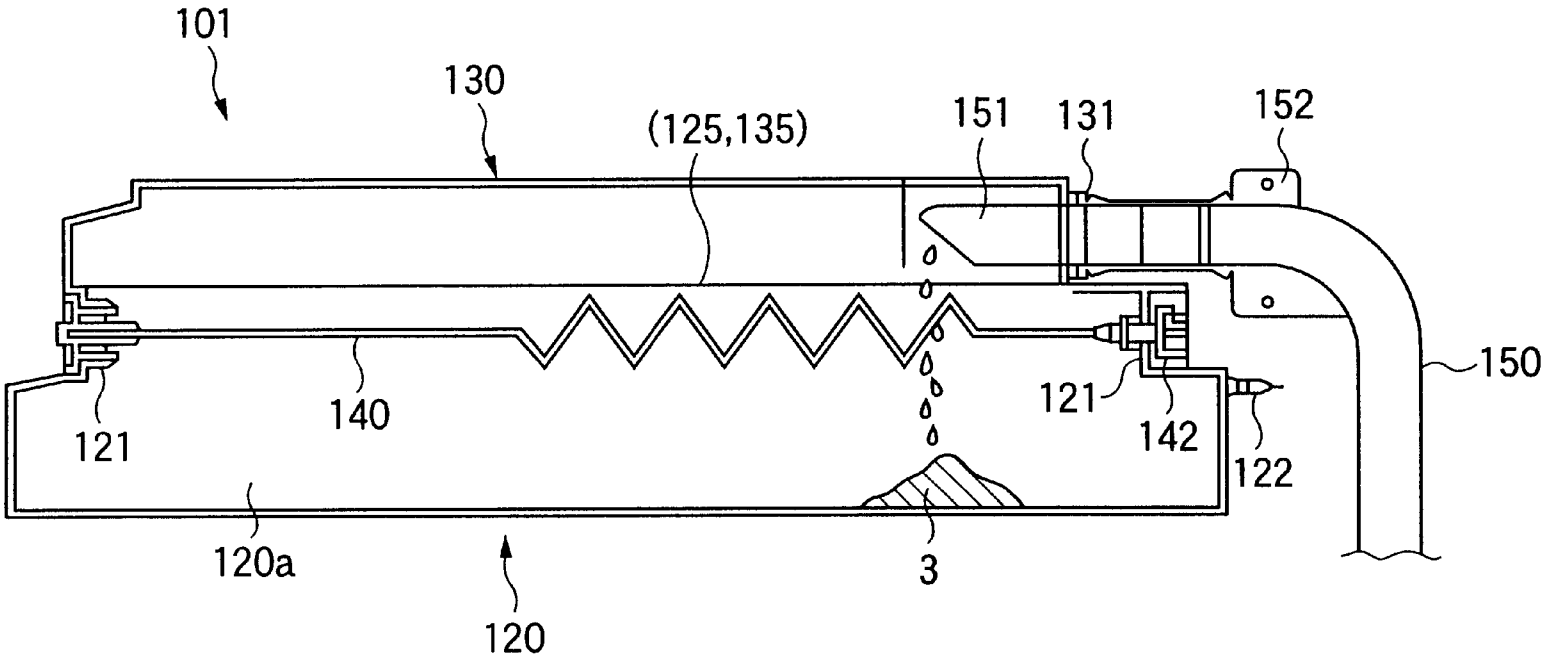
FIG. 46 is a cross-sectional view showing the developer reclaim container shown in FIG. 44.

FIGS. 44 through 46 show a developer reclaim container serving as the developer handling apparatus according to the present invention. FIG. 44 is a perspective view of the developer reclaim container; FIG. 45 is an exploded perspective view of the same; and FIG. 46 is a cross-sectional view of the same when the container is used.

The principal section of a developer reclaim container 101 comprises a container main body 110 whose entire shape is of a rectangular-parallelepiped box; and a developer agitation and leveling member 140 helically formed from a wire. The container main body 110 is constituted of a lower main body 120 and an upper main body 130, which are vertically divided.

The upper main body 130 acts like a closure. An insertion port 131 is formed at one end of the upper main body 130, and an insertion section 151 of a developer conveyor pipe for transporting the developer 3 is to be inserted into the insertion port 131. The lower main body 120 assumes a shape consisting of a storage space 120*a* for storing the developer 3. A bearing section 121 is formed on either side surface section of the lower main body 120, and the bearing section 121 rotatably, removably supports a shaft end section of the developer agitation leveling member 140. As shown in FIG. 46, reference numeral 142 designates a sprocket for coupling the shaft end section of the developer agitation leveling member 140 with an unillustrated rotary drive shaft;

122 designates a positioning pin used for attaching a container main body 110 to a predetermined loading position; and 152 designates mount hardware for mounting a developer conveyor pipe 150.

In connection with the lower main body 120 and the upper main body 130 of the container main boy 110, a plurality of snap-fit engaging sections (each having a hook-shaped tip) 160*a* through 160*g* are formed on a joining section 135 of the upper main body 130. Corresponding engaged sections (assuming, e.g., recessed shapes) 165*a* through 165*g* are formed in a joining section 125 of the lower main body 120. The engaging sections 160*a* through 160*g* and the engaged sections 165*a* through 165*g* are engaged with each other, thereby joining together the lower main body 120 and the upper main body 130. In this case, the engaging sections 160*a* through 160*g* are formed so as to become resiliently deformable.

The developer agitation leveling member 140 is attached to the lower main body 120 of the container main body 110. The upper main body 130 is joined on top of the lower main body 120, thereby causing the snap-fit engaging sections 160*a* through 160*g* to engage with the engaged sections 165*a* through 165*g*, to thereby fixedly join together the lower main body 120 and the upper main body 130. Thus, the developer reclaim container 101 is assembled.

The developer reclaim container 101 is attached to a predetermined loading position, and the sprocket 142 of the developer agitation leveling member 140 is connected to the rotary drive shaft. The insertion section 151 of the developer conveyor pipe 150 is inserted into the insertion hole 131 of the upper main body 130, whereby the developer reclaim container 101 can be used. When the developer 3 is transported from the developer conveyer pipe 150 connected to a cleaning device or a trickle-type development apparatus, the developer 3 is discharged by and falls from the insertion section 151 and is stored in the storage space 120*a* of the lower main body 120. The thus-stored developer 3 gradually accumulates. The thus-accumulated developer 3 is then agitated and leveled by the developer agitation leveling member 140, thus accumulating substantially uniformly in the storage space 120*a* of the lower main body 120.

After the snap-fit engaging sections 160*a* through 160*g* are disengaged from the engaged sections 165*a* through 165*g*, the upper main body 130 is removed from the lower main body 120, thus disassembling the developer reclaim container 101. Further, the developer agitation leveling member 140 is removed from the lower main body 120, thus completing disassembly of the developer reclaim container 101.

As has been described, in relation to the developer handling apparatus according to the present invention, even when there is adopted a construction involving division of the housing into two or more segments, the assembly and disassembly of the developer handling apparatus are relatively easy, and reuse of the developing handling apparatus is easy.

What is claimed is:

1. A developer handling apparatus comprising:

a casing including:

a storage section for storing a developer; and an opening section for passing the developer therethrough; and a rotary member disposed to rotate within the casing, wherein the casing is a structural body assembled by fixedly joining together a plurality of split housing pieces;

joining sections of at least a part of the split housing pieces are made of synthetic resin;

the joining sections are fixedly joined together so that damage is not inflicted on the joining sections when the split housing pieces are disassembled; and wherein an auxiliary fixing member is attached to the casing to prevent at least the part of the split housing pieces from moving in a direction in which the part of the split housing pieces depart from each other.

2. The developer handling apparatus according to claim 1, wherein at least the part of the split housing pieces is split housings detachable from each other.

3. A developer handling apparatus comprising:

a casing including a storage section for storing a developer; and an opening section for passing the developer therethrough; and a rotary member disposed to rotate within the casing, wherein the casing is a structural body assembled by fixedly joining together a plurality of split housing pieces; and at least a part of the split housing pieces are fixed together only by a fixing member;

wherein an auxiliary fixing member is attached to the casing to prevent at least the part of the split housing pieces from moving in a direction in which the part of the split housing pieces depart from each other.

4. The developer handling apparatus according to claim 3, wherein the fixing member includes a resilient engaging member pushed in against resilient deformation force and engaged under restoration force.

5. The developer handling apparatus according to claim 3, wherein the fixing member includes a projecting section and a receiving section into which the projecting section is to be fixedly fitted.

6. The developer handling apparatus according to claim 3, wherein the fixing member includes holes which are opposite to each other when the split housing pieces are joined together; and an insertion member fixedly inserted into the mutually-opposite holes.

7. The developer handling apparatus according to claim 3, wherein the fixing member includes a removable material having adhesion properties; and the split housing pieces are adhered to each other while sandwiching the removable material therebetween.

8. The developer handling apparatus according to claim 3, wherein at least a part of the split housing pieces is a split housing requiring disassembly.

9. The developer handling apparatus according to claim 4, wherein the resilient engaging member includes an engaging section and an engaged section, which are formed integrally on at least the part of the split housing pieces, respectively.

10. The developer handling apparatus according to claim 4, wherein the resilient engaging member is pressed into a joining section of at least the part of the split housing pieces against the resilient deformation force and engaged under restoration force; and the resilient engaging member is different from the part of the split housing pieces.

11. The developer handling apparatus according to claim 9, wherein one of the engaging section and the engaged section is formed to be resiliently-deformable; and the resiliently-deformable one of the engaging section and the engaged section is situated in an outer position when the engaging section and the engaged section are engaged with each other.

12. The developer handling apparatus according to claim 9, wherein one of the engaging section and the engaged section is formed to be resiliently-deformable; and the resiliently-deformable one of the engaging section and the engaged section is situated in an inner position when the engaging section and the engaged section are engaged with each other.

13. The developer handling apparatus according to claim 3, further comprising a shaft support section for supporting a shaft of the rotary member, wherein the fixing member is disposed at a position on a joining section between the split housing pieces, the position being at least in the vicinity of the shaft support section.

14. The developer handling apparatus according to claim 3, wherein a plurality of the fixing members are provided on a joining section between at least the part of the split housing pieces at intervals; and the auxiliary fixing member is provided at a position on the joining section differing from the position of the fixing members.

15. The developer handling apparatus according to claim 3, wherein a plurality of the fixing members are provided on a joining section between at least the part of the split housing pieces at intervals; and the auxiliary fixing member is provided at a position on the joining section coincident with the position of the fixing members.

16. The developer handling apparatus according to claim 3, wherein a plurality of the fixing members are provided on a joining section between at least the part of the split housing pieces at intervals; and the auxiliary fixing members are provided at a position on the joining section differing from the position of the fixing members and provided at a position on the joining section coincident with the positions of the fixing members.

17. The developer handling apparatus according to claim 3, wherein a resilient member is disposed on a part or the entire joining section between at least the part of the split housing pieces.

18. The developer handling apparatus according to claim 3, wherein the casing is a housing; and the rotary member includes a development roller.

19. The developer handling apparatus according to claim 18, wherein the split housing pieces are a first housing and a second housing and are divided vertically;

the fixing member is a plurality of fixing members; and the fixing members are provided at a position on a joining section between the first and second housings in the vicinity of a shaft support section for supporting the shaft of the development roller and is provided at other position.

20. The developer handling apparatus according to claim 18, further comprising a side bracket, wherein the side bracket is attached to side end sections of end portions of the development roller of the housing assembled by fixedly joining together the first housing and the second housing so that the side brackets are fitted to clamp the side end sections from the outside; and the side bracket prevents the first housing and the second housing from moving in a direction in which the first housing and the second housing depart from each other.

21. The developer handling apparatus according to claim 19, wherein the side brackets are formed in a shape to clamp the side end sections in conjunction with the fixing member attached to the shaft support section of the development roller from outside.

22. The developer handling apparatus according to claim 20, wherein the rotary member attached to the casing further includes one of a developer agitating-and-transporting member and a developer supply member;

a torque transmission mechanism for transmitting torque of each of the rotary members is disposed outside of one side end section of the housing; and the side bracket is formed in a cover structure covering the torque transmission mechanism.

23. The developer handling apparatus according to claim 21, wherein the rotary member attached to the casing further includes one of a developer agitating-and-transporting member and a developer supply member;

a torque transmission mechanism for transmitting torque of each of the rotary members is disposed outside of one side end section of the housing; and the side bracket is provided with a bearing section for receiving the shaft of each of the rotary sections and a support section for supporting the torque transmission mechanism for use with the bearing.

24. The developer handling apparatus according to claim 3, further comprising a parallel layout component disposed in parallel to and spaced a predetermined distance away from the development roller, wherein a receiving recess is formed in the interior of the side end section of the second housing for receiving an end section of the parallel layout component; and a squeezing projection for squeezing the parallel layout component fitted into the receiving recess from above is formed in the first housing to fasten the parallel layout component.

25. The developer handling apparatus according to claim 15, wherein a shaft end section of the development roller is formed to project outside of the housing;

an engaging projection projecting in the same direction as that in which the shaft end section of the development roller projects is formed in a portion of the housing;

the shaft end section of the development roller is supported on a support frame for rotatably supporting the shaft end of an image carrier on which an electrostatic latent image to be developed is formed through the bearing support; and the engaging projection is engaged to an engaging section formed in the support frame to attach a development apparatus to the support frame.

26. A method of assembling a developer handling apparatus comprising:

a casing including;

a storage section for storing a developer and an opening section for passing the developer therethrough; and a rotary member disposed to rotate within the casing, wherein the casing is a structural body assembled by fixedly joining together a plurality of split housing pieces; and at least a part of the split housing pieces are fixed together only by at least one fixing member, the method comprising the steps of:

attaching the rotary member to a predetermined split structural body of the plurality of split housing pieces;

joining together the plurality of split housing pieces; and fastening together the joined split housing pieces by the at least one fixing member; and attaching an auxiliary fixing member to the casing to prevent at least the part of the split housing pieces from moving in a direction in which the part of the split housing pieces depart from each other.

27. A method of disassembling a developer handling apparatus comprising:

a casing including a storage section for storing a developer, and an opening section for passing the developer therethrough; and a rotary member disposed to rotate within the casing, another attachment component different from the rotary member, wherein the casing is a structural body assembled by fixedly joining together a plurality of split housing pieces; and at least a part of the split housing pieces are fixed together only by at least one fixing member, the method comprising the steps of:

releasing the at least one fixing member from a fixed state;

separating apart the split housing pieces released from the fixed state; and removing the rotary member from the predetermined split housing detaching the another attachment component at the time of disassembly; and the rotary member and the other attachment member are attached to at least the part of the split housing pieces.

28. A developer handling apparatus comprising:

a casing including:

a storage section for storing a developer, and an opening section for passing the developer therethrough; and a rotary member disposed to rotate within the casing, another attachment component different from the rotary member, wherein the casing is a structural body assembled by fixedly joining together a plurality of split housing pieces;

joining sections of at least a part of the split housing pieces are made of synthetic resin; and the joining sections are fixedly joined together so that damage is not inflicted on the joining sections when the split housing pieces are disassembled;

wherein it is necessary for detaching the another attachment component at a time of disassembly; and the rotary member and the another attachment member are attached to at least the part of the split housing pieces.

29. A developer handling apparatus comprising:

a casing including:

a storage section for storing a developer; and an opening section for passing the developer therethrough; and a rotary member disposed to rotate within the casing, another attachment component different from the rotary member, wherein the casing is a structural body assembled by fixedly joining together a plurality of split housing pieces; and at least a part of the split housing pieces are fixed together only by a fixing member;

wherein it is necessary for detaching the another attachment component at a time of disassembly; and the rotary member and the other attachment member are attached to at least the part of the split housing pieces.

* * * * *